US012138740B2

(12) United States Patent
Otani

(10) Patent No.: US 12,138,740 B2
(45) Date of Patent: Nov. 12, 2024

(54) WHEEL COVER FOR ELECTRIC TOOL

(71) Applicant: MAKITA CORPORATION, Anjo (JP)

(72) Inventor: Ryosuke Otani, Anjo (JP)

(73) Assignee: MAKITA CORPORATION, Anjo (JP)

( * ) Notice: Subject to any disclaimer, the term of this patent is extended or adjusted under 35 U.S.C. 154(b) by 887 days.

(21) Appl. No.: 17/252,317

(22) PCT Filed: Jul. 11, 2019

(86) PCT No.: PCT/JP2019/027487

§ 371 (c)(1),
(2) Date: Dec. 15, 2020

(87) PCT Pub. No.: WO2020/026747

PCT Pub. Date: Feb. 6, 2020

(65) Prior Publication Data

US 2021/0260722 A1 Aug. 26, 2021

(30) Foreign Application Priority Data

Aug. 1, 2018 (JP) ..... 2018-145086
May 22, 2019 (JP) ..... 2019-096120

(51) Int. Cl.
*B24B 55/05* (2006.01)
*B24B 23/02* (2006.01)

(52) U.S. Cl.
CPC ..... *B24B 55/052* (2013.01); *B24B 23/028* (2013.01)

(58) Field of Classification Search
CPC ..... B24B 55/052; B24B 55/05; B24B 55/102; B24B 55/04; B24B 45/00; B24B 23/028;
(Continued)

(56) References Cited

U.S. PATENT DOCUMENTS 10,478,943 B2 * 11/2019 Nakamura ..... B24B 23/02
11,072,052 B2 * 7/2021 Aiken ..... B24B 55/04
(Continued)

FOREIGN PATENT DOCUMENTS

CN 204076022 U * 1/2015 ..... B23D 59/00
CN 204076022 U 1/2015
(Continued)

OTHER PUBLICATIONS

Machine translation of CN-204076022-U (Year: 2015).*
(Continued)

*Primary Examiner* — Robert F Neibaur
(74) *Attorney, Agent, or Firm* — Oliff PLC

(57) ABSTRACT

A wheel cover including a first cover attachable to a body of a power tool and a second cover removably attachable to the first cover reduces rattling of the second cover. The wheel cover includes a first cover attachable to a body of the power tool to cover at least a portion of a first surface of the tip tool adjacent to the body of the power tool, a second cover removably attachable to the first cover to cover at least a portion of a second surface of the tip tool opposite to the body of the power tool, and a rattle restrainer that reduces, while the second cover is attached to the first cover, rattling of the second cover relative to the first cover.

19 Claims, 39 Drawing Sheets

(58) Field of Classification Search
CPC ..... B24B 23/022; B24B 23/08; B24B 23/02; B24B 23/00; B24B 27/08; B23Q 11/0078; B23Q 11/089; B23Q 11/08; B23Q 11/0891
USPC ..... 451/359
See application file for complete search history.

(56) References Cited

U.S. PATENT DOCUMENTS

| | | | | |
|---|---|---|---|---|
| 2006/0068690 | A1 | 3/2006 | Koschel et al. | |
| 2013/0283622 | A1* | 10/2013 | Eto | B26B 25/002 30/164 |
| 2017/0072532 | A1 | 3/2017 | Kawakami et al. | |
| 2017/0072534 | A1 | 3/2017 | Nakamura et al. | |
| 2017/0072535 | A1* | 3/2017 | Iwakami | B24B 55/052 |
| 2019/0358774 | A1* | 11/2019 | Tong | B24B 55/052 |

FOREIGN PATENT DOCUMENTS

| | | | |
|---|---|---|---|
| CN | 106514468 | A | 3/2017 |
| DE | 102008022294 | A1 | 10/2009 |
| JP | 2017-052061 | A | 3/2017 |
| JP | 2017-052063 | A | 3/2017 |

OTHER PUBLICATIONS

Oct. 8, 2019 International Search Report issued in International Patent Application No. PCT/JP2019/027487.
Feb. 28, 2022 Office Action issued in Chinese Patent Application No. 201980040327.2.
May 9, 2023 Office Action issued in Japanese Patent Application No. 2019-096120.
Feb. 2, 2021 International Preliminary Report on Patentability issued in International Patent Application No. PCT/JP2019/027487.

* cited by examiner

WHEEL COVER FOR ELECTRIC TOOL

FIELD

The present disclosure relates to a wheel cover for covering a disk-shaped tip tool attached to a power tool for machining performed by rotating the tip tool.

BACKGROUND

A wheel cover is used to cover a tip tool attached to a power tool to reduce scattering of sparks and dust in machining of a workpiece performed by rotating the tip tool. The wheel cover may cover a larger portion of the tip tool to more effectively reduce scattering. However, the wheel cover may interfere with a workpiece during machining and lower the machining performance of the power tool on the workpiece.

A wheel cover that can cover a different portion of a tip tool may be used in accordance with the type of the tip tool (in other words, the machining operation) to prevent such interference with a workpiece during machining.

For example, for grinding or polishing, a workpiece is machined with the face of a tip tool. A wheel cover may simply cover a portion of the tip tool adjacent to the body of the power tool corresponding to substantially half the periphery of the tip tool.

For cutting, a workpiece is cut with a blade on the periphery of a tip tool. A wheel cover may simply cover a surface portion of the tip tool adjacent to the body of the power tool and another surface portion of the tip tool opposite to the power tool body, both corresponding to substantially half the periphery of the tip tool.

To cover a different surface portion of a tip tool in accordance with the machining operation, a different wheel cover may be prepared for every machining operation in this manner. However, a wheel cover prepared for every machining operation is to be attached to and detached from the power tool for every operation. This replacement work can be troublesome.

A known wheel cover includes a first cover attached to a body of a power tool to cover a surface portion of a tip tool adjacent to the power tool body corresponding to substantially half the periphery of the tip tool, and a second cover removably attached to the first cover to cover another surface portion of the tip tool opposite to the first cover (refer to, for example, US2006/0068690, hereafter Patent Literature 1; and DE102008022294, hereafter Patent Literature 2).

The known wheel cover includes the first cover attached to the power tool body, and the second cover that is attachable to the first cover when a cutting operation is to be performed on a workpiece, thus covering the two opposite surface portions of the tip tool. This structure eliminates the replacement work of the wheel cover on the power tool body and improves the usability of the power tool.

BRIEF SUMMARY

Technical Problem

The known wheel cover includes the second cover to be attached to the first cover to cover the periphery. The second cover is secured to the first cover by engagement with engagement portions on two circumferential ends of the first cover or with an engagement portion on the surface of the first cover facing the tip tool. The second cover is designed to be larger than the first cover for attachment to the first cover by accommodating dimensional variations resulting from manufacture.

However, the second cover, which is thus attachable to the first cover, may rattle relative to the first cover due to vibrations or other factors in use of the power tool with the second cover. This may lower the operability of the power tool. The rattling second cover may cause wear of the engagement portions between the first cover and the second cover. This may easily degrade the wheel cover.

One or more aspects of the present disclosure are directed to a wheel cover including a first cover attachable to a body of a power tool and a second cover removably attachable to the first cover to reduce rattling of the second cover in use of the power tool.

Solution to Problem

An aspect of the present disclosure provides a wheel cover for covering a disk-shaped tip tool attached to an output shaft of a power tool, the wheel cover including:

- a first cover attachable to a body of the power tool to cover at least a portion of a first surface of the tip tool, the first surface being adjacent to the body of the power tool;
- a second cover removably attachable to the first cover to cover at least a portion of a second surface of the tip tool, the second surface being opposite to the body of the power tool; and
- a rattle restrainer configured to reduce, while the second cover is attached to the first cover, rattling of the second cover relative to the first cover.

Advantageous Effects

The wheel cover according to the above aspect of the present disclosure includes the first cover attachable to the body of the power tool and the second cover removably attachable to the first cover to reduce rattling of the second cover in use of the power tool.

DETAILED DESCRIPTION

Embodiments of the present disclosure will now be described with reference to the drawings.

First Embodiment

Figure 1:
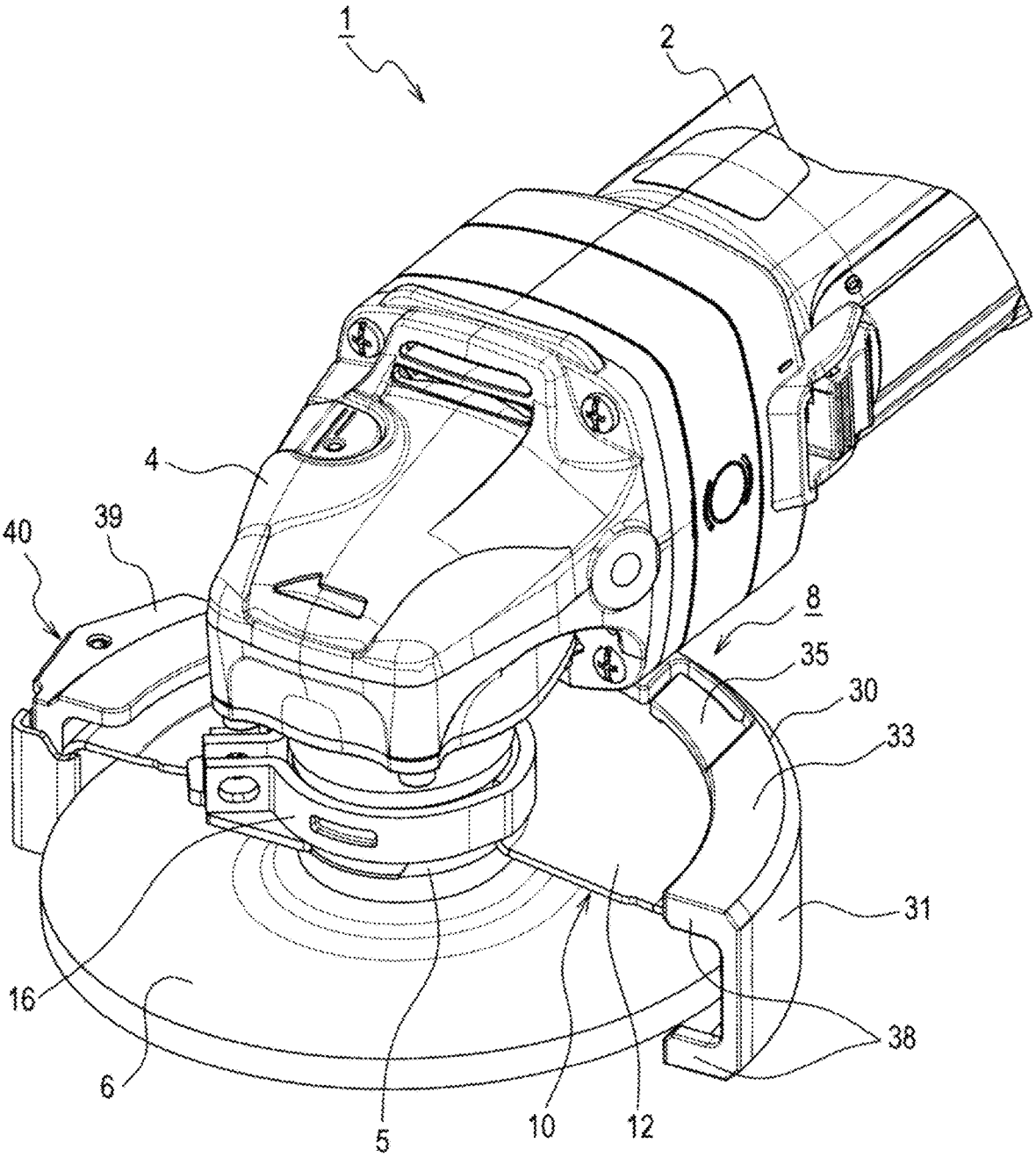
FIG. 1 is an external perspective view of a grinder according to a first embodiment.

As shown in FIG. 1, a grinder 1 according to the present embodiment is a handheld power tool (disk grinder) used to machine a workpiece by rotating a disk-shaped tip tool 6. Machining herein includes grinding, polishing, and cutting.

The grinder 1 includes a motor housing 2 and a gear housing 4, both serving as a housing for a body of the grinder.

The motor housing 2 accommodates a motor. The motor housing 2 is substantially cylindrical and grippable by a user. The rotational shaft of the motor protrudes into the gear housing 4, which is located in front of the motor housing 2.

The rear of the motor housing 2, which is opposite to the gear housing 4, is covered with a rear cover accommodating a drive circuit of the motor and other components.

The gear housing 4 covers a front opening of the motor housing 2. The gear housing 4 accommodates a gear assembly, which is connected to the rotational shaft of the motor and transmits the rotation of the motor to an output shaft 5 orthogonal to the rotational shaft of the motor.

The output shaft 5 protrudes downward from the gear housing 4 in FIG. 1. The output shaft 5 receives the tip tool 6 fastened with a lock nut. The structure for attaching the tip tool 6 to the output shaft 5 and the internal structures of the motor housing 2 and the gear housing 4 are described in, for example, Patent Literatures 1 and 2 and will not be described in detail.

In the grinder 1, the motor is driven by the drive circuit in the rear cover, and the rotation of the motor is transmitted to the output shaft 5 via the gear assembly in the gear housing 4.

With the tip tool 6 fastened to the output shaft 5 with the lock nut, the motor rotates the tip tool 6 to perform an operation such as grinding, polishing, or cutting. The tip tool 6 is, for example, a grinding disk, a cutting disk, or a wire brush.

The gear housing 4 includes a cylindrical portion into which the output shaft 5 protrudes. The cylindrical portion is coaxial with the center axis of the output shaft 5 and surrounds the output shaft 5. A wheel cover 8 is attached to the periphery of the cylindrical portion.

The wheel cover 8 reduces scattering of sparks or dust toward the operator during machining of a workpiece.

The wheel cover 8 according to the present embodiment is fastened to the cylindrical portion of the gear housing 4 surrounding the output shaft 5. The wheel cover 8 includes a first cover 10 and a second cover 30. The first cover 10 is located adjacent to the gear housing 4 and covers the tip tool 6. The second cover 30 is removably attachable to the first cover 10.

Figure 2:
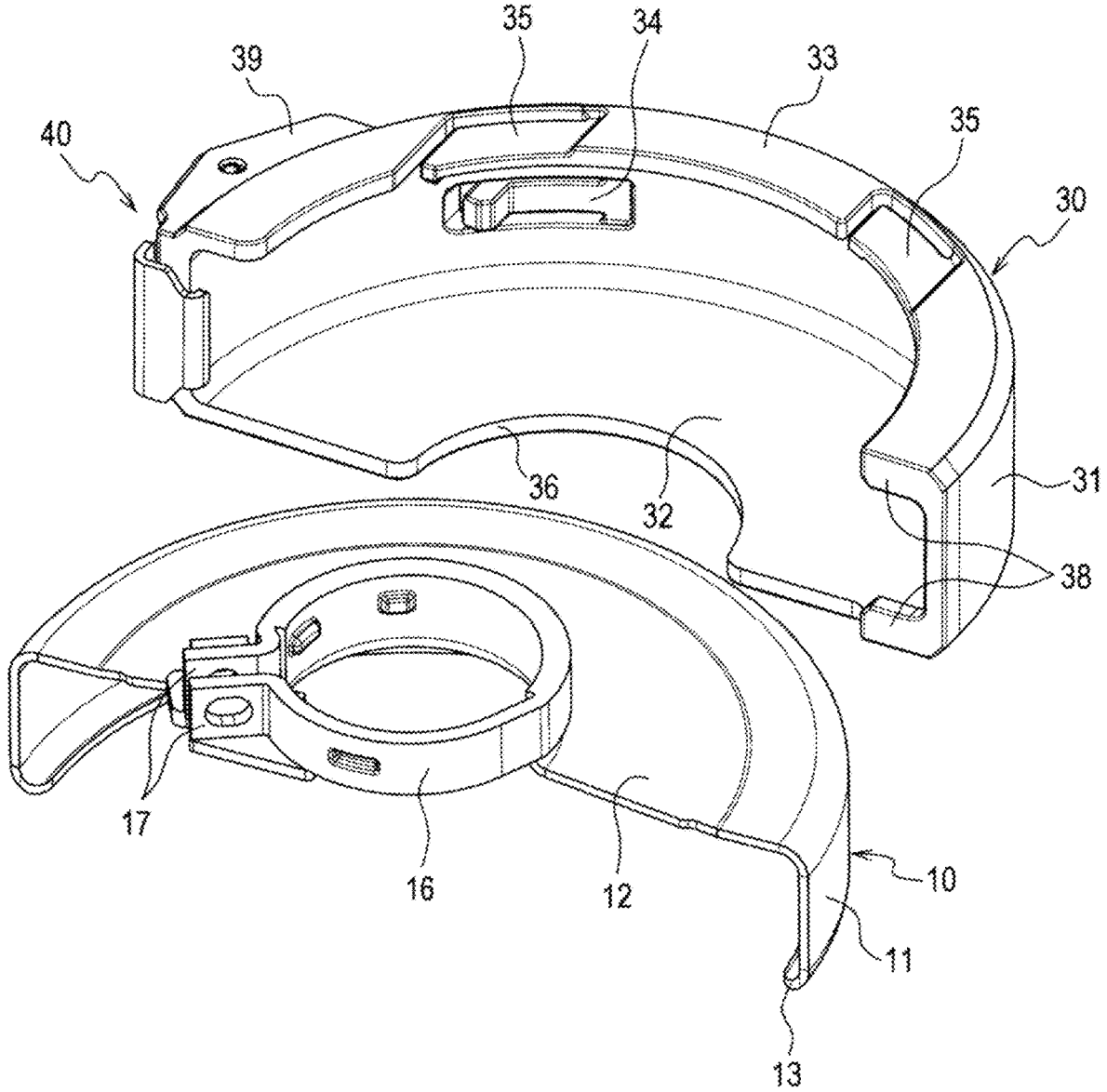
FIG. 2 is a perspective view of a wheel cover according to the first embodiment showing its structure.
Figure 3:
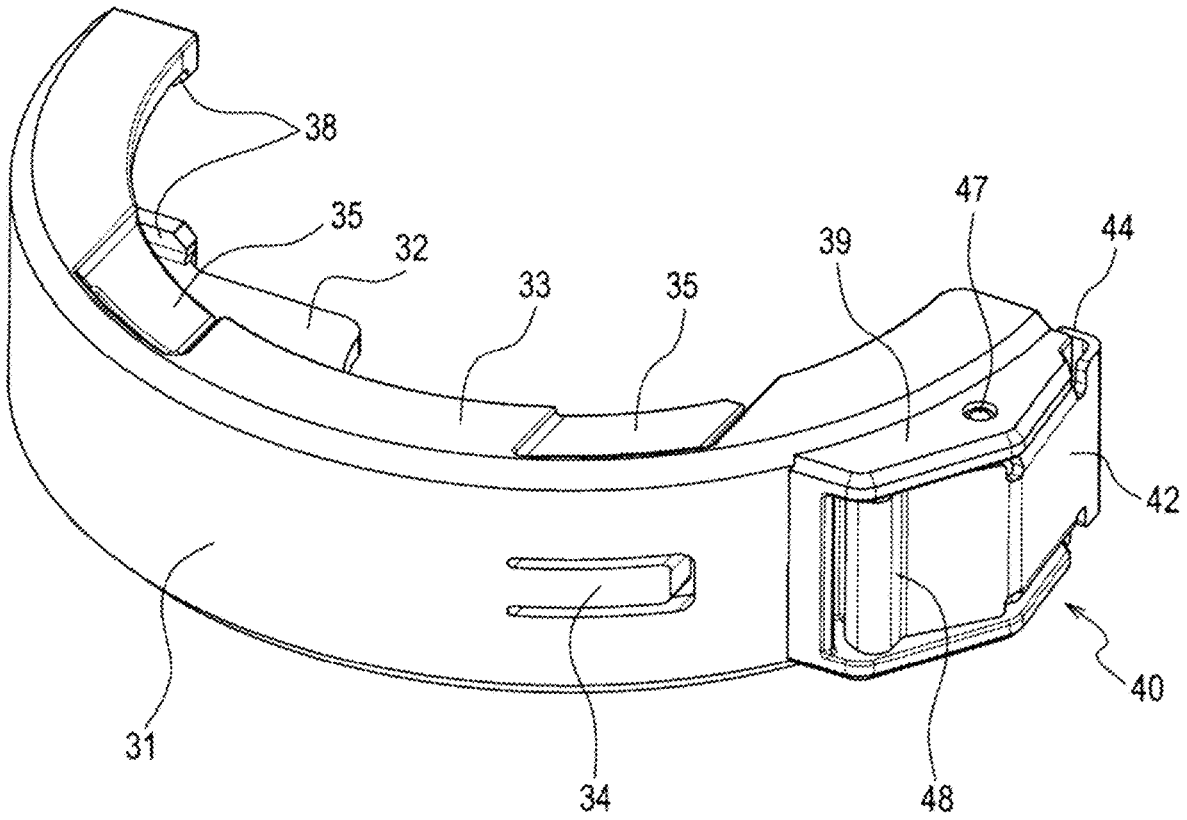
FIG. 3 is a perspective view of a second cover as viewed in a direction opposite to FIG. 2.
Figure 4C:
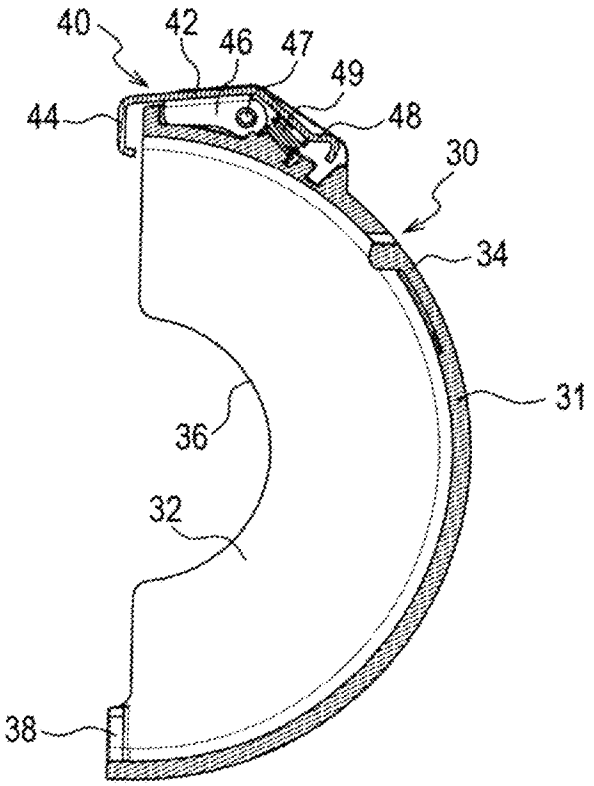
FIG. 4C is a cross-sectional view taken along line IVC-IVC in FIG. 4B.
Figure 4A:
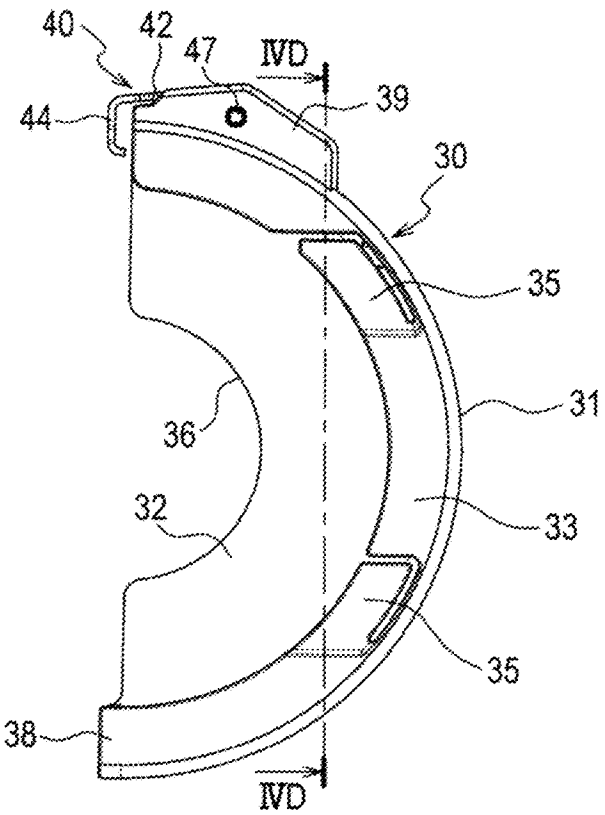
FIG. 4A is a plan view of the second cover as viewed from a gear housing.
Figure 4B:
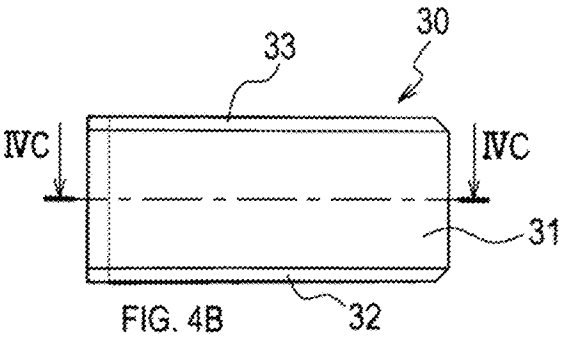
FIG. 4B is a side view of the second cover as viewed from below in FIG. 4A.
Figure 4D:
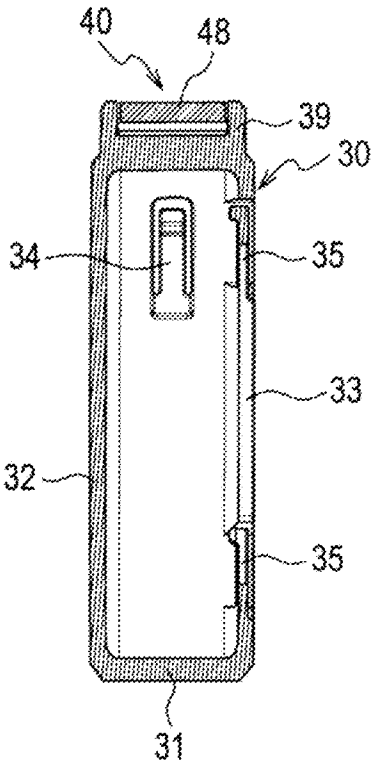
FIG. 4D is a cross-sectional view taken along line IVD-IVD in FIG. 4A.

As shown in FIG. 2, the first cover 10 includes a periphery protector (first periphery protector) 11, a semicircular plate face protector (first plate face protector) 12, and a curved portion (first curved portion) 13. The plate face protector 12 faces a plate face (first surface) of the tip tool 6 adjacent to the gear housing 4 and partly covers (more specifically, covers substantially half) the plate face.

The periphery protector 11 surrounds the peripheral edge of the plate face protector 12. The periphery protector 11 is bent to be substantially orthogonal to the plate face of the plate face protector 12 and faces the peripheral edge of the tip tool 6. The periphery protector 11 connects to, at an end opposite to the plate face protector 12, the curved portion 13 curved inward in the radial direction of the tip tool 6.

The plate face protector 12, the periphery protector 11, and the curved portion 13 are metal plates integral with one another.

An annular member 16 is located on the plate face protector 12. The annular member 16 is to be fitted to the cylindrical portion of the gear housing 4 surrounding the output shaft 5.

The annular member 16 includes fasteners 17 for fastening the annular member 16 radially inward. The annular member 16 is an open ring having ends bent outward to face each other across the opening. The ends serve as the fasteners 17. The user attaches the first cover 10 to the cylindrical portion of the gear housing 4 and determines the fastening position about the output shaft. After determining the fastening position, the user fastens the fasteners 17 to tighten the annular member 16 radially inward to fix the first cover 10 to the gear housing 4.

The fasteners 17 have holes through which a head bolt (not shown) is placed and a nut is screwed onto the bolt to firmly fix the first cover 10 to the gear housing 4 (in other words, to the grinder body).

The second cover 30 has substantially the same shape as the first cover 10, and includes a plate face protector (second plate face protector) 32, a periphery protector (second periphery protector) 31, and a curved portion (second curved portion) 33. The second cover in the present embodiment is formed from a synthetic resin. The plate face protector 32, the periphery protector 31, and the curved portion 33 are formed integrally with the synthetic resin.

The second cover 30 is larger than the first cover 10 to cover the first cover 10 from outside.

The second cover 30 can thus be placed over the first cover 10 with the second plate face protector 32 overlapping the first plate face protector 12. The second cover 30 can also be placed over the first cover 10 with the second plate face protector 32 opposed to the first plate face protector 12.

The second plate face protector 32 has a recess 36 to surround the annular member 16 to avoid interference with the annular member 16 when the second cover 30 is placed over the first cover 10 with the second plate face protector 32 overlapping the first plate face protector 12.

When the second cover 30 is placed over the first cover 10 with the second plate face protector 32 opposed to the first plate face protector 12, the second plate face protector 32 faces a plate face (second surface) of the tip tool 6 opposite to the gear housing 4, as shown in FIG. 1.

The second cover 30 placed in this manner can cover portions of the first and second surfaces corresponding to substantially half the plate faces of the tip tool 6.

In this state, the tip tool 6 has the two opposite surface portions covered with the wheel cover 8 with its semicircular surface portion uncovered with the wheel cover 8. The tip tool 6 can thus cut the workpiece with the uncovered surface portion.

The second cover 30 can be removed from the first cover 10 or the second cover 30 can be attached to the first cover 10 with the plate face protectors 12 and 32 overlapping each other. This allows the entire plate face of the tip tool 6 opposite to the gear housing 4 to be uncovered.

In this state, the plate face of the tip tool 6 opposite to the gear housing 4 can be used to grind or polish the workpiece.

The second periphery protector 31 has a bend 38 on its first circumferential end. When the second cover 30 is placed over the first cover 10, the bend 38 is engaged with a first circumferential end of the first periphery protector 11. The bend 38 in the present embodiment extends over the second periphery protector 31, the second plate face protector 32, and the second curved portion 33.

The second periphery protector 31 has an engagement member 40 on its second circumferential end. When the second cover 30 is placed over the first cover 10, the engagement member 40 is engaged manually with the first circumferential end of the first periphery protector 11.

As shown in FIGS. 3 to 5D, the engagement member 40 includes a pair of protruding tabs 39, a support shaft 47, and a movable plate 42. The protruding tabs 39 protrude from the second periphery protector 31 in a direction opposite to the second plate face protector 32 and the second curved portion 33 (in other words, outward). The movable plate 42 is pivotally secured about the support shaft 47.

The movable plate 42 is bent at a predetermined angle to conform to the curved periphery of the second periphery protector 31. The movable plate 42 can be in contact with and away from the outer peripheral surface of the second periphery protector 31 with the support shaft 47 placed through support pieces 46 located inside the bent portion.

The movable plate 42 is located, across the support shaft 47, on the first circumferential end of the second periphery protector 31. The movable plate 42 includes an engagement tab 44 bent at a substantially right angle toward the second periphery protector 31. When the movable plate 42 comes in contact with the second periphery protector 31, the engagement tab 44 protrudes inward from the second periphery protector 31 and is engaged with the first circumferential end of the first periphery protector 11.

A portion of the movable plate 42 opposite to the engagement tab 44 across the support shaft 47 is urged outward from the second periphery protector 31 by a coil spring 49 located between the movable plate 42 and the second periphery protector 31.

The engagement tab 44 thus normally protrudes inward from the second periphery protector 31, with the movable plate 42 being urged by the coil spring 49, and is engaged with the first periphery protector 11 as shown in FIGS. 4A to 5D.

When the user pushes an operation part 48, opposite to the engagement tab 44, toward the second periphery protector 31 against the urging force from the coil spring 49 while applying a force to place the second periphery protector 31 and the first periphery protector 11 closer to each other against the urging force from an elastic strip 34, the engagement tab 44 is displaced outward from the second periphery protector 31 and is disengaged from the first periphery protector 11.

To attach the second cover 30 to the first cover 10, the bend 38 is engaged with the first periphery protector 11 and the second cover 30 is placed to cover the first cover 10. The engagement member 40 is then operated to engage the engagement tab 44 with the first periphery protector 11.

With the second cover 30 attached to the first cover 10, the user can operate the engagement member 40 to disengage the engagement tab 44 from the first periphery protector 11. The second cover 30 is then easily removed from the first cover 10.

When a cutting operation on a workpiece is performed with the second cover 30 attached to the first cover 10, the second cover 30 may rattle relative to the first cover 10.

The wheel cover 8 according to the present embodiment includes a rattle restrainer to reduce such rattling. The rattle restrainer includes the elastic strips 34 and 35, which are leaf springs, to urge the second periphery protector 31 and the second curved portion 33 away from the first cover 10.

The elastic strip (first elastic member or first elastic strip) 34 is defined by a cutout in the second periphery protector 31 and is integral with the second periphery protector 31 along the outer circumference of the second periphery protector 31. The tip of the elastic strip 34 is bent inward from the second periphery protector 31.

Figure 5C:
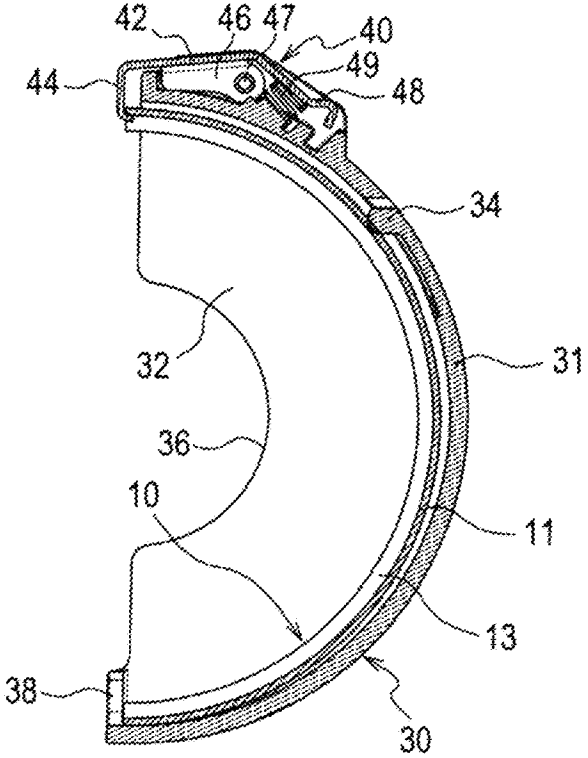
FIG. 5C is a cross-sectional view taken along line VC-VC in FIG. 5B.
Figure 5A:
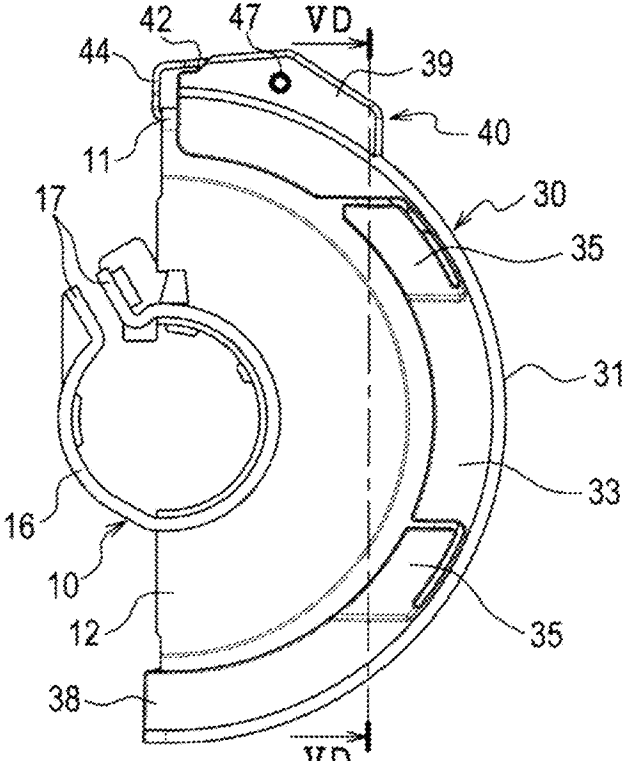
FIG. 5A is a plan view of the wheel cover as viewed from the gear housing.
Figure 5B:
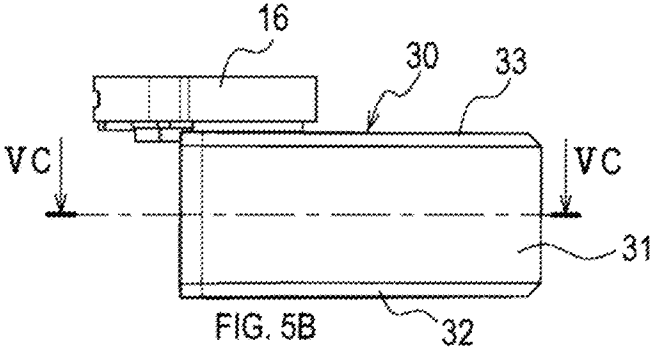
FIG. 5B is a side view of the wheel cover as viewed from below in FIG. 5A.

When the second cover 30 is attached to the first cover 10, the tip of the elastic strip 34 comes in contact with the first periphery protector 11 as shown in FIG. 5C.

The elastic strip 34 thus reduces rattling of the second cover 30 in the radial direction of the tip tool 6, which is a direction intersecting with the output shaft 5 of the grinder 1.

The elastic strips (second elastic members or second elastic strips) 35 are defined by two cutouts in the second curved portion 33 and are integral with the second curved portion 33 along the outer circumference of the periphery protector. The two elastic strips 35 are circumferentially spaced apart along the periphery protector 11. The tip of each elastic strip 35 is bent toward the facing second plate face protector 32.

Figure 5D:
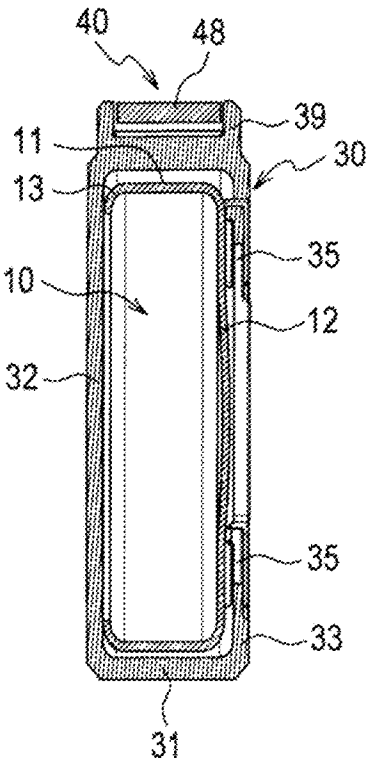
FIG. 5D is a cross-sectional view taken along line VD-VD in FIG. 5A.

When the second cover 30 is attached to the first cover 10, the tips of the elastic strips 35 come in contact with the first plate face protector 12 as shown in FIG. 5D.

The elastic strips 35 thus reduce rattling of the second cover 30 in the axial direction parallel to the output shaft 5 of the grinder 1.

The wheel cover 8 according to the present embodiment can thus reduce rattling of the second cover 30, which may cause discomfort to the user in use of the grinder 1 and may lower the operability of the grinder 1. The structure also reduces wear of the engagement portions between the first cover 10 and the second cover 30 resulting from rattling of the second cover 30 and thus reduces degradation of the wheel cover 8.

Second Embodiment

A wheel cover 8A according to a second embodiment will now be described.

The wheel cover 8A according to the present embodiment basically has the same structure as the wheel cover 8 according to the first embodiment, with a second cover 30A and an engagement member 40A structurally different from the corresponding components in the first embodiment. The second embodiment will be described focusing on the differences, and the components corresponding to those in the first embodiment in the second cover 30A and the engagement member 40A are given the same reference numerals with letter A added in the drawings and will be described partly.

In the wheel cover 8A according to the present embodiment, the second cover 30A and the engagement member 40A are metal plates, similarly to the first cover 10.

As shown in FIGS. 6 to 9D, a second periphery protector 31A has a bend 38A on its first circumferential end, and the engagement member 40A on its second circumferential end.

Figure 6:
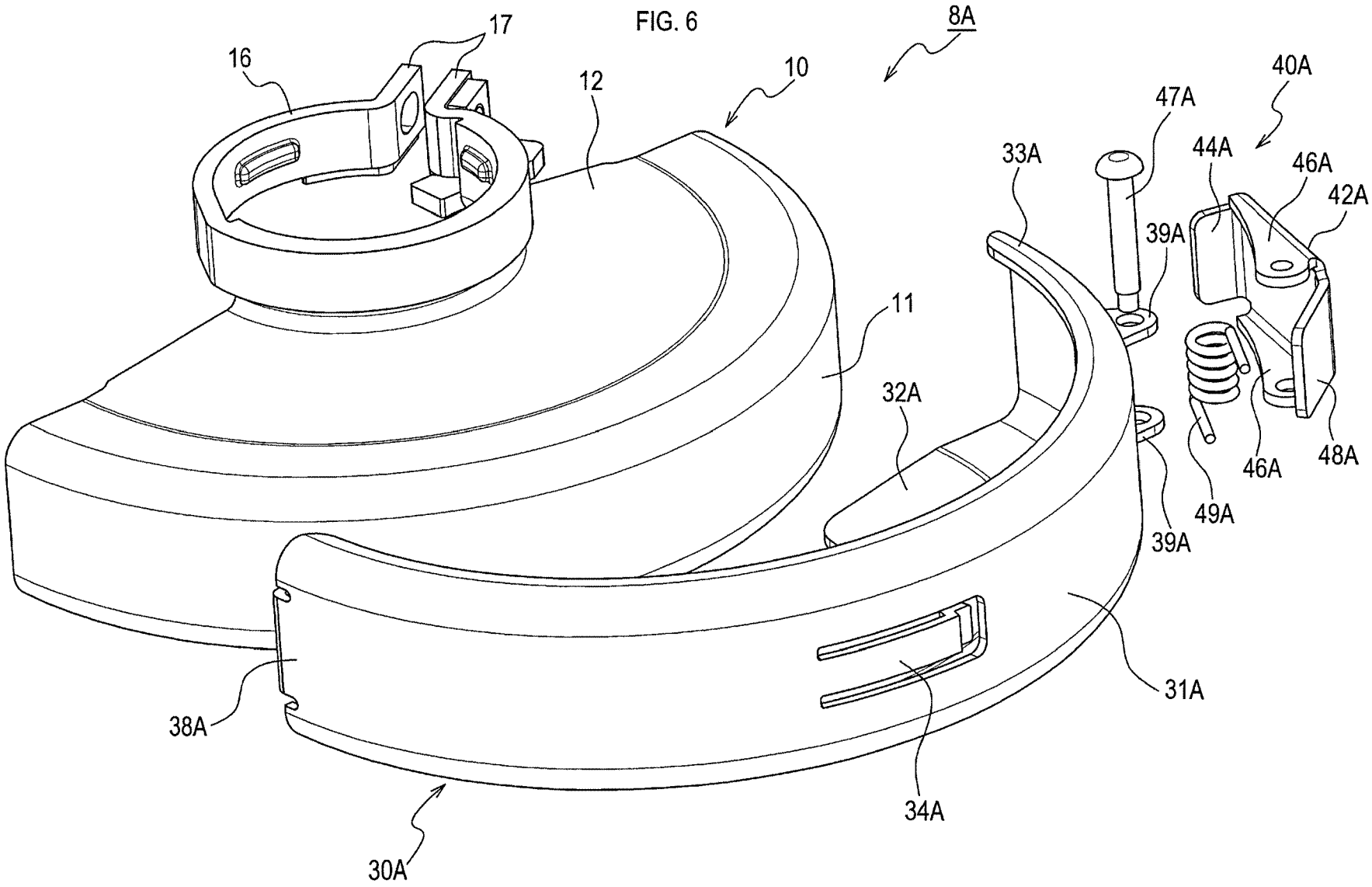
FIG. 6 is a perspective view of a wheel cover according to a second embodiment showing its structure.
Figure 7:
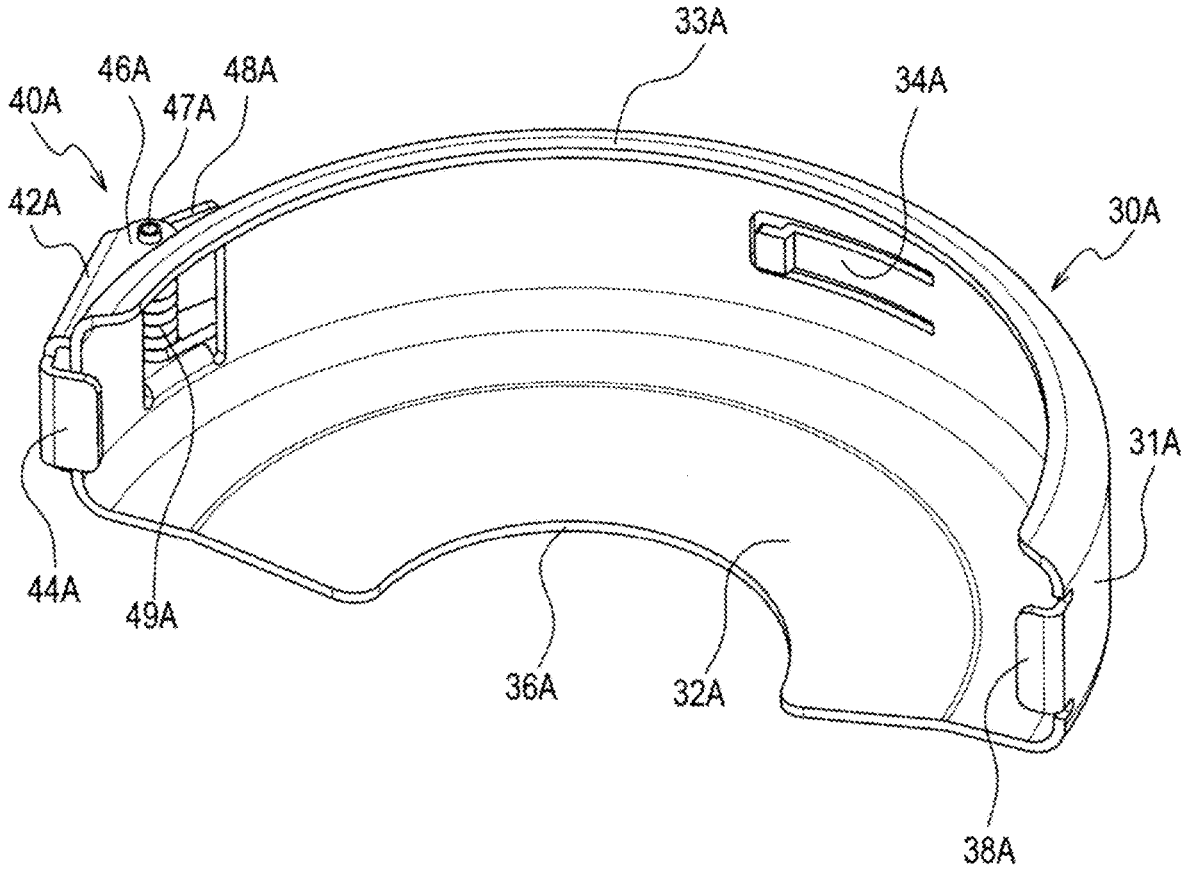
FIG. 7 is a perspective view of a second cover as viewed in a direction opposite to FIG. 6.

As shown in FIGS. 6 and 7, the engagement member 40A includes, as in the first embodiment, a movable plate 42A pivotally secured to, about a support shaft 47A, a pair of protruding tabs 39A protruding from the second periphery protector 31A.

The movable plate 42A includes a pair of support pieces 46A bent at a substantially right angle to hold the pair of protruding tabs 39A between them from outside.

The movable plate 42A can be in contact with and away from the outer peripheral surface of the second periphery protector 31A with the support shaft 47A placed through the protruding tabs 39A and the support pieces 46A with the two protruding tabs 39A held between the pair of support pieces 46A.

The movable plate 42A is bent at a predetermined angle to conform to the curved periphery of the second periphery protector 31A. The pair of support pieces 46A extends from the bent portion toward the first circumferential end of the second periphery protector 31A.

The movable plate 42A includes an engagement tab 44A on one end adjacent to the first circumferential end of the periphery protector 31A across the support shaft 47A. The engagement tab 44A is bent at a substantially right angle toward the periphery protector 31A. A torsion spring 49A is located between the two protruding tabs 39A. The torsion spring 49A receives the support shaft 47A placed through it.

The torsion spring 49A urges a portion of the movable plate 42A opposite to the engagement tab 44A across the support shaft 47A away from the second periphery protector 31A. This causes another portion of the movable plate 42A extending from the support shaft 47A to the engagement tab 44A to come in contact with the second periphery protector 31A.

The portion of the movable plate 42A opposite to the engagement tab 44A across the support shaft 47A thus serves as an operation part 48A. The user can push the operation part 48A toward the periphery protector 31A against the urging force from the torsion spring 49A.

Figure 8A:
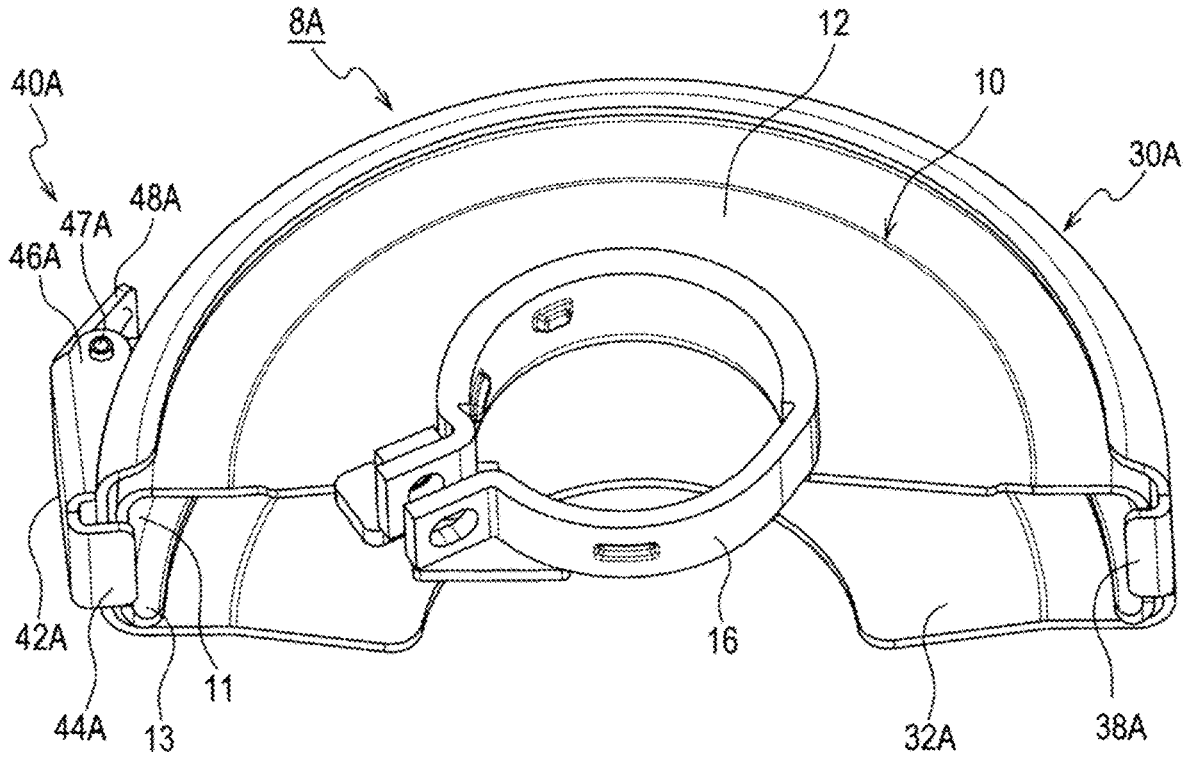
FIG. 8A is a perspective view of the wheel cover with the second cover attached to the first cover with an engagement member on the wheel cover at a closed position.

Thus, as shown in FIG. 8A, when the second cover 30A is attached to the first cover 10, the urging force from the torsion spring 49A causes the engagement tab 44A to protrude inward from the second periphery protector 31A to be engageable with the first periphery protector 11.

Figure 8B:
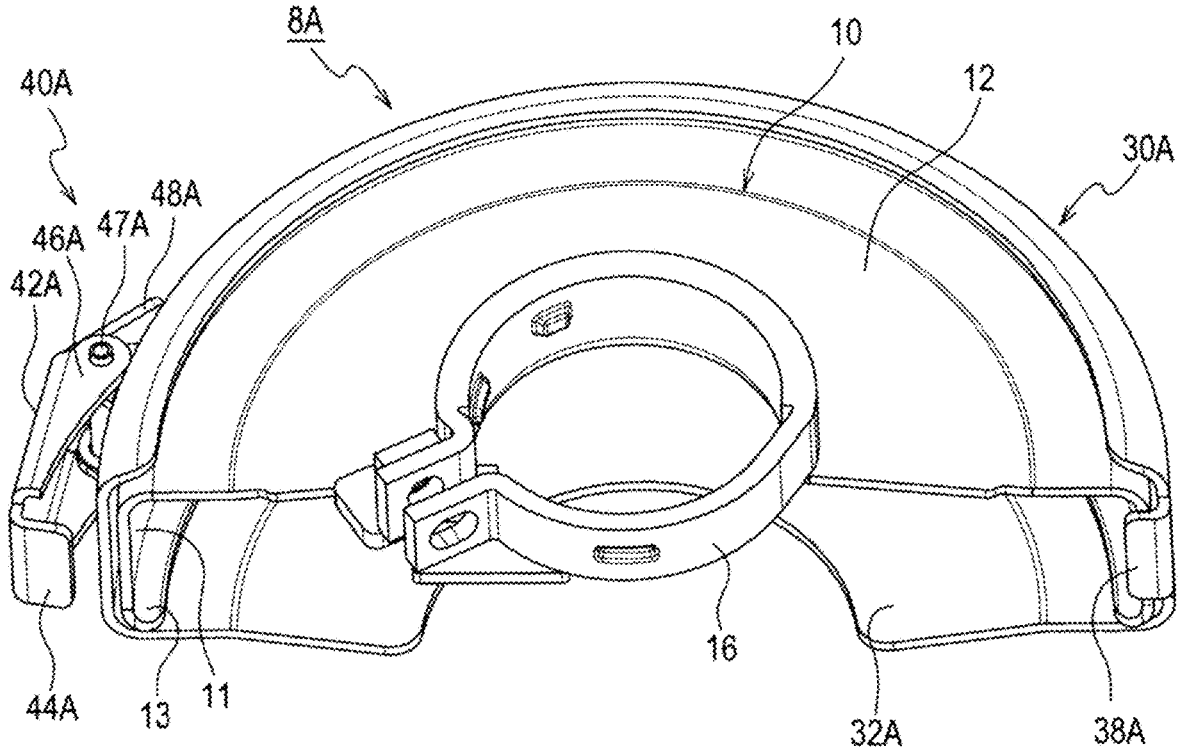
FIG. 8B is a perspective view of the wheel cover with the second cover attached to the first cover with the engagement member on the wheel cover at an open position.

As shown in FIG. 8B, when the user pushes the operation part 48A toward the second periphery protector 31A against the urging force from the torsion spring 49A, the engagement tab 44A is displaced outward from the second periphery protector 31A to be disengageable from the first periphery protector 11.

In the present embodiment, the engagement member 40 allows easy attachment and removal of the second cover 30A to and from the first cover 10 as in the first embodiment.

The wheel cover 8A according to the present embodiment includes an elastic strip (first elastic member or first elastic strip) 34A, which is a leaf spring, for reducing rattling when the second cover 30A is attached to the first cover 10. The elastic strip 34A urges the second periphery protector 31A away from the first cover 10.

The elastic strip 34A is defined by a cutout in substantially the middle of the second periphery protector 31A in the circumferential direction and is integrally formed with the second periphery protector 31A by press molding along the outer circumference of the second periphery protector 31A. The tip of the elastic strip 34A is bent inward from the second periphery protector 31A.

Figure 9C:
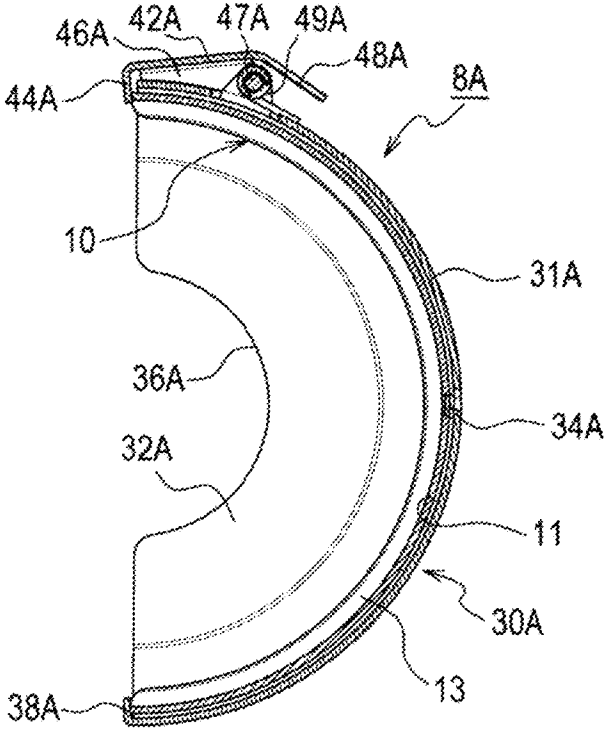
FIG. 9C is a cross-sectional view taken along line IXC-IXC in FIG. 9B.
Figure 9D:
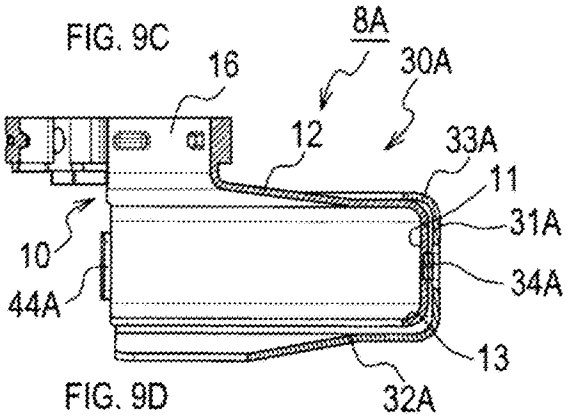
FIG. 9D is a cross-sectional view taken along line IXD-IXD in FIG. 9A.
Figure 9A:
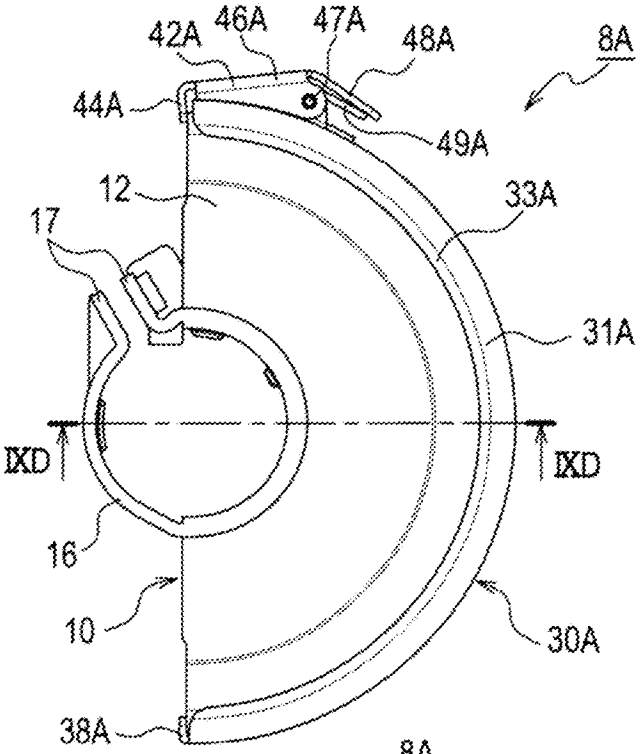
FIG. 9A is a plan view of the wheel cover as viewed from a gear housing.
Figure 9B:
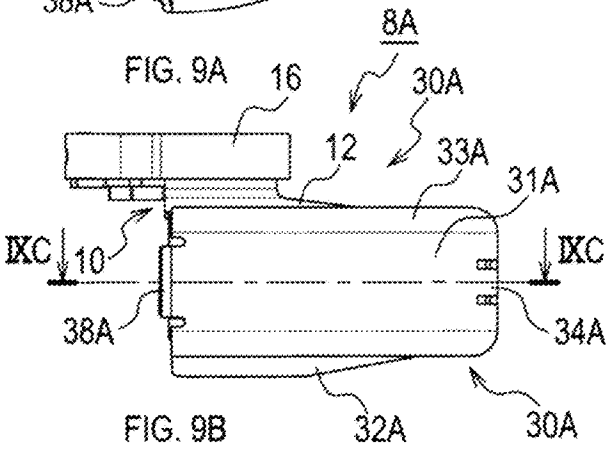
FIG. 9B is a side view of the wheel cover as viewed from below in FIG. 9A.

When the second cover 30A is attached to the first cover 10, the tip of the elastic strip 34A comes in contact with the first periphery protector 11 as shown in FIGS. 9C and 9D.

The elastic strip 34A thus reduces rattling of the second cover 30A in the radial direction of the tip tool 6.

The structure according to the present embodiment can also reduce rattling of the second cover 30A, which may cause discomfort to the user in use of the grinder 1 and may lower the operability of the grinder 1. The structure also reduces wear of the engagement portions between the first cover 10 and the second cover 30A resulting from rattling of the second cover 30A and thus reduces degradation of the wheel cover 8A.

The second cover 30A in the present embodiment does not include a second elastic strip (second elastic member) to reduce rattling in the axial direction parallel to the output shaft of the grinder 1. However, the second cover 30A in the present embodiment is formed from metal. The bend 38A, the engagement tab 44A, and the elastic strip 34A are thus firmly in contact with the first cover 10 to reduce rattling in the axial direction under the friction between the contact portions.

Third Embodiment

A wheel cover 8B according to a third embodiment will now be described.

The wheel cover 8B according to the present embodiment basically has the same structure as the wheel cover 8 according to the first embodiment, with a second cover 30B and an engagement member 40B structurally different from the corresponding components in the first embodiment. The third embodiment will be described focusing on the differences, and the components corresponding to those in the first embodiment in the second cover 30B and the engagement member 40B are given the same reference numerals with letter B added in the drawings and will be described partly.

In the wheel cover 8B according to the present embodiment, the second cover 30B and the engagement member 40B are metal plates, similarly to the wheel cover 8A according to the first embodiment.

As shown in FIGS. 10 to 13D, a second periphery protector 31B has a bend 38B on its first circumferential end, and the engagement member 40B on its second circumferential end.

Figure 10:
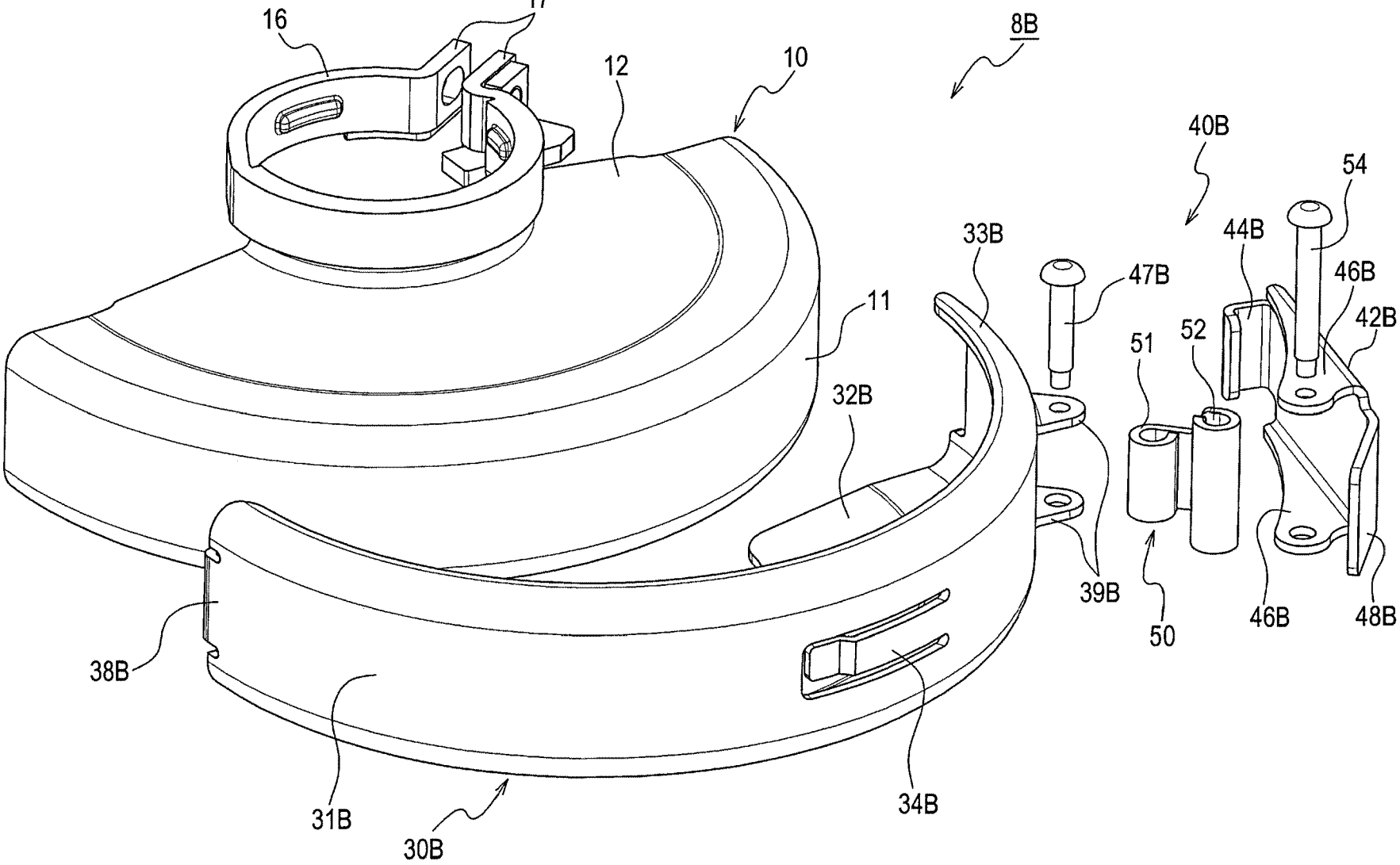
FIG. 10 is a perspective view of a wheel cover according to a third embodiment showing its structure.
Figure 11:
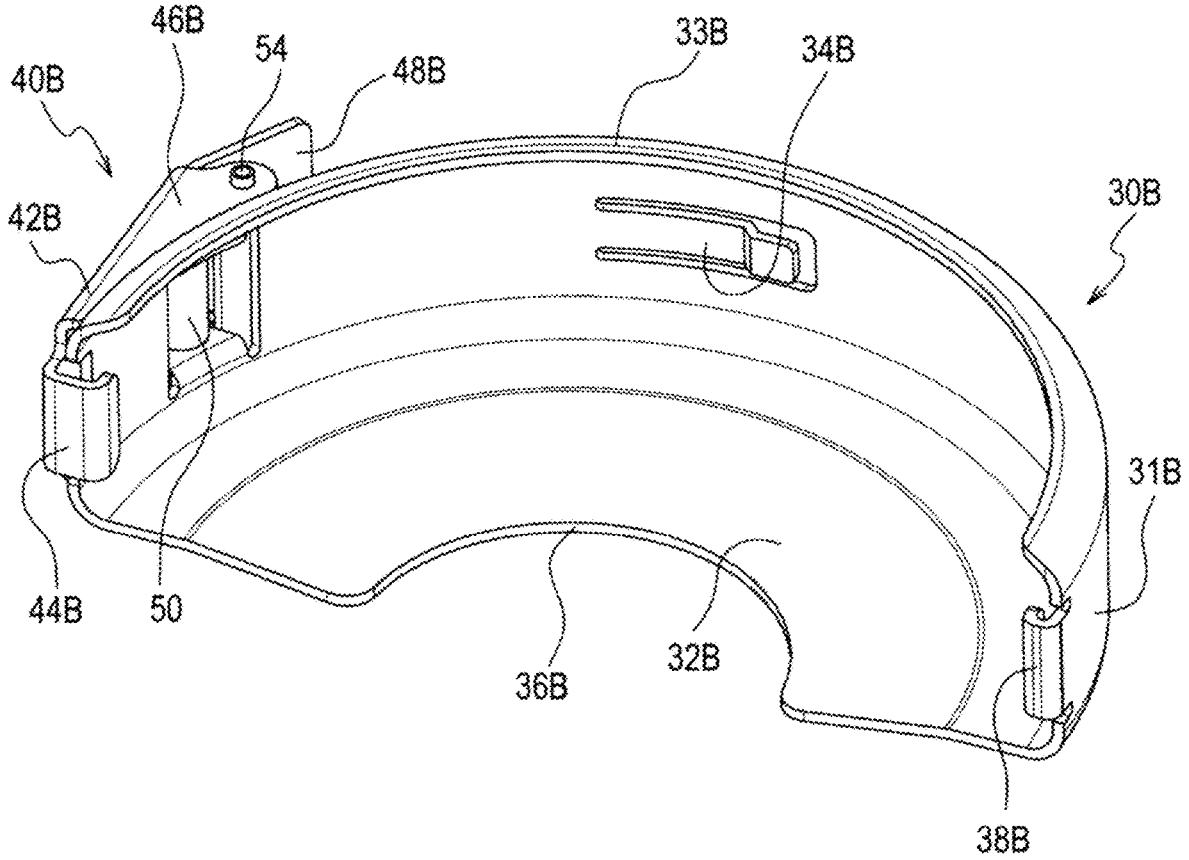
FIG. 11 is a perspective view of a second cover as viewed in a direction opposite to FIG. 10.

As shown in FIGS. 10 and 11, the engagement member 40B is attached to the second periphery protector 31B with a plate-like connector 50. The connector 50 is attached to the second periphery protector 31B to allow the engagement member 40B to be displaceable between an open position shown in FIG. 12A and a closed position shown in FIG. 12C. The connector 50 serves as a hinge to open and close the engagement member 40B.

As shown in FIG. 10, the connector 50 includes a hinge 51 and a hinge 52. The hinge 51 is secured to, about a support shaft 47B, a pair of protruding tabs 39B protruding from the periphery protector 31B. The hinge 52 about a support shaft 54 is used to secure the engagement member 40B.

The connector 50 is attached to the second periphery protector 31B with the hinge 51 placed between the pair of protruding tabs 39B. The support shaft 47B is placed through a hole in one protruding tab 39B, the hole in the hinge 51, and the hole in the other protruding tab 39B to attach the connector 50.

The connector 50 is thus attached to the second periphery protector 31B in a manner pivotable about the support shaft 47B.

The hinge 52 in the connector 50 receives the support shaft 54 parallel to the support shaft 47B. The engagement member 40B includes a pair of support pieces 46B to hold the hinge 52 between them.

The pair of support pieces 46B is bent from a movable plate 42B, which is the body of the engagement member 40B.

The engagement member 40B is attached to the connector 50 with the hinge 52 held between the pair of support pieces 46B and the support shaft 54 placed through a hole in one support piece 46B, a hole in the hinge 52, and a hole in the other support piece 46B.

The movable plate 42B in the engagement member 40B is thus attached to the connector 50 (or in other words, to the second periphery protector 31B) in a manner pivotable about the support shaft 54.

The second periphery protector 31B has an engagement tab 44B located circumferentially outward. The engagement tab 44B is bent to be engageable with a circumferentially outer end of the first periphery protector 11.

The movable plate 42B is bent, in a portion opposite to the engagement tab 44B, at a predetermined angle to conform to the curved periphery of the second periphery protector 31B. The bent portion serves as an operation part 48B.

Figure 12A:
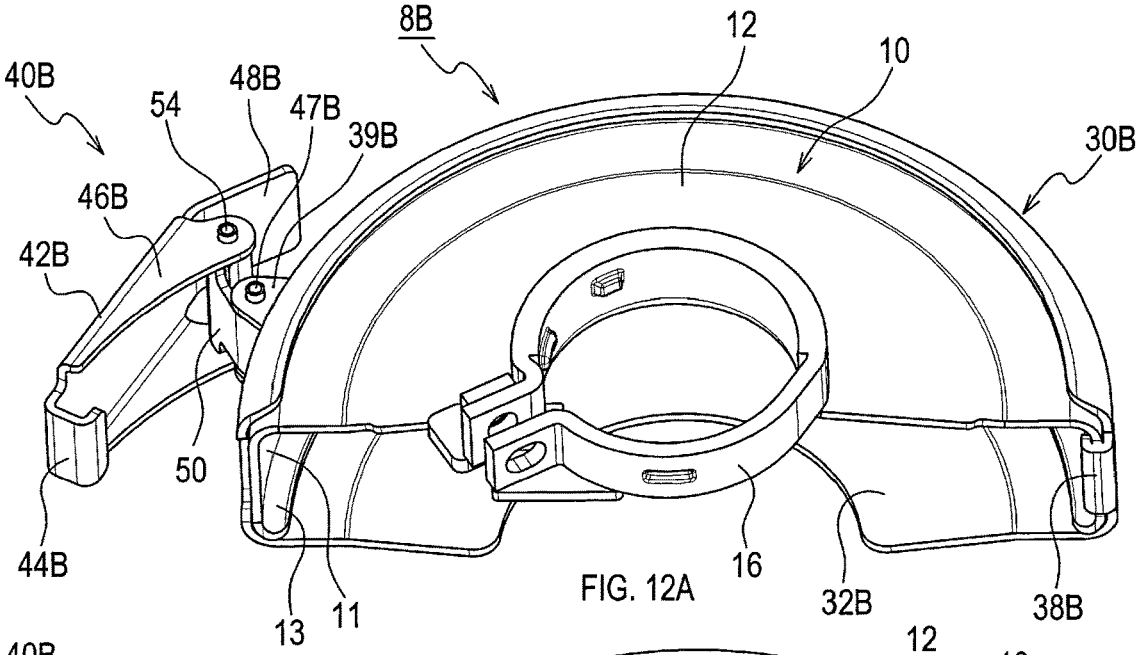
FIG. 12A is a perspective view showing an engagement member at an open position.
Figure 12B:
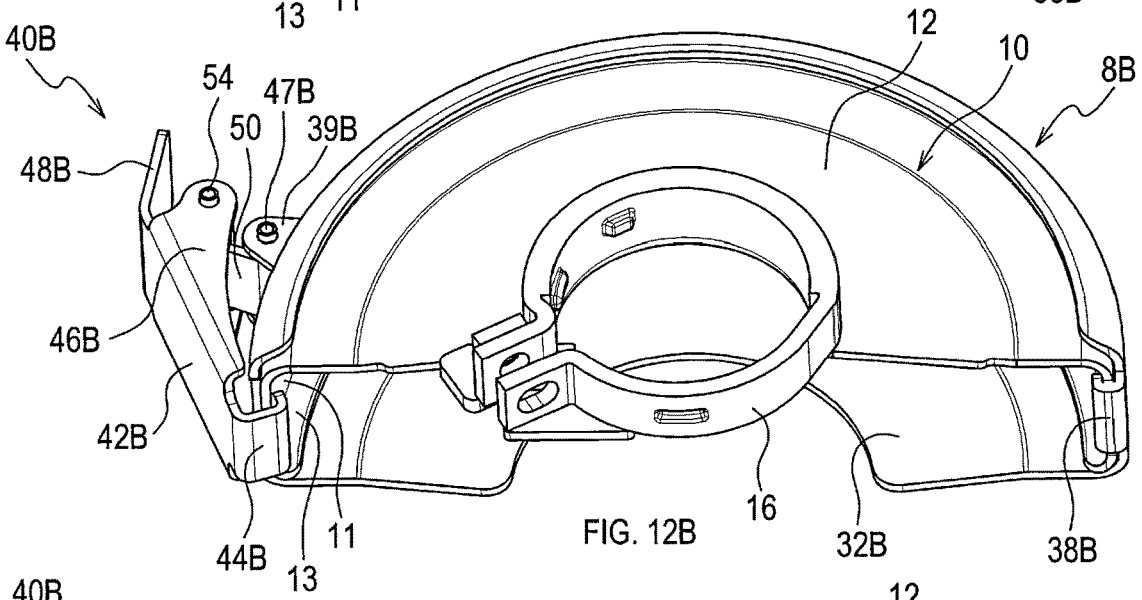
FIG. 12B is a perspective view showing the engagement member engaged with a first cover.
Figure 12C:
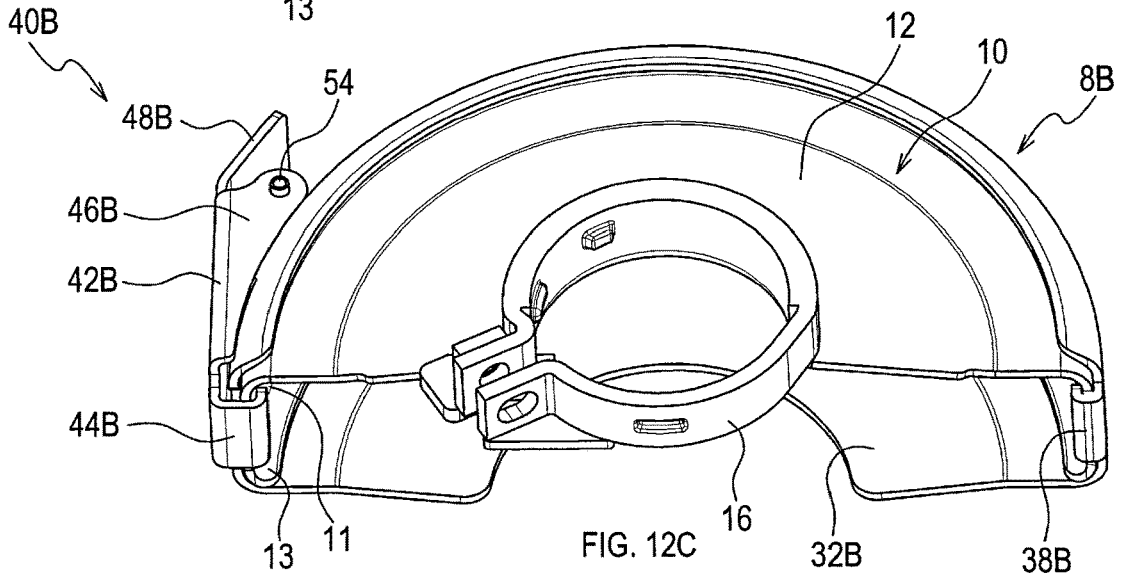
FIG. 12C is a perspective view showing the engagement member at a closed position.

The user can easily attach the second cover 30B to the first cover 10 with the procedure shown in FIGS. 12A to 12C.

The user first places the second cover 30B over the first cover 10 as shown in FIG. 12A, and then engages the bend 38B on the second cover 30B with the first periphery protector 11. The user then engages the engagement tab 44B with the first periphery protector 11 as shown in FIG. 12B, and pushes the operation part 48B toward the second cover 30.

This causes the bend 38B and the engagement tab 44B to be engaged with both ends of the first periphery protector 11 as shown in FIG. 12C, thus firmly attaching the second cover 30B to the first cover 10.

To remove the second cover 30B from the first cover 10, the user may simply pull the operation part 48B outward to disengage the engagement tab 44B from the first periphery protector 11.

In the present embodiment, the engagement member 40B allows easy attachment and removal of the second cover 30B to and from the first cover 10 as in the first embodiment.

The wheel cover 8B according to the present embodiment also includes, as a rattle restrainer, an elastic strip 34B, which is a leaf spring, similarly to the wheel cover 8A according to the second embodiment. The elastic strip 34B is located in the second periphery protector 31B and urges the second periphery protector 31B away from the first cover 10.

The elastic strip 34B is defined by a cutout in substantially the middle of the second periphery protector 31B in the circumferential direction and is integrally formed with the second periphery protector 31B by press molding along the outer circumference of the second periphery protector 31B. The tip of the elastic strip 34B is bent inward from the second periphery protector 31B.

Figure 13C:
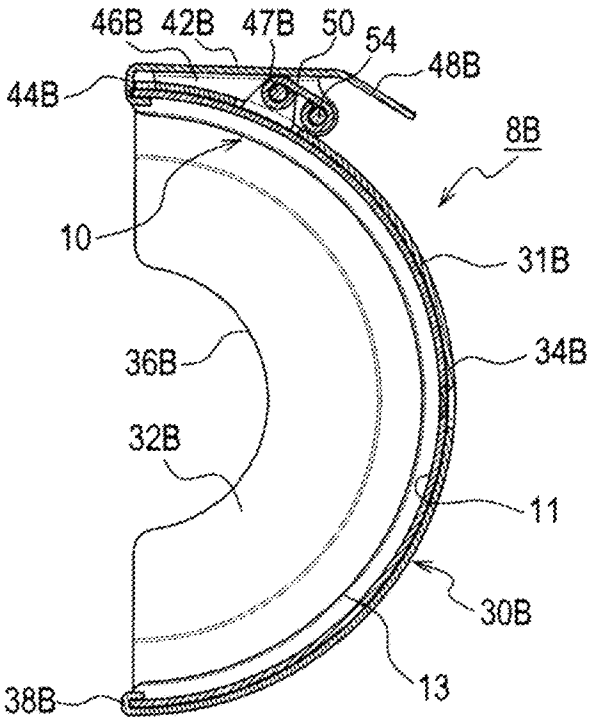
FIG. 13C is a cross-sectional view taken along line XIIIC-XIIIC in FIG. 13B.
Figure 13D:
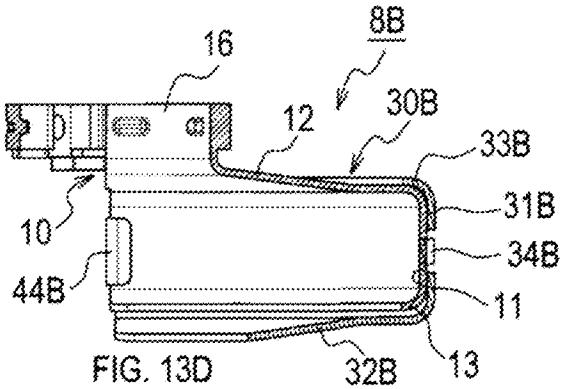
FIG. 13D is a cross-sectional view taken along line XIIID-XIIID in FIG. 13A.
Figure 13A:
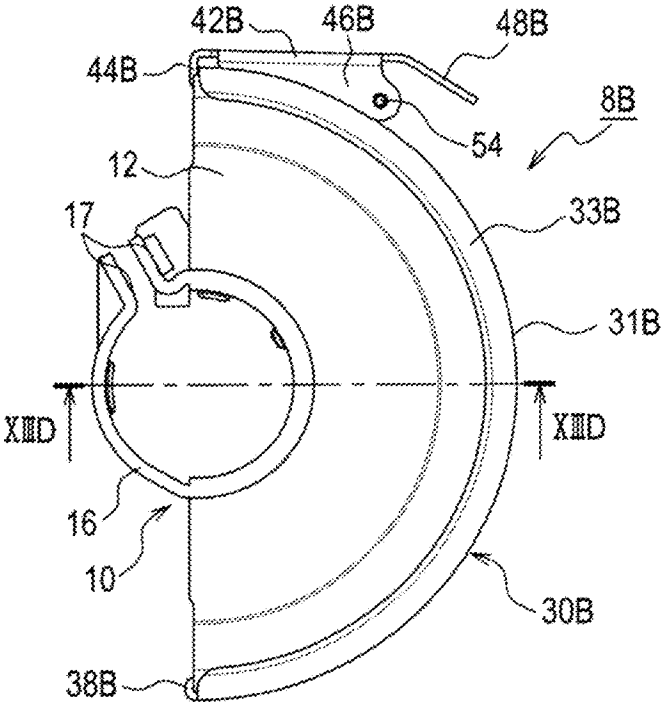
FIG. 13A is a plan view of the wheel cover as viewed from a gear housing.
Figure 13B:
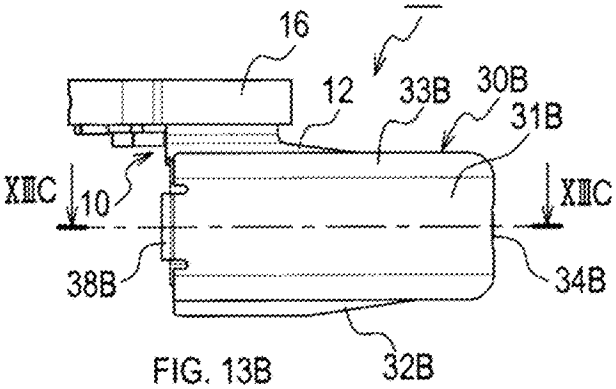
FIG. 13B is a side view of the wheel cover as viewed from below in FIG. 13A.
Figure 14:
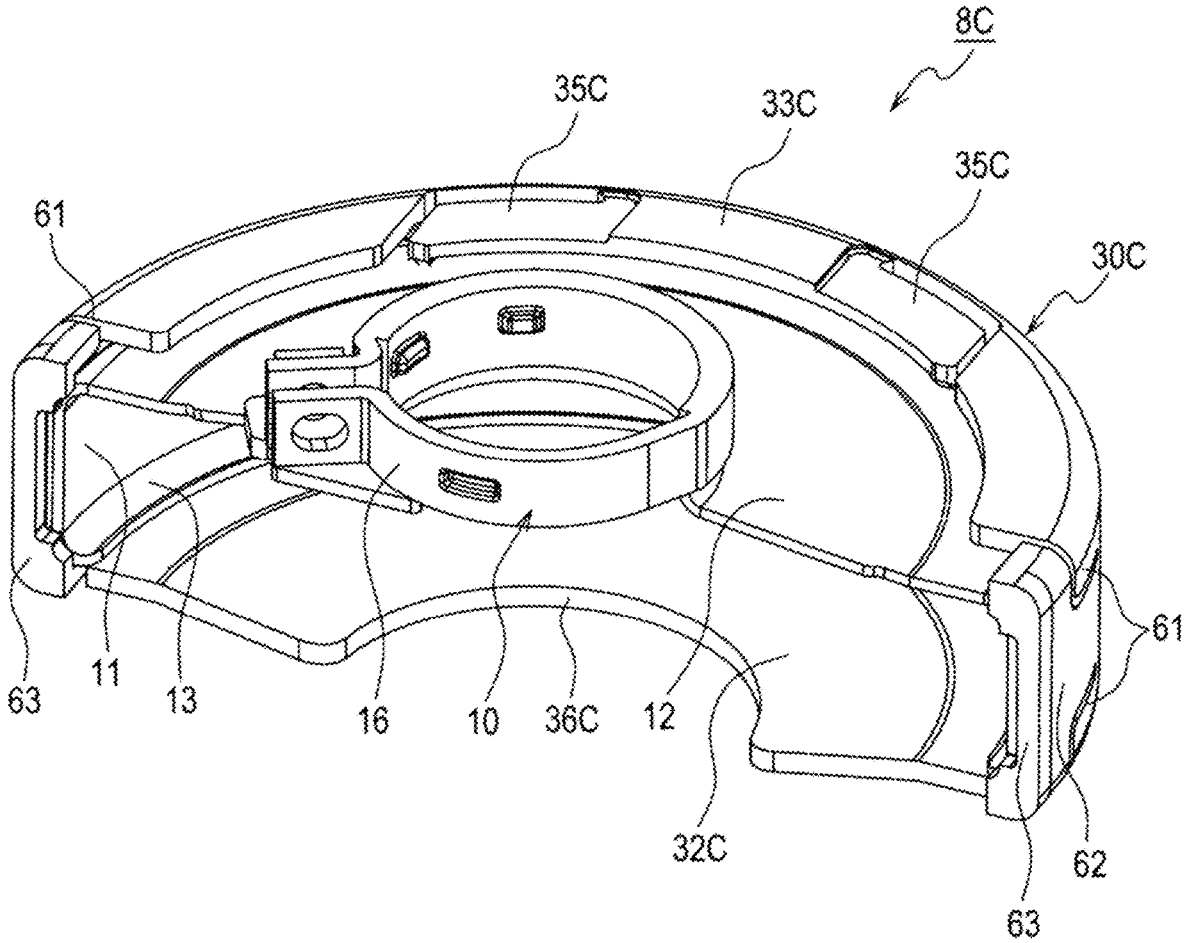
FIG. 14 is a perspective view of a wheel cover according to a fourth embodiment showing its structure.

When the second cover 30B is attached to the first cover 10 as shown in FIGS. 13C and 13D, the tip of the elastic strip 34B comes in contact with the first periphery protector 11.

The elastic strip 34B thus reduces rattling of the second cover 30B in the radial direction of the tip tool 6, similarly to the elastic strips 34 and 34A in the above embodiments.

The structure according to the present embodiment can also reduce rattling of the second cover 30B, which may cause discomfort to the user in use of the grinder 1 and may lower the operability of the grinder 1. The structure also reduces wear of the engagement portions between the first cover 10 and the second cover 30B resulting from rattling of the second cover 30B and thus reduces degradation of the wheel cover 8B.

Fourth Embodiment

A wheel cover 8C according to a fourth embodiment will now be described.

The wheel cover 8C according to the present embodiment basically has the same structure as the wheel cover 8 according to the first embodiment, with a second cover 30C structurally different from the corresponding component in the first embodiment. The fourth embodiment will be described focusing on the difference, and the components corresponding to those in the first embodiment in the second cover 30C are given the same reference numerals with letter C added in the drawings and will be described partly.

The second cover 30C in the present embodiment is formed from a synthetic resin, similarly to the second cover 30 in the first embodiment.

As shown in FIGS. 14 to 16D, in the present embodiment, the second cover 30C has elastic pieces 62, which are leaf springs, on its two circumferential ends. Each elastic piece 62 is partly separated from a second periphery protector 31C by cutouts 61 to be elastically deformable outward.

The tip of each elastic piece 62 opposite to the second periphery protector 31C is bent inward from the second periphery protector 31C to serve as an engagement tab 63 engageable with the corresponding circumferential end of the first cover 10.

Each engagement tab 63 has a width to be engageable with, in addition to the first periphery protector 11, the corners between the first periphery protector 11 and the first plate face protector 12 and between the first periphery protector 11 and the first curved portion 13 when the second cover 30C is attached to the first cover 10.

In the present embodiment, to attach the second cover 30C to the first cover 10, the second cover 30 is simply slid over the first cover 10 to allow the engagement tabs 63 to be engaged with the corresponding circumferential ends of the first cover 10.

In the present embodiment, the second cover 30C is easily attachable to the first cover 10 without using the engagement members 40, 40A, or 40B as in the above embodiments.

To remove the second cover 30C from the first cover 10, the engagement tabs 63 may be simply displaced outward from the second cover 30C against the urging force from the elastic pieces 62 to allow easy removal.

Two elastic strips (second elastic members or second elastic strips) 35C, which are leaf springs, are defined by cutouts in a second curved portion 33C as in the first embodiment. The elastic strips 35C are integral with the second curved portion 33C along the outer circumference of the second periphery protector 31C. The elastic strips 35C each extend from the middle portion toward a corresponding circumferential end of the curved portion 33C. Each elastic strip 35C has a deformable tip in the circumferential direction.

Figure 15:
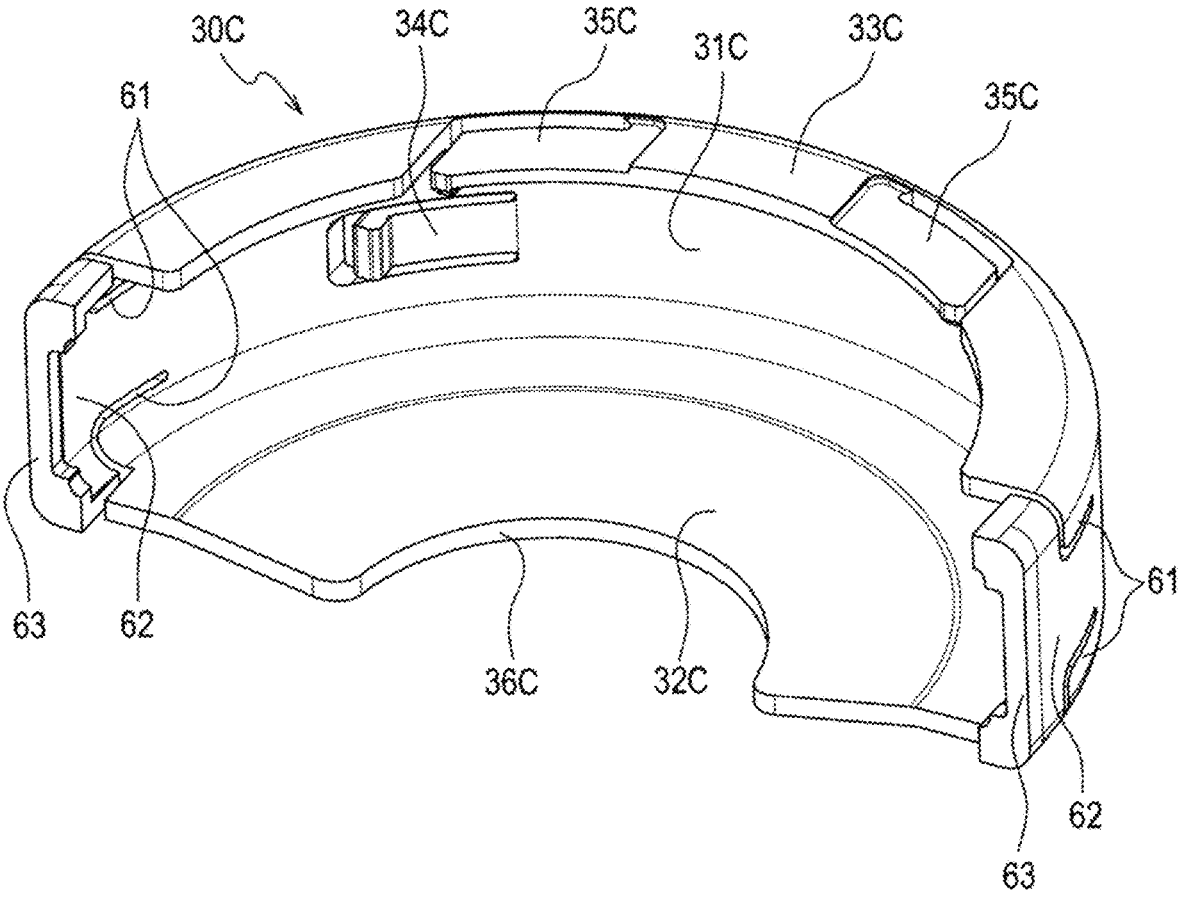
FIG. 15 is a perspective view of a second cover as viewed in the same direction as in FIG. 14.
Figure 16C:
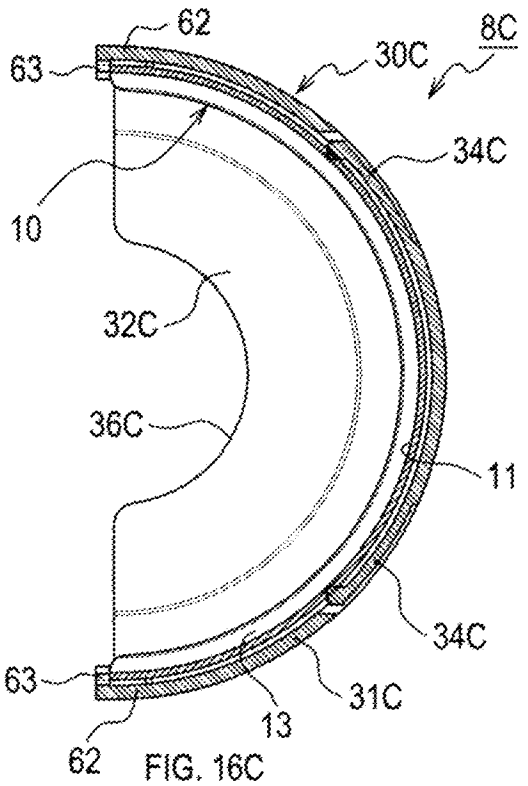
FIG. 16C is a cross-sectional view taken along line XVIC-XVIC in FIG. 16B.
Figure 16A:
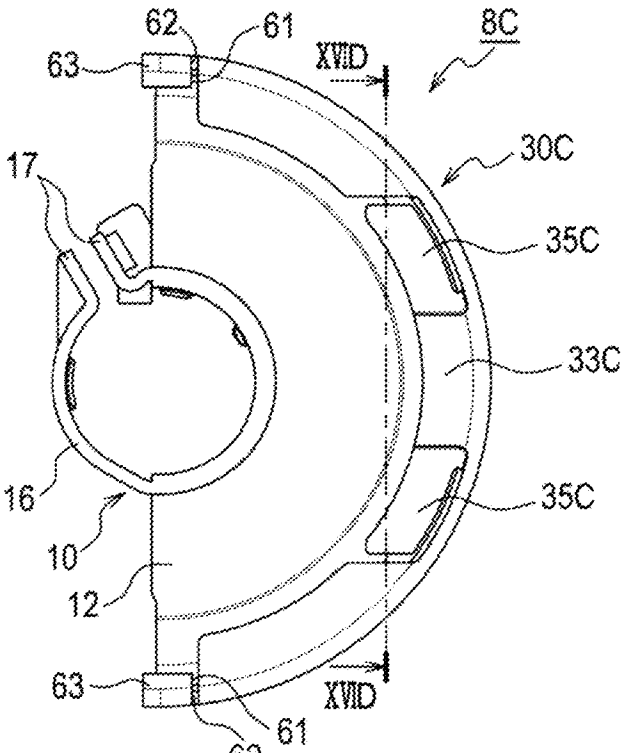
FIG. 16A is a plan view of the wheel cover as viewed from a gear housing.
Figure 16B:
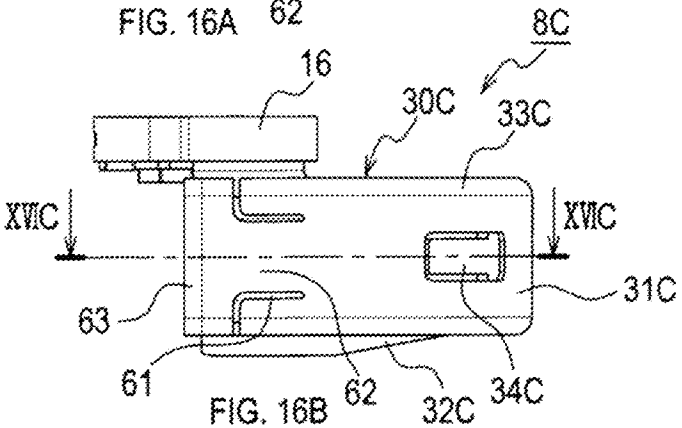
FIG. 16B is a side view of the wheel cover as viewed from below in FIG. 16A.
Figure 16D:
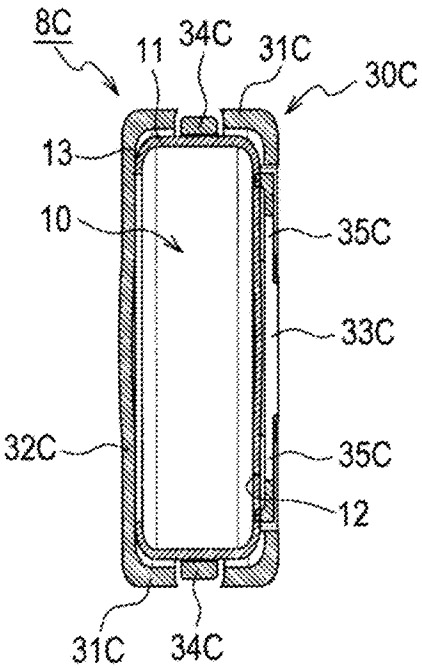
FIG. 16D is a cross-sectional view taken along line XVID-XVID in FIG. 16A.

As shown in FIGS. 15 to 16D, two elastic strips 34C, which are leaf springs, are defined by cutouts in the second periphery protector 31C. The elastic strips 34C are integral with the second periphery protector 31C along the outer circumference.

The two elastic strips (first elastic members or first elastic strips) 34C each extend, similarly to the elastic strips 35C, from the middle portion toward a corresponding circumferential end of the second periphery protector 31C. Each elastic strip 34C has a deformable tip in the circumferential direction. The tip of the elastic strip 34C is bent inward from the second periphery protector 31C.

When the second cover 30C is attached to the first cover 10, the tips of the two elastic strips 34C come in contact with the first periphery protector 11 to reduce rattling of the second cover 30C in the radial direction of the tip tool 6.

When the second cover 30C is attached to the first cover 10, the two elastic strips 35C come in contact with the first plate face protector 12 to reduce rattling of the second cover 30C in the axial direction of the output shaft 5 in the grinder 1.

The structure according to the present embodiment can thus reduce, similarly to the wheel cover 8 in the first embodiment, rattling of the second cover 30C, which may cause discomfort to the user in use of the grinder 1 and may lower the operability of the grinder 1. The structure also reduces wear of the engagement portions between the first cover 10 and the second cover 30C resulting from rattling of the second cover 30C and thus reduces degradation of the wheel cover 8C.

Fifth Embodiment

A wheel cover 8D according to a fifth embodiment will now be described.

The wheel cover 8D according to the present embodiment includes the first cover 10 with the same structure as in the first embodiment, a plate 70 integrally joined to the first periphery protector 11 by, for example, welding, and a second cover 30D attachable to the first cover 10 with the plate 70 in between.

The second cover 30D basically has the same structure as in the first embodiment, and thus the components corresponding to those in the first embodiment in the second cover 30D are given the same reference numerals with letter D added in the drawings and will be described partly.

Figure 17:
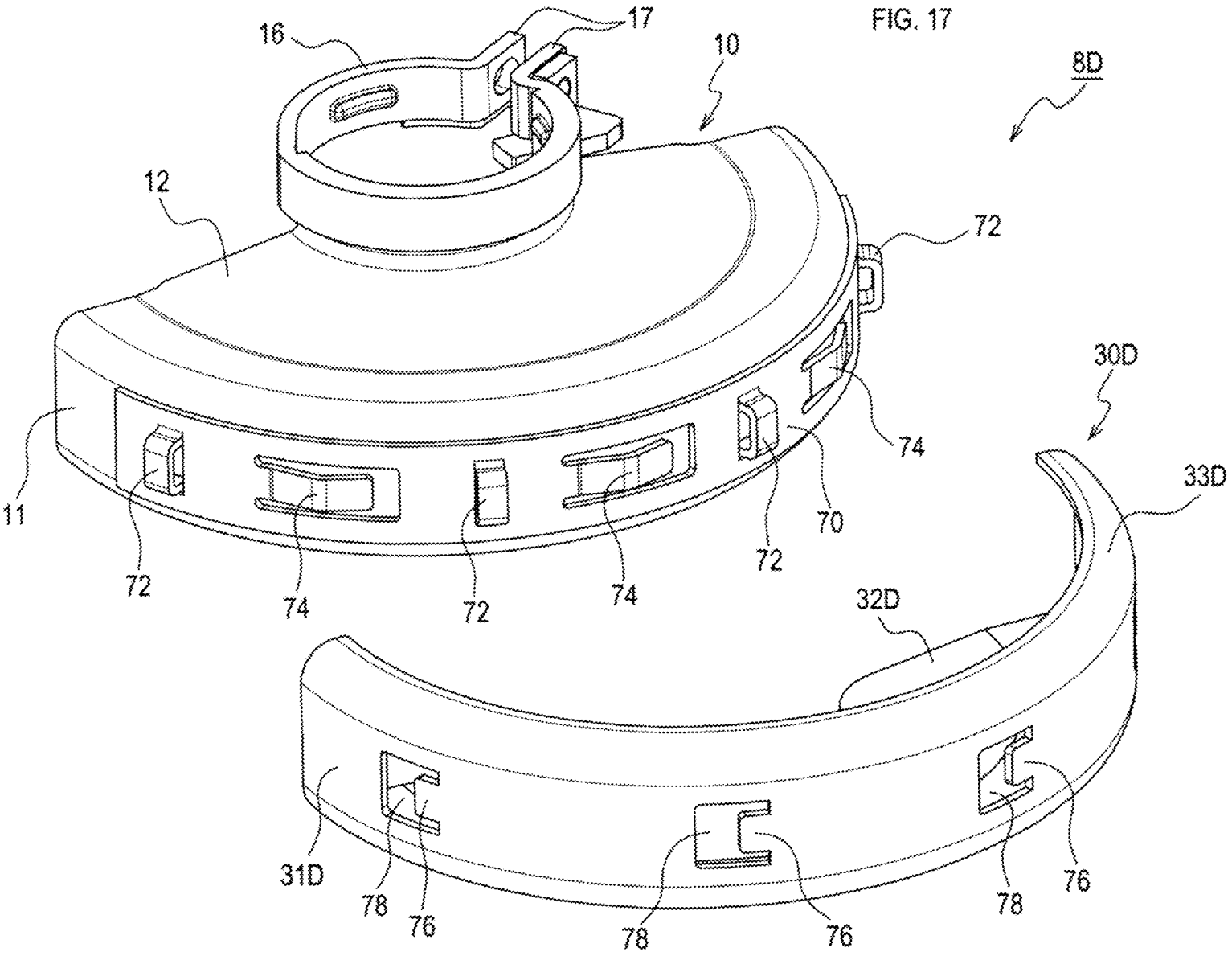
FIG. 17 is a perspective view of a wheel cover according to a fifth embodiment showing its structure.

As shown in FIG. 17, the elongated plate 70 is joined to the first periphery protector 11 along its outer peripheral surface. The plate 70 is a pressed metal plate. The plate 70 includes multiple fitting frames 72 defining fitting holes in the circumferential direction of the first cover 10. The fitting frames 72 protrude from the plate 70 at intervals.

Figure 18A:
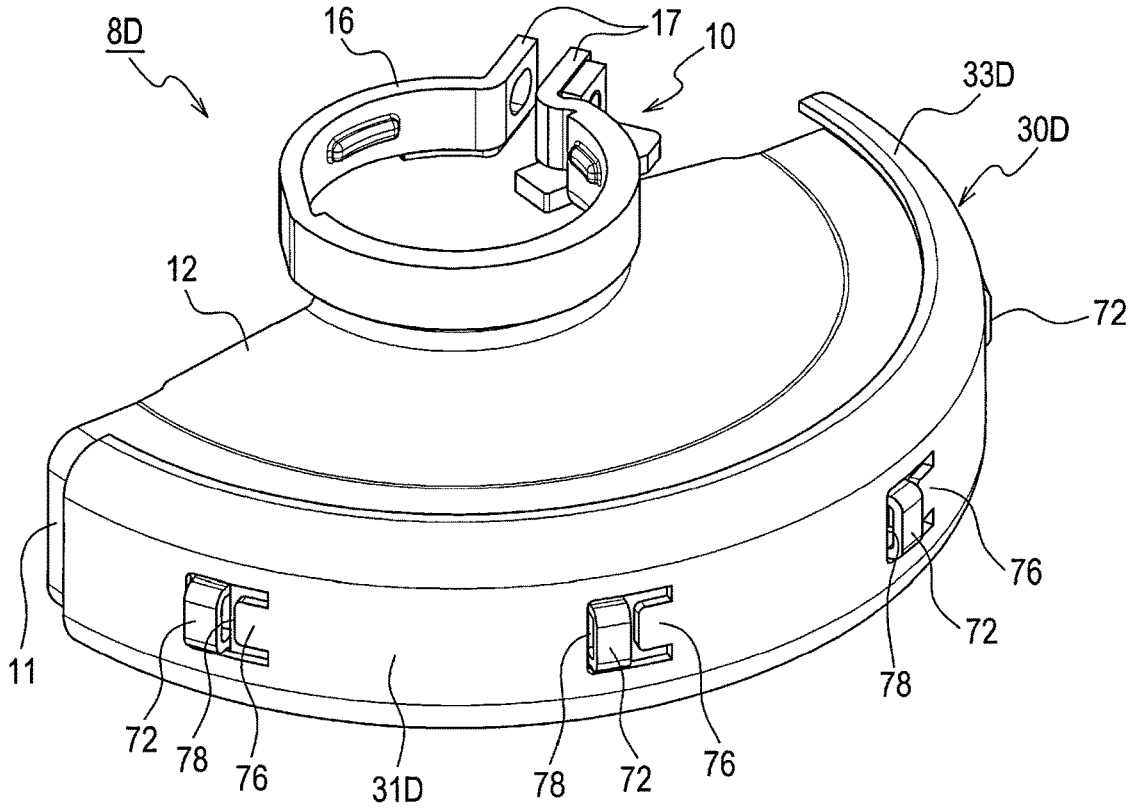
FIG. 18A is a perspective view of the wheel cover with a second cover attached to the first cover before the second cover is secured.
Figure 18B:
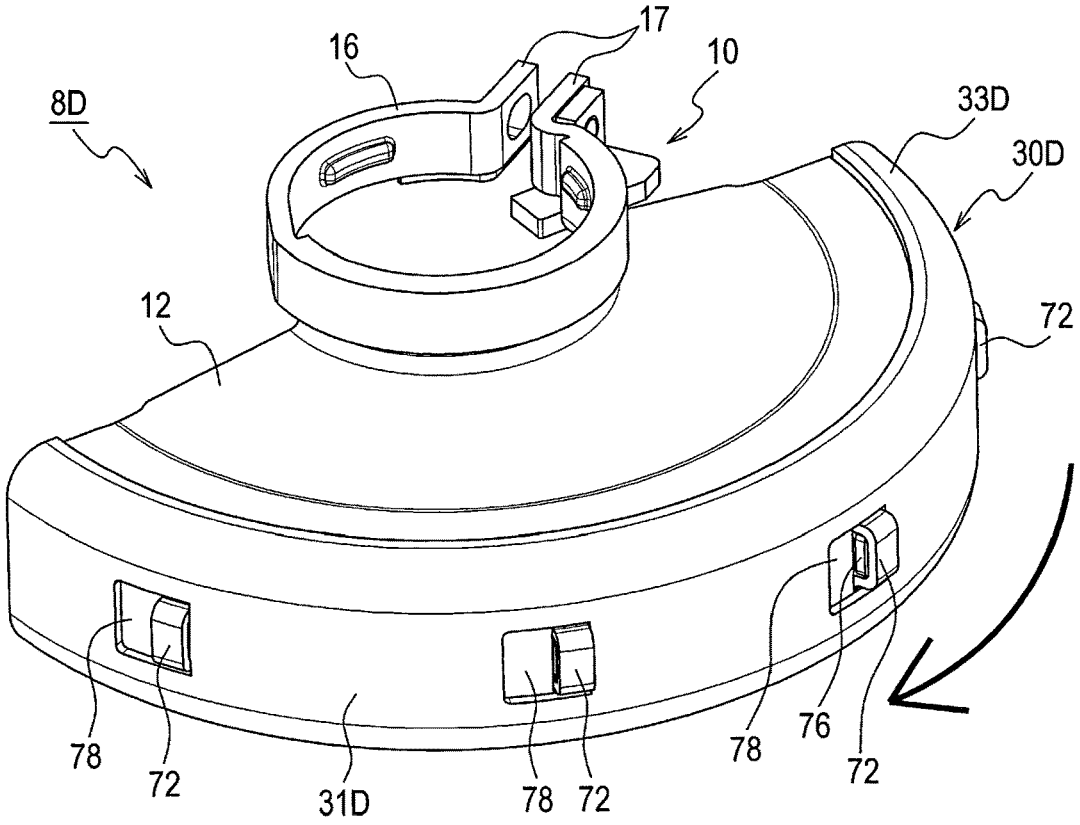
FIG. 18B is a perspective view of the wheel cover with the second cover attached to the first cover after the second cover is secured.
Figure 19:
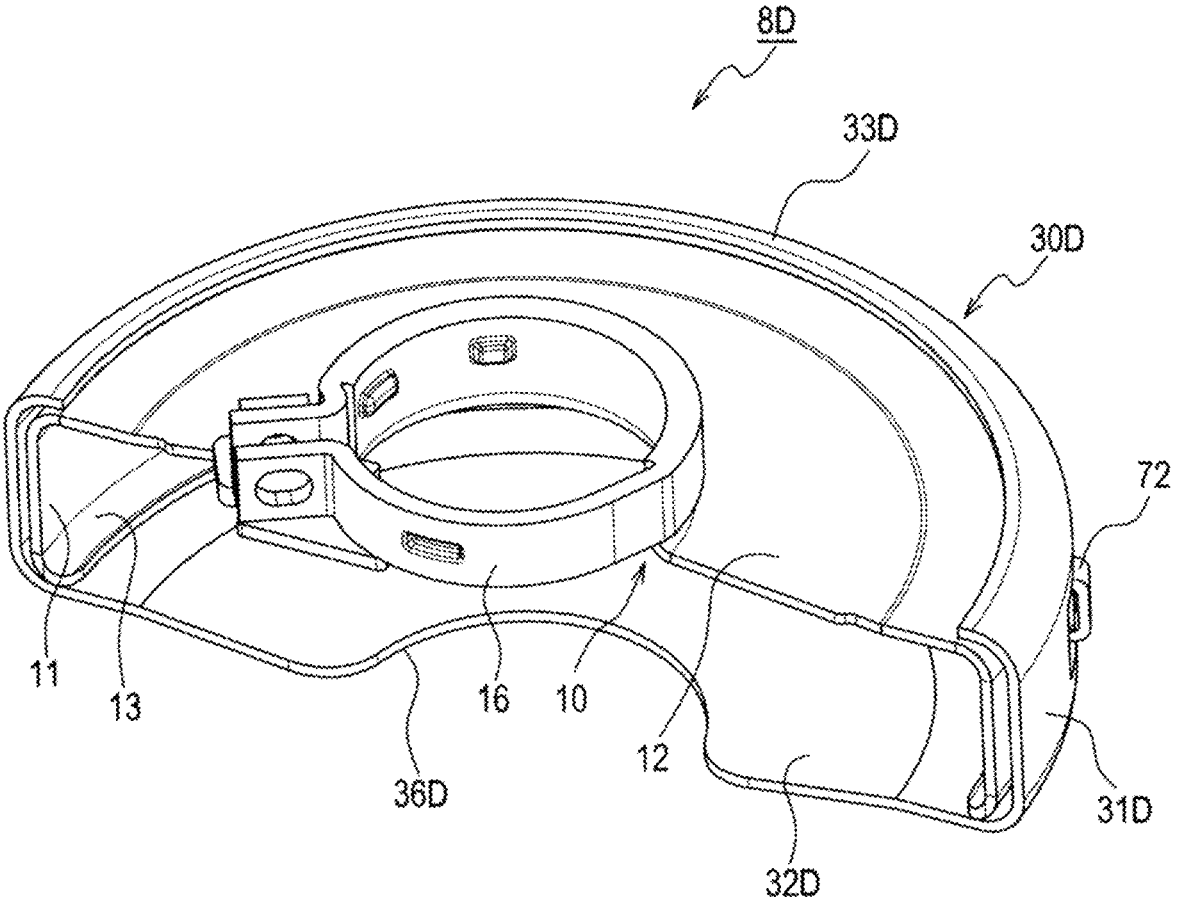
FIG. 19 is a perspective view of the wheel cover according to the fifth embodiment as viewed in a direction opposite to FIG. 18B.

A second periphery protector 31D has multiple insertion holes 78 through which the multiple fitting frames 72 on the plate 70 are inserted when the second cover 30D is placed over the first cover 10 to have the second periphery protector 31D overlapping the first periphery protector 11, as shown in FIGS. 18A to 19.

Each insertion hole 78 is larger than the corresponding fitting frame 72 as shown in FIG. 18A. This allows the second cover 30D to move, with the fitting frames 72 received in the insertion holes 78, relative to the first cover 10 by a predetermined distance in the circumferential direction of the second periphery protector 31D as indicated by the arrow shown in FIG. 18B.

A fitting tab 76 extends in each insertion hole 78. When the second cover 30 is moved relative to the first cover 10 in the circumferential direction of the second periphery protector 31, the fitting tab 76 is received in the corresponding fitting hole defined by the fitting frame 72.

The fitting tabs 76, together with the fitting frames 72 on the first cover 10, serve as an attachment unit for attaching the second cover 30D to the first cover 10. The fitting tabs 76 protrude in the same direction into the corresponding insertion holes 78.

In the present embodiment, to secure the second cover 30D to the first cover 10, the second cover 30D is placed over the first cover 10 and the fitting frames 72 on the first cover 10 are inserted through the insertion holes 78 in the second cover 30, as shown in FIG. 18A.

As shown in FIG. 18B, the second cover 30D is moved relative to the first cover 10 in the direction indicated by the arrow to allow the fitting tabs 76 at the insertion holes 78 to be received in the corresponding fitting holes defined by the fitting frames 72.

The fitting tabs 76 are thus fitted into the corresponding fitting frames 72 and the second cover 30D is firmly secured to the first cover 10, as shown in FIG. 19. The attachment is performed simply by moving the second cover 30D relative to the first cover 10 with a very easy and quick operation.

The plate 70, which is integrally joined to the first cover 10, includes elastic strips (first elastic members or first elastic strips) 74, between the fitting frames 72, defined by cutouts in the plate 70. The elastic strips 74 are integral with the plate 70 along the outer circumference of the first periphery protector 11.

Figure 20C:
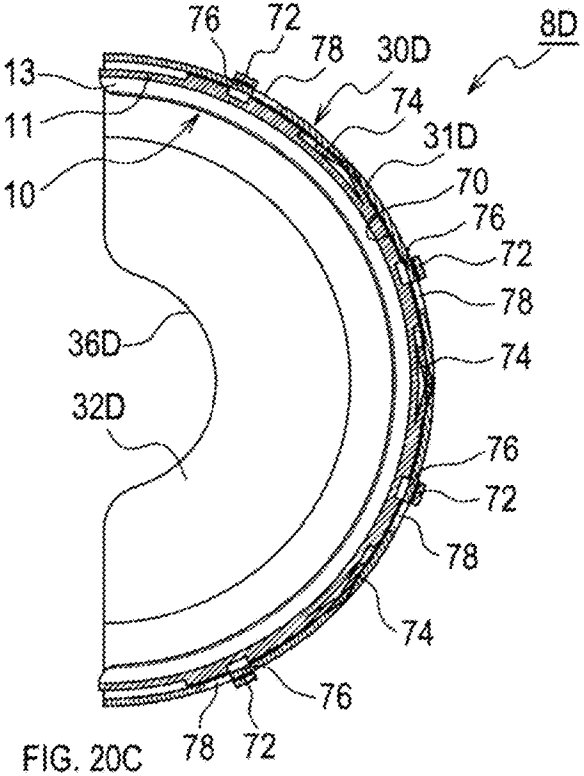
FIG. 20C is a cross-sectional view taken along line XXC-XXC in FIG. 20B.
Figure 20D:
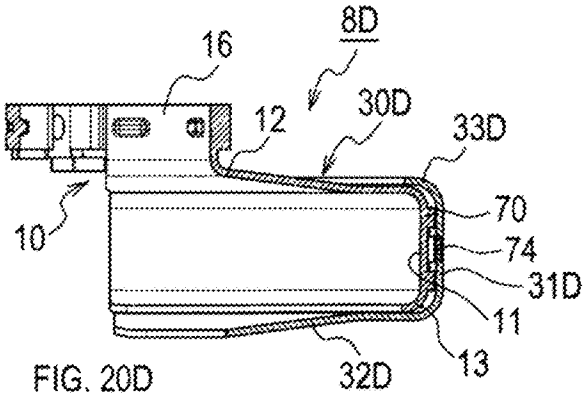
FIG. 20D is a cross-sectional view taken along line XXD-XXD in FIG. 20A.
Figure 20A:
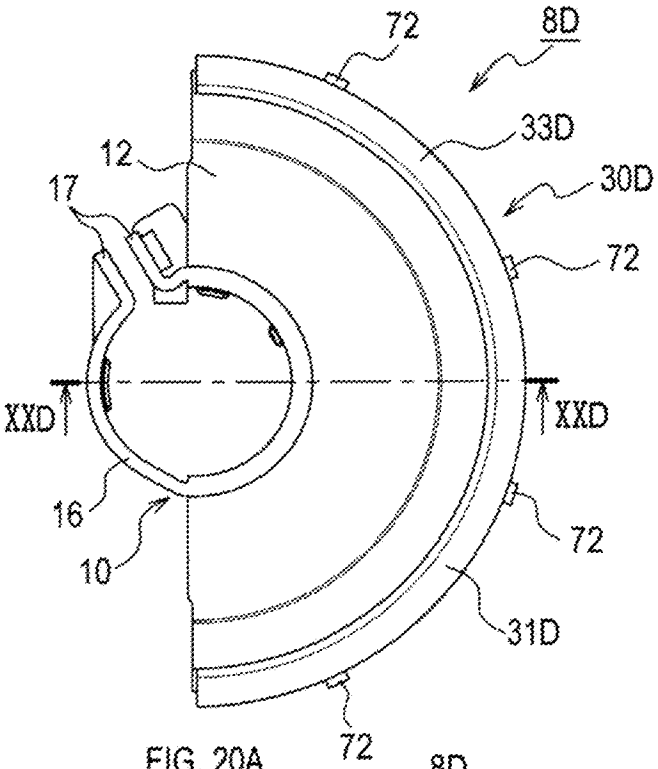
FIG. 20A is a plan view of the wheel cover as viewed from a gear housing.
Figure 20B:
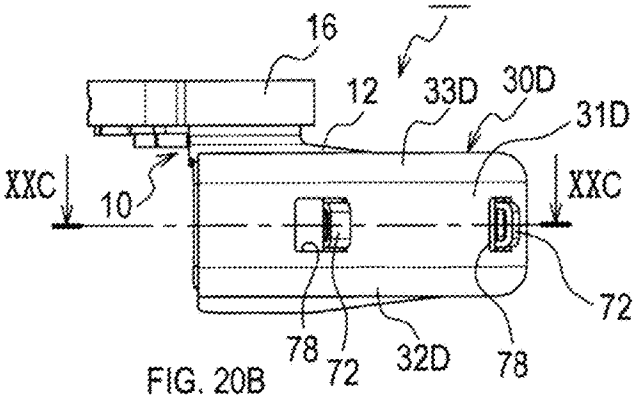
FIG. 20B is a side view of the wheel cover as viewed from below in FIG. 20A.

The elastic strips 74 are elongated narrow strips along the outer circumference of the first periphery protector 11, and each have a middle portion bent outward. When the second cover 30D is attached to the first cover 10, as shown in FIGS. 20C and 20D, the elastic strips 74 come in contact with the inner peripheral surface of the second periphery protector 31D.

The elastic strips 74 thus reduce rattling of the second cover 30D in the radial direction of the tip tool 6 while the second cover 30D is attached to the first cover 10.

The structure according to the present embodiment can also reduce rattling of the second cover 30D, which may cause discomfort to the user in use of the grinder 1 and may lower the operability of the grinder 1. The structure also reduces wear of the engagement portions between the first cover 10 and the second cover 30D resulting from rattling of the second cover 30D and thus reduces degradation of the wheel cover 8D.

Sixth Embodiment

A wheel cover 8E according to a sixth embodiment will now be described.

The wheel cover 8E according to the present embodiment includes the first cover 10 with the same structure as in the first embodiment, a plate 80 integrally joined to the first periphery protector 11 by, for example, welding, and a second cover 30E attachable to the first cover 10 with the plate 80 in between.

The second cover 30E basically has the same structure as in the first embodiment, and thus the components corresponding to those in the first embodiment in the second cover 30E are given the same reference numerals with letter E added in the drawings and will be described partly.

Figure 21:
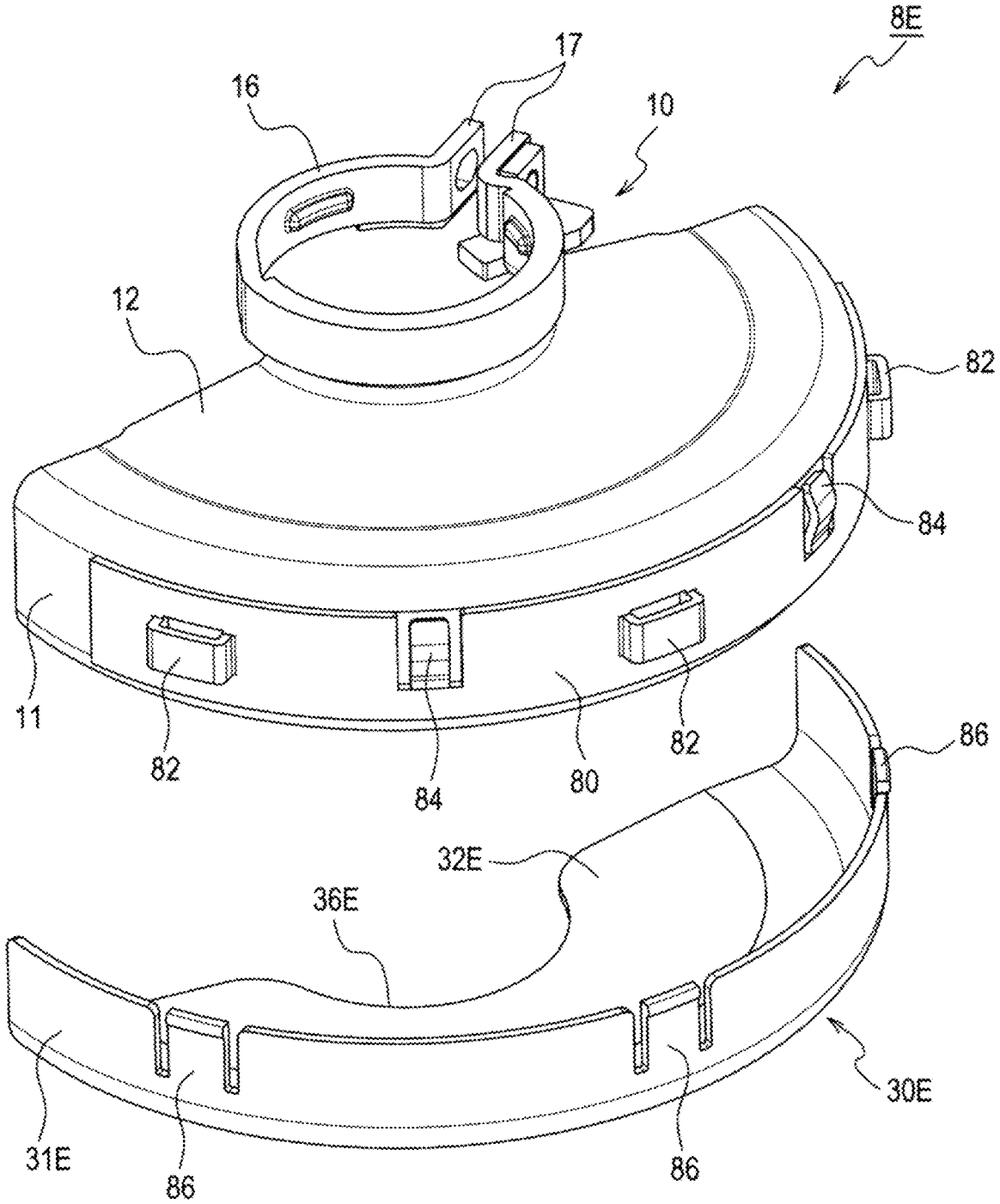
FIG. 21 is a perspective view of a wheel cover according to a sixth embodiment showing its structure.

As shown in FIG. 21, the elongated plate 80 is joined to the first periphery protector 11 along its outer peripheral surface. The plate 80 is a pressed metal plate. The plate 80 includes multiple fitting frames 82 defining fitting holes in the direction orthogonal to the circumferential direction of the first cover 10. The fitting frames 82 protrude from the plate 80 at intervals.

A second periphery protector 31E has no curved portion 33, and has an end extending straight opposite to the end adjacent to a second plate face protector 32E.

The second periphery protector 32E has multiple fitting tabs 86 on the opening edge opposite to the end adjacent to the second plate face protector 32E. The fitting tabs 86 are defined by cutouts in the second periphery protector 32E and can be fittable into fitting holes defined by the fitting frames 82 on the first cover 10.

Figure 22:
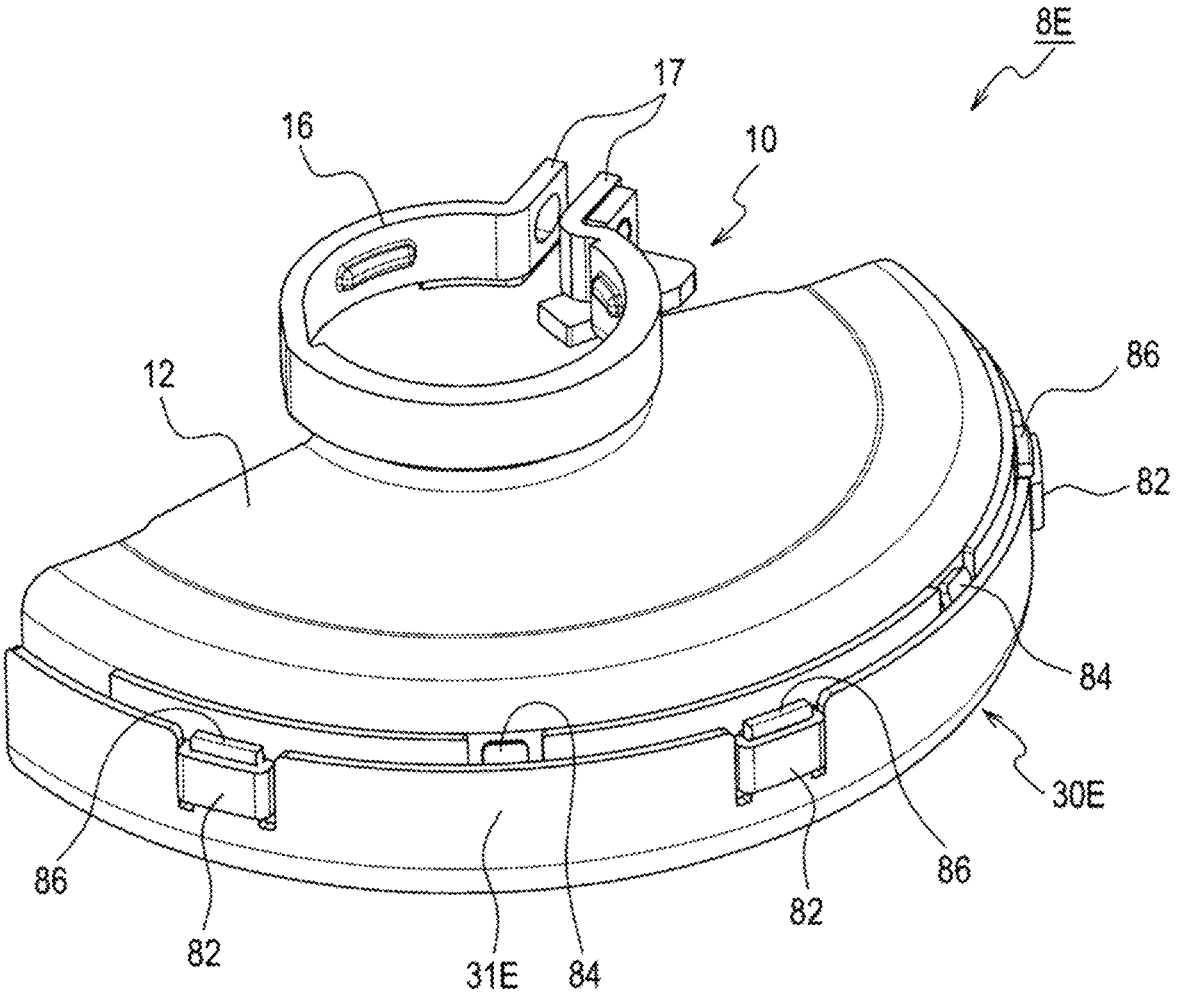
FIG. 22 is a perspective view of the wheel cover with a second cover attached to the first cover.
Figure 23:
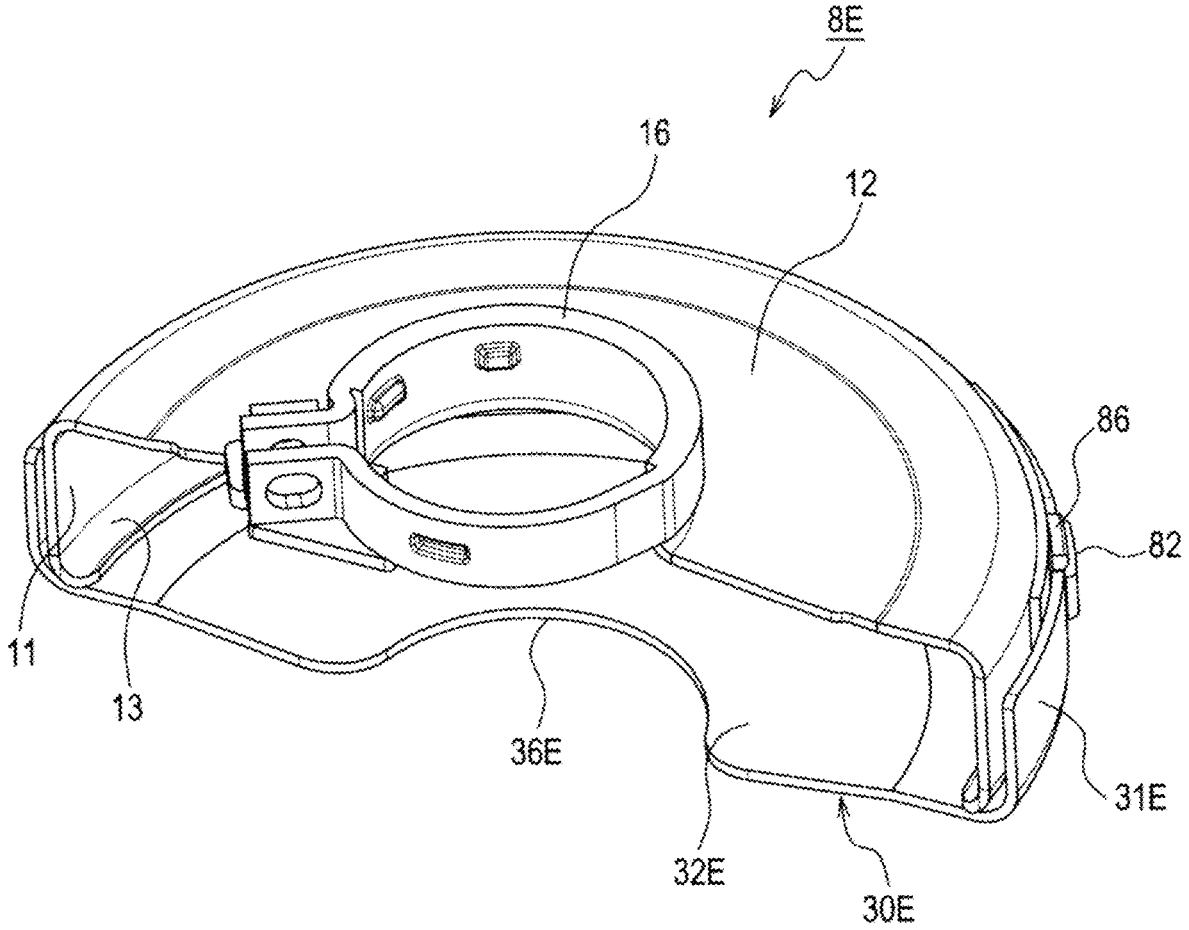
FIG. 23 is a perspective view of the wheel cover according to the sixth embodiment as viewed in a direction opposite to FIG. 22.
Figure 24C:
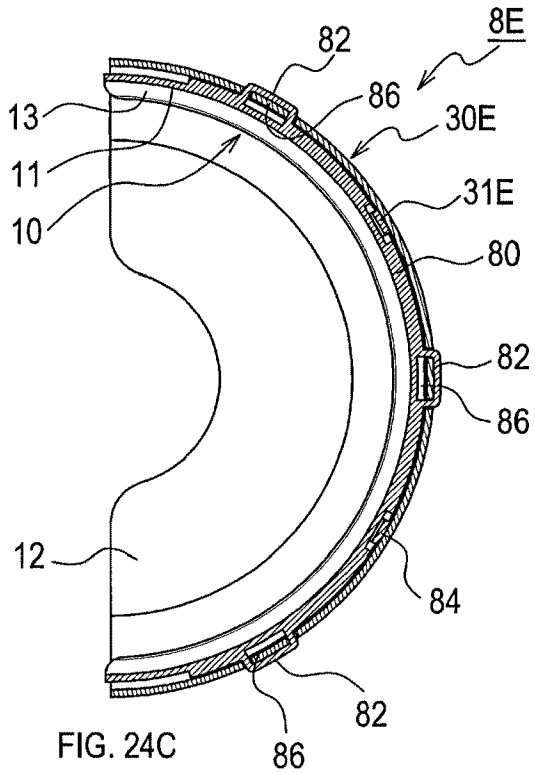
FIG. 24C is a cross-sectional view taken along line XXIVC-XXIVC in FIG. 24B.
Figure 24D:
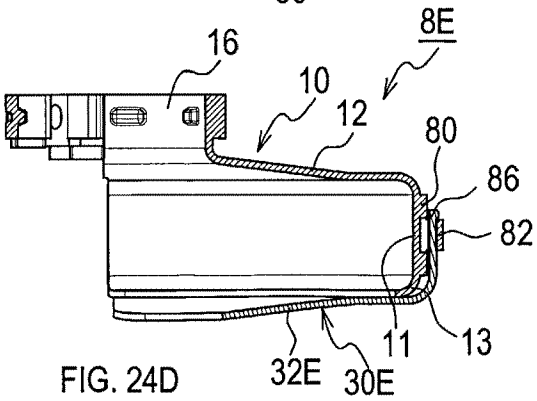
FIG. 24D is a cross-sectional view taken along line XXIVD-XXIVD in FIG. 24A.
Figure 24A:
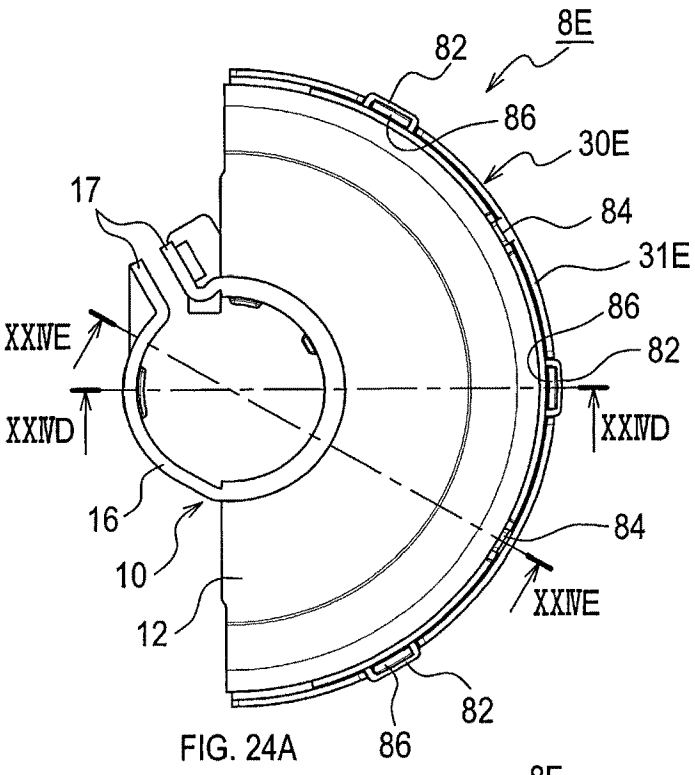
FIG. 24A is a plan view of the wheel cover as viewed from a gear housing.
Figure 24B:
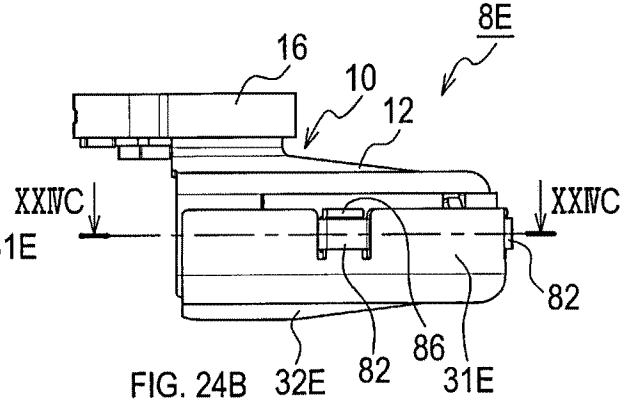
FIG. 24B is a side view of the wheel cover as viewed from below in FIG. 24A.
Figure 24E:
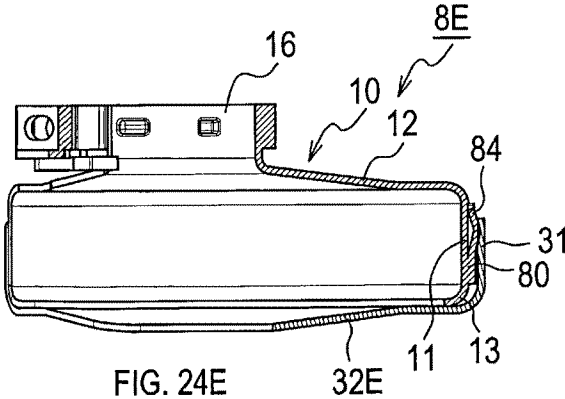
FIG. 24E is a cross-sectional view taken along line XXIVE-XXIVE in FIG. 24A.

In the wheel cover 8E, the second cover 30E is attachable to the first cover 10 as shown in FIGS. 22 and 23, with the second cover 30E being moved in the axial direction of the output shaft 5 to cause each fitting tab 86 to be fitted into the corresponding fitting frame 82.

In the present embodiment, as in the wheel cover 8D according to the fifth embodiment, the second cover 30E is attachable to the first cover 10 with an easy and quick operation.

The plate 80, which is integrally joined to the first cover 10, includes elastic strips (first elastic members or first elastic strips) 84, between the fitting frames 82, defined by cutouts in the plate 80. The elastic strips 84 each have a free end adjacent to an end of the first periphery protector 11 connecting to the plate face protector 12 and are integral with the plate 80.

Each elastic strip 84 extends from one end adjacent to the first curved portion 13 to the free end adjacent to the first plate face protector 12, and has a middle portion bent outward between the two ends. When the second cover 30E is attached to the first cover 10, as shown in FIGS. 24A to 24E, the elastic strips 84 come in contact with the inner peripheral surface of the second periphery protector 31E.

The elastic strips 84 thus reduce rattling of the second cover 30E in the radial direction of the tip tool 6 while the second cover 30E is attached to the first cover 10.

The structure according to the present embodiment can also reduce rattling of the second cover 30E, which may cause discomfort to the user in use of the grinder 1 and may lower the operability of the grinder 1. The structure also reduces wear of the engagement portions between the first cover 10 and the second cover 30D resulting from rattling of the second cover 30E and thus reduces degradation of the wheel cover 8E.

Although the embodiments of the present disclosure have been described above, the wheel cover according to the present disclosure is not limited to the above embodiments and can be modified variously.

First Modification

For example, the elastic strip (first elastic member or first elastic strip) 34 in the first embodiment is integral with the second periphery protector 31.

Figure 25A:
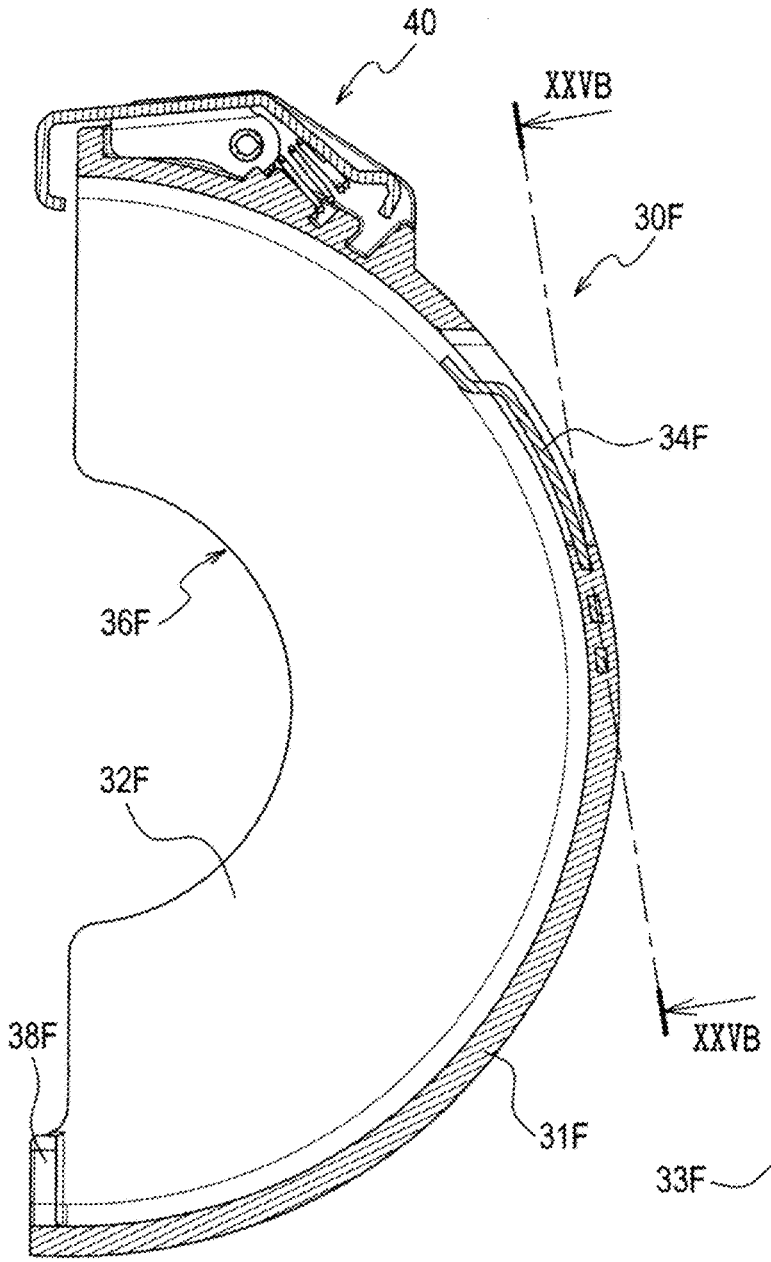
FIG. 25A is a cross-sectional view of a second cover, corresponding to FIG. 4C, as viewed from a gear housing.
Figure 25B:
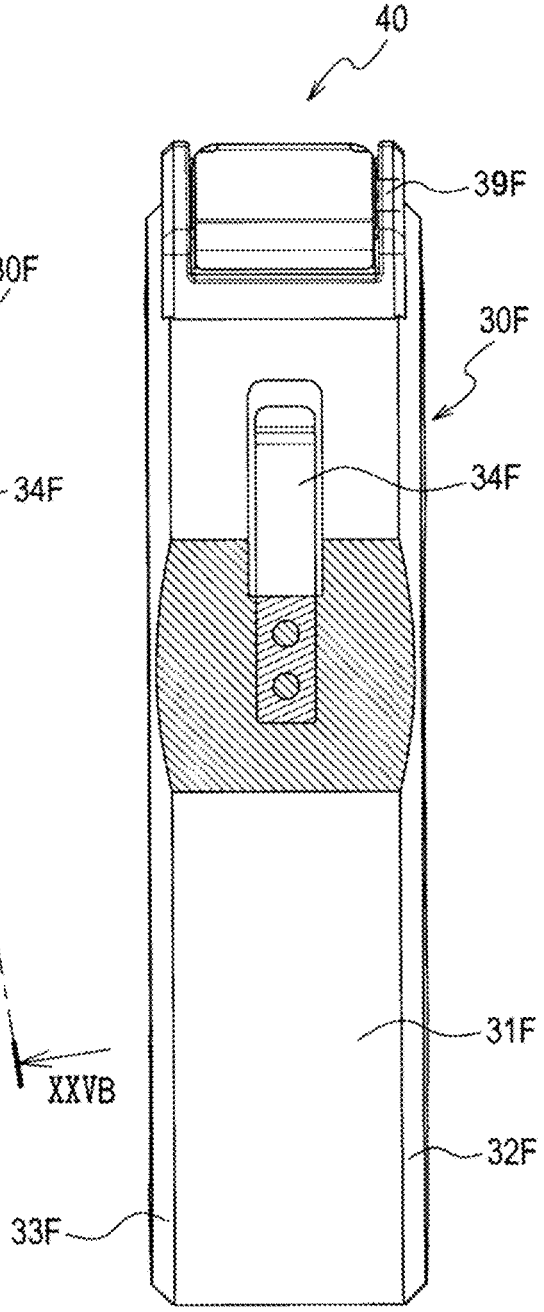
FIG. 25B is a cross-sectional view taken along line XXVB-XXVB in FIG. 25A.

In another embodiment, as shown in FIGS. 25A and 25B, an elastic strip 34F may be a metal plate separate from a second cover 30F and integrally formed with the second cover 30F by insert molding.

Figure 26A:
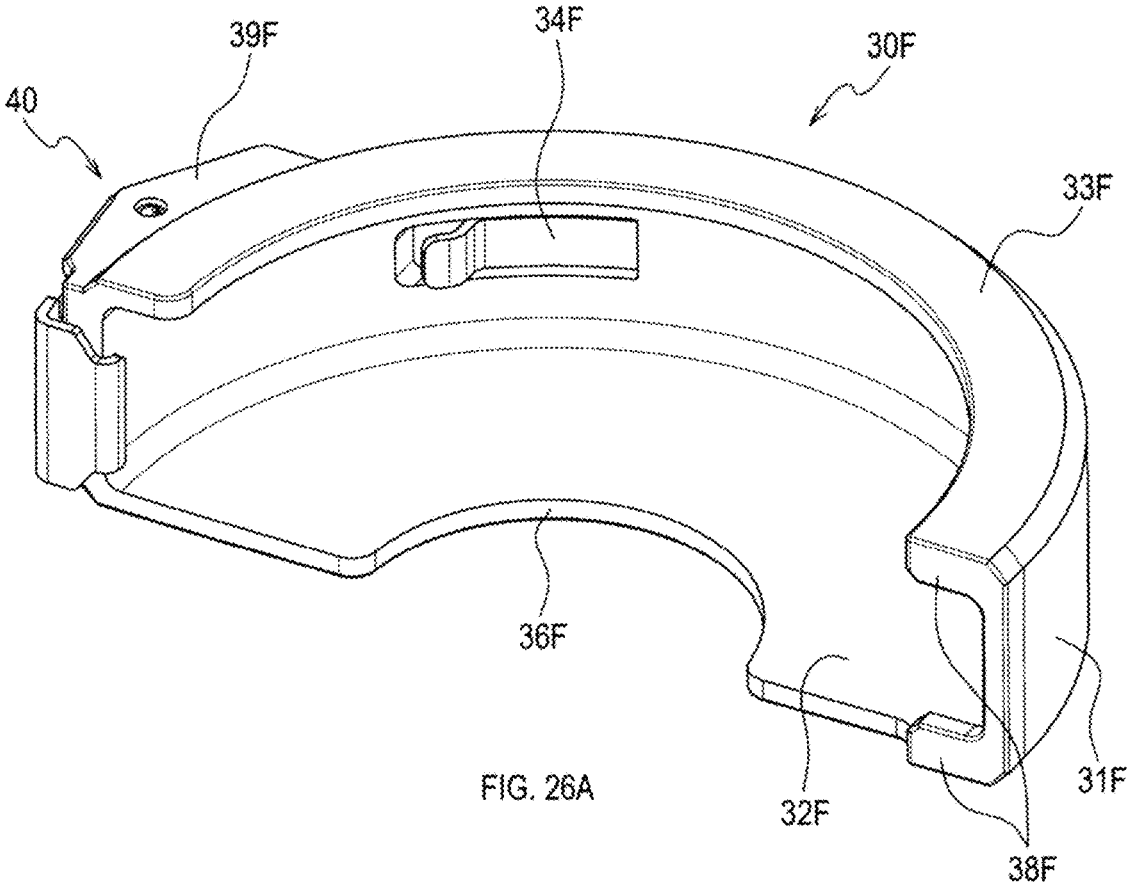
FIG. 26A is a perspective view of the second cover as viewed from its inside to be attached to the first cover.
Figure 26B:
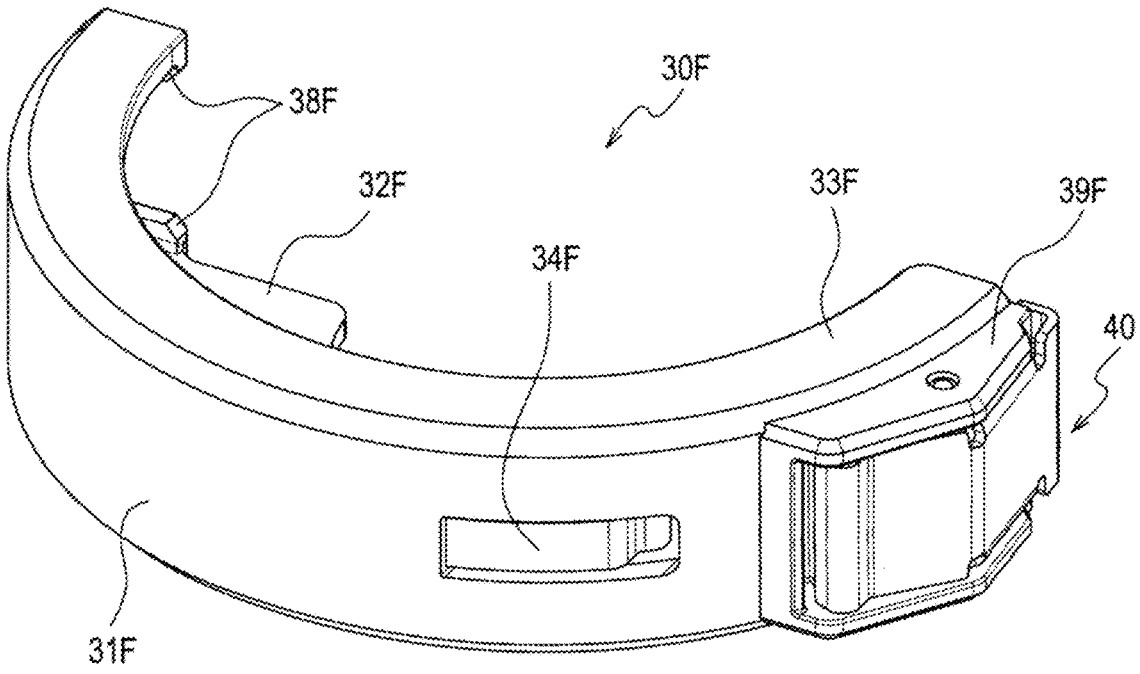
FIG. 26B is a perspective view of the second cover as viewed from its outside opposite to FIG. 26A.

In the present modification, as shown in FIGS. 26A and 26B, the second cover 30F includes the elastic strip 34F in a second periphery protector 31F as in the first embodiment. The second cover 30F attached to the first cover 10 can thus reduce rattling of the second cover 30F in the radial direction of the tip tool 6.

The second cover 30F in the first modification shown in FIGS. 25A to 26B includes the same engagement member 40 as in the first embodiment, but the engagement member 40 may be modified as in the second to fourth embodiments. The second cover 30F in the present modification includes no elastic strip 35 in a curved portion 33F, but may include the elastic strip (second elastic member or second elastic strip) 35 as in the first and fourth embodiments.

Second Modification

Figure 27:
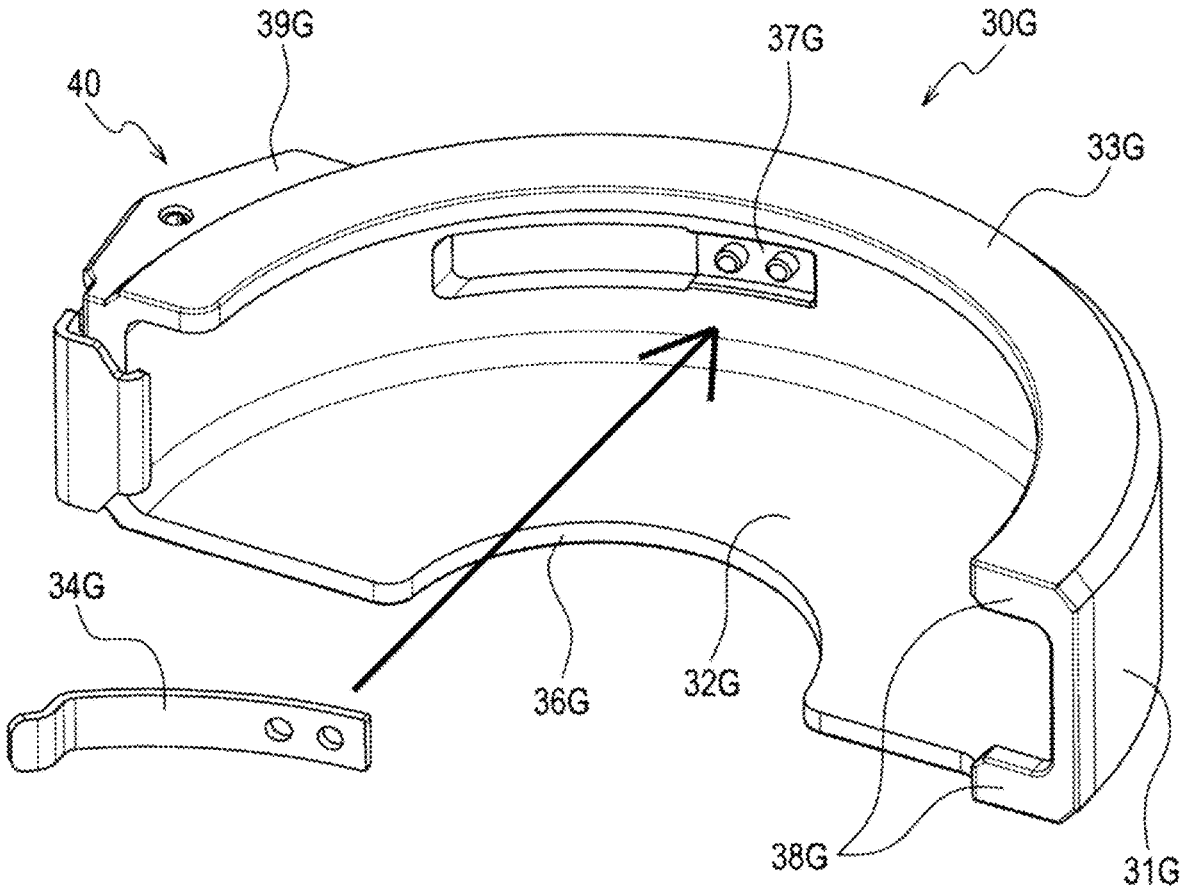
FIG. 27 is a perspective view of a second cover according to a second modification without a leaf spring serving as a first elastic strip.
Figure 28:
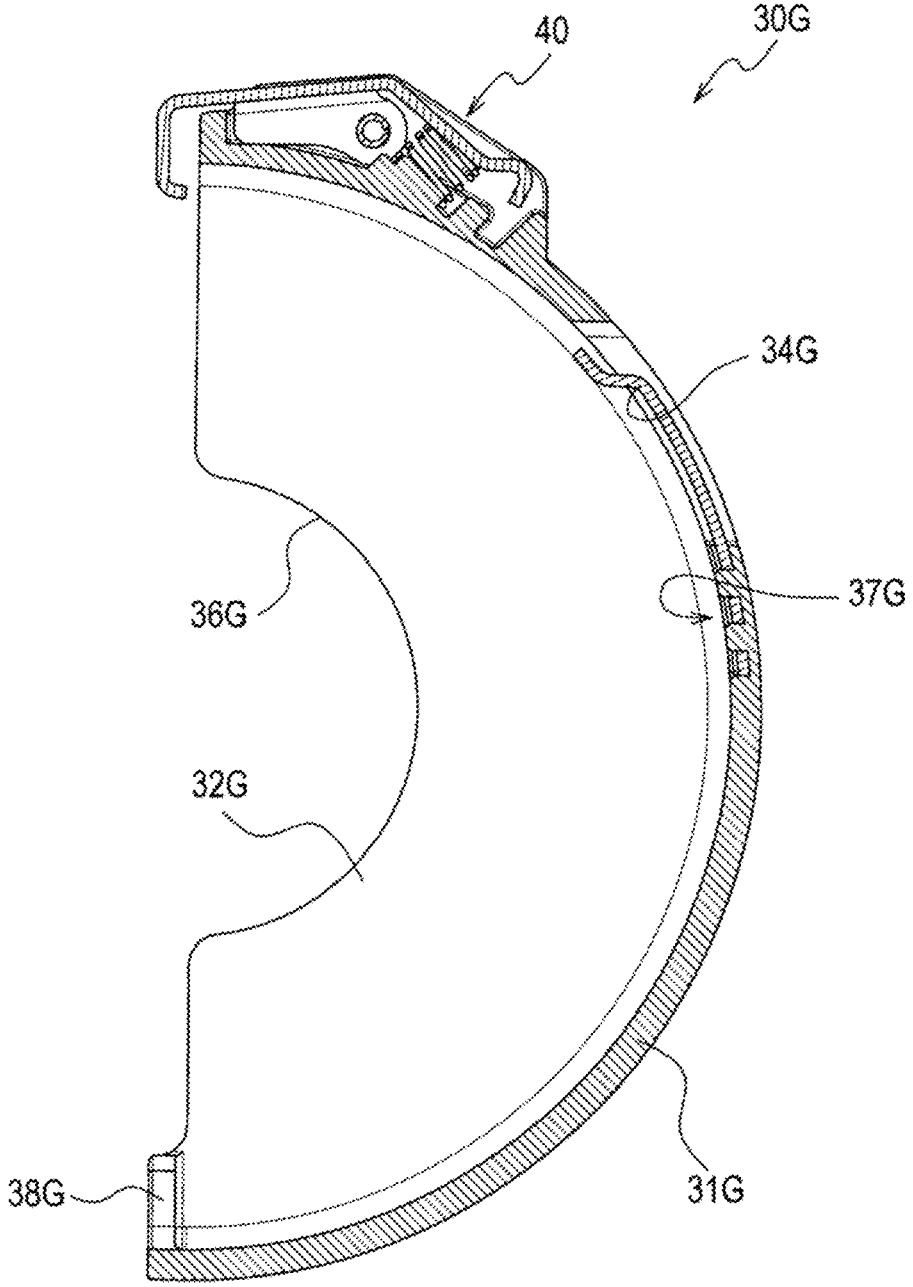
FIG. 28 is a cross-sectional view of the second cover according to the second modification, corresponding to FIG. 4C, as viewed from a gear housing.

As shown in FIGS. 27 and 28, when an elastic strip 34G is separate from a second cover 30G, the elastic strip 34G may be secured to the second cover 30G by, for example, press-fitting, welding, bonding, or hooking with a tab.

Figure 29A:
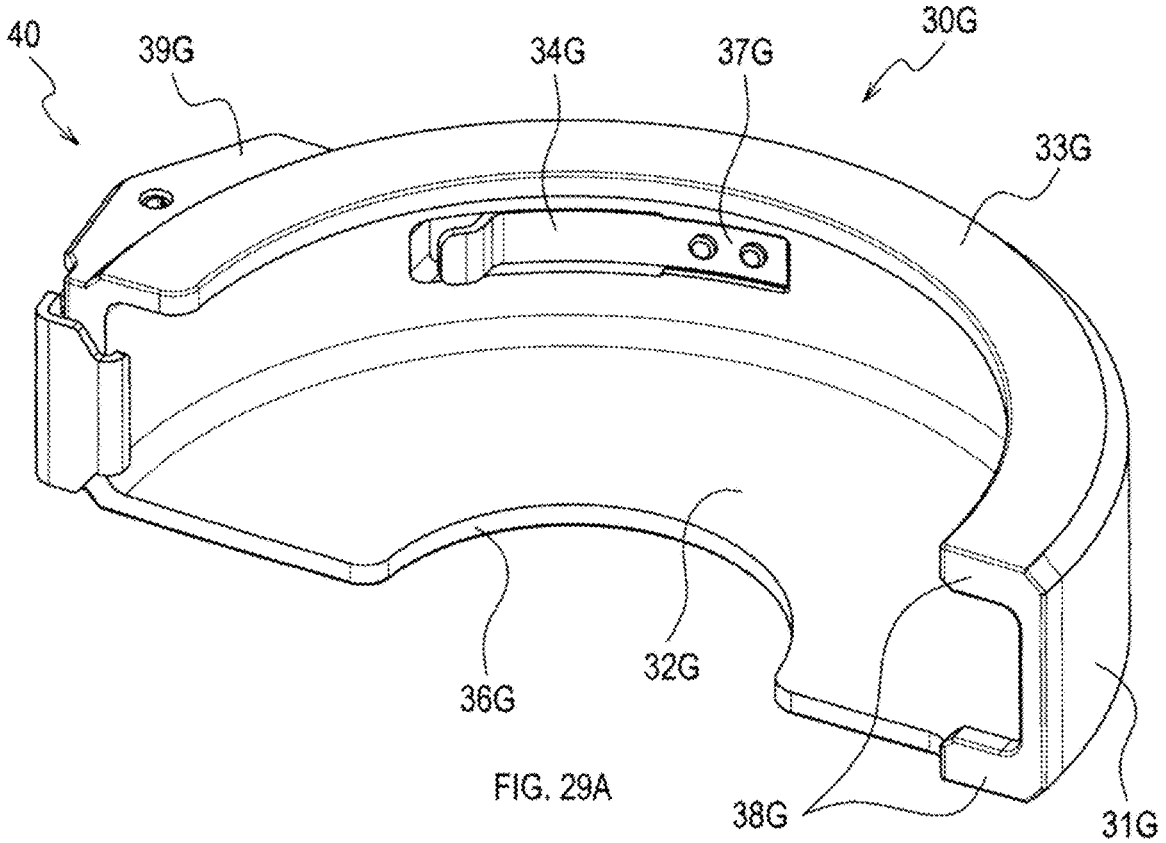
FIG. 29A is a perspective view of the second cover as viewed from its inside to be attached to the first cover with the leaf spring serving as the first elastic strip attached.
Figure 29B:
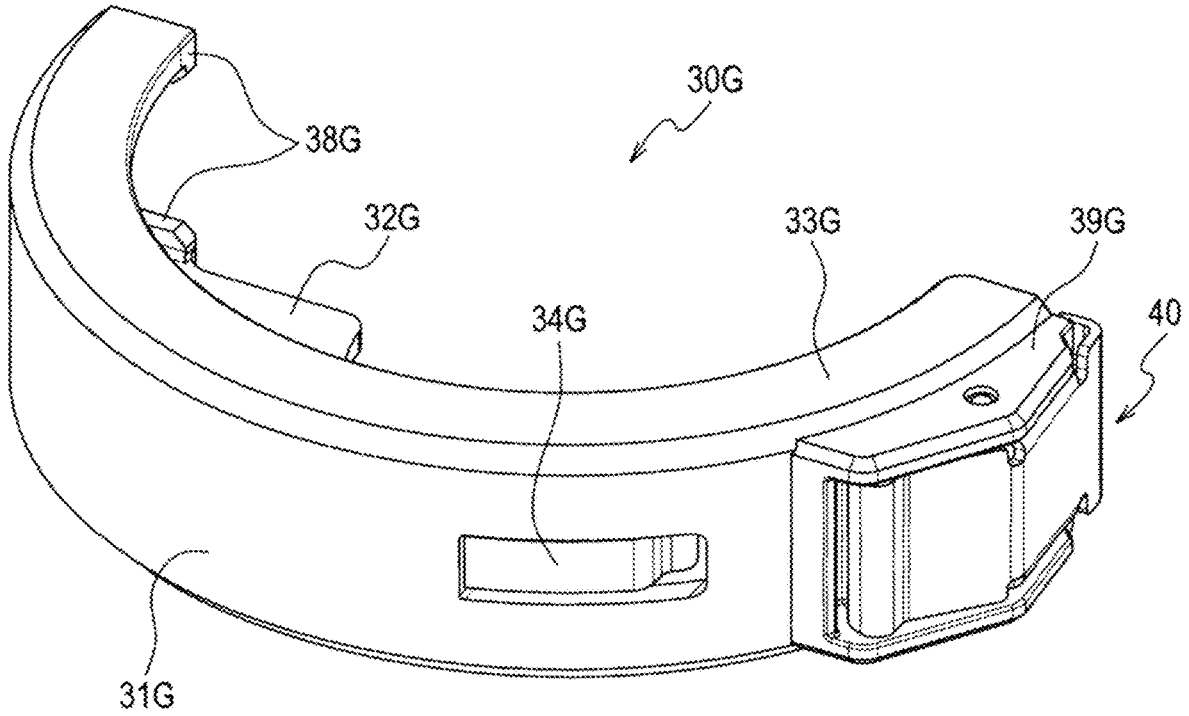
FIG. 29B is a perspective view of the second cover as viewed from its outside opposite to FIG. 29A with the leaf spring serving as the first elastic strip attached.

In this manner as well, as shown in FIGS. 29A and 29B, the second cover 30G may include the elastic strip 34G in a second periphery protector 31G. The second cover 30G attached to the first cover 10 can thus reduce rattling of the second cover 30G in the radial direction of the tip tool 6.

The elastic strip 34G in this modification may be a metal plate as in the first modification or may be formed from a synthetic resin. The second cover 30G may also be a metal plate or formed from a synthetic resin.

The second cover 30G in the present modification includes the same engagement member 40 as in the first embodiment, but the engagement member 40 may be modified as in the second to fourth embodiments. A second curved portion 33G may include the elastic strip 35, as in the first and fourth embodiments.

Third Modification

In each of the above embodiments, one or more elastic strips 35, 34, 74, and 84 defined in the second cover 30 or in the first cover 10 are used as rattle restrainers to reduce rattling of the second cover 30.

The rattle restrainers according to the present disclosure may reduce any rattling of the second cover 30 in the radial direction of the tip tool 6 or in the axial direction of the output shaft 5 when the second cover 30 is attached to the first cover 10. The rattle restrainers may not be elastic strips, which are leaf springs.

Figure 30A:
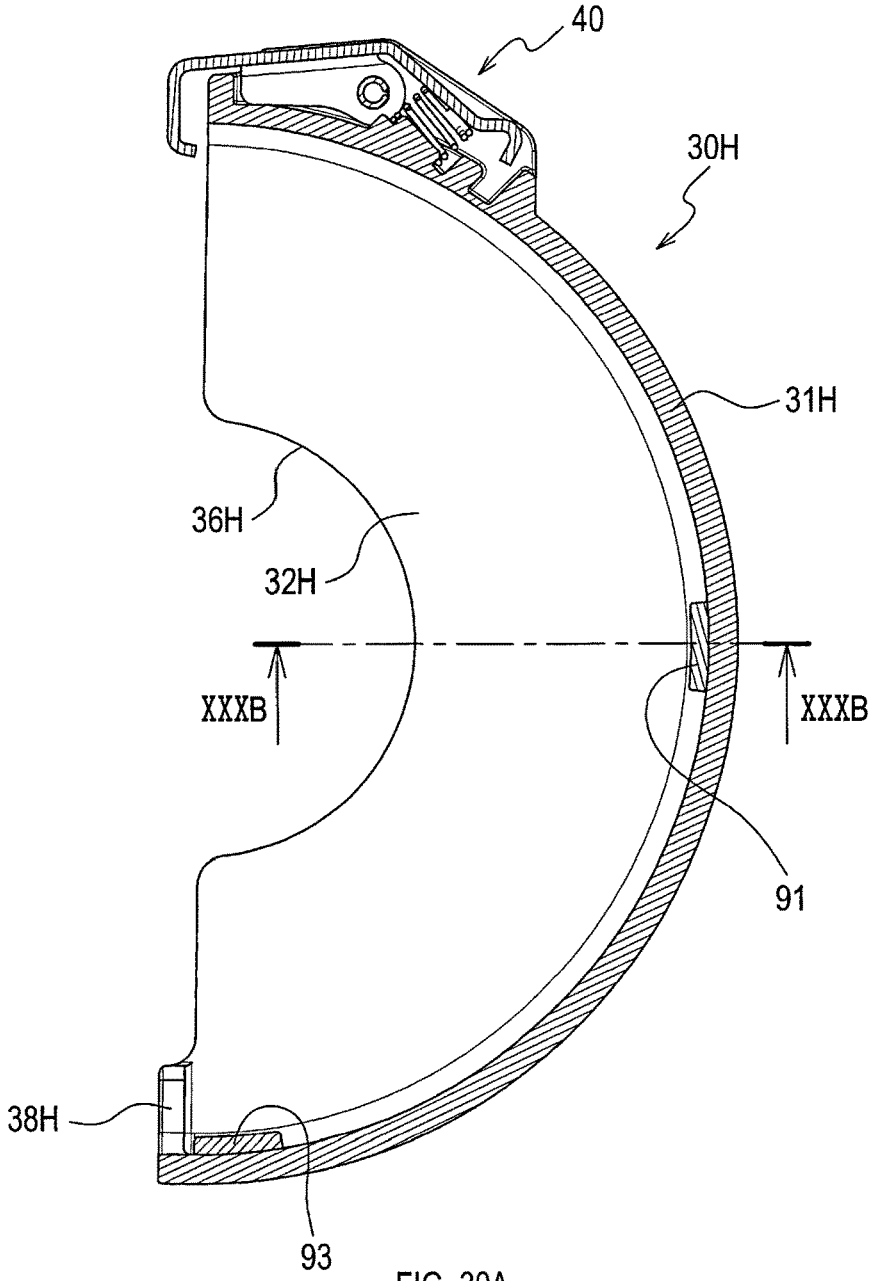
FIG. 30A is a cross-sectional view of a second cover as viewed from a gear housing, corresponding to FIG. 4C.
Figure 30B:
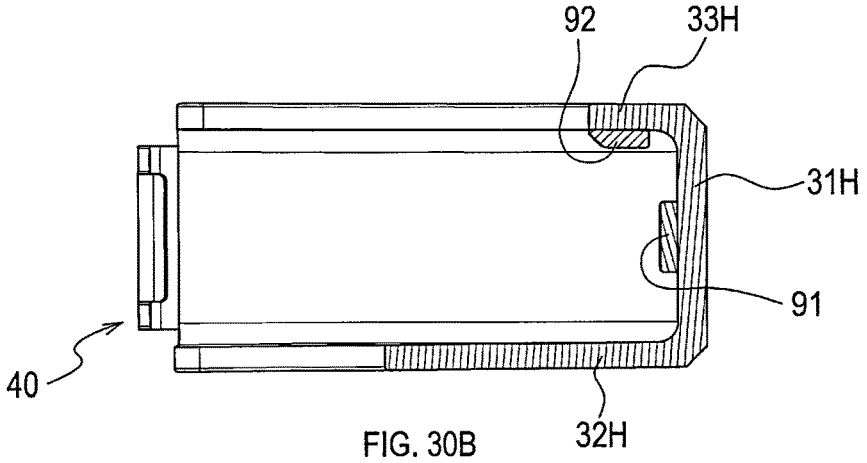
FIG. 30B is a cross-sectional view taken along line XXXB-XXXB in FIG. 30A.
Figure 31:
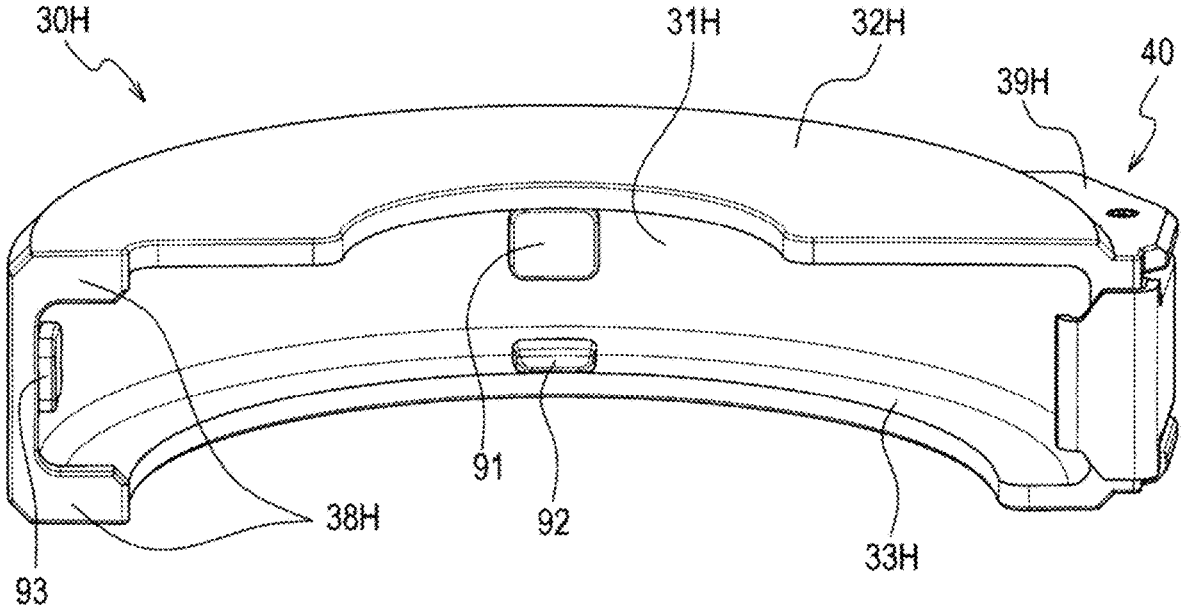
FIG. 31 is a perspective view of the second cover according to a third modification as viewed from its inside to be attached to the first cover.

For example, as shown in FIGS. 30A to 31, elastic members 91 and 93 formed from elastic rubber, a sponge, or an elastomer may be applied to, as the rattle restrainers, the circumferentially middle portion of the inner peripheral surface of a second periphery protector 31H and to an end of the second periphery protector 31H adjacent to a bend 38H.

In this manner, the elasticity of the elastic members 91 and 93 reduces rattling of a second cover 30H in the radial direction of the tip tool 6.

In this case, an elastic member 92 formed from elastic rubber, a sponge, or an elastomer may also be applied to the circumferentially middle of the inner peripheral surface of a second curved portion 33H. This can reduce rattling of the second cover 30H in the axial direction of the output shaft 5.

The number of elastic members 91 to 93 and their attachment positions in FIGS. 30A to 31 may be changed as appropriate. The elastic members 91 to 93 may be located on the outer peripheral surface of the first cover 10.

Fourth Modification

In the third modification, the elastic members 91 to 93 located on the inner peripheral surface of the second periphery protector 31H and the second curved portion 33H reduce rattling of the second cover 30H in the radial direction of the tip tool 6 and in the axial direction of the output shaft 5.

Figure 32A:
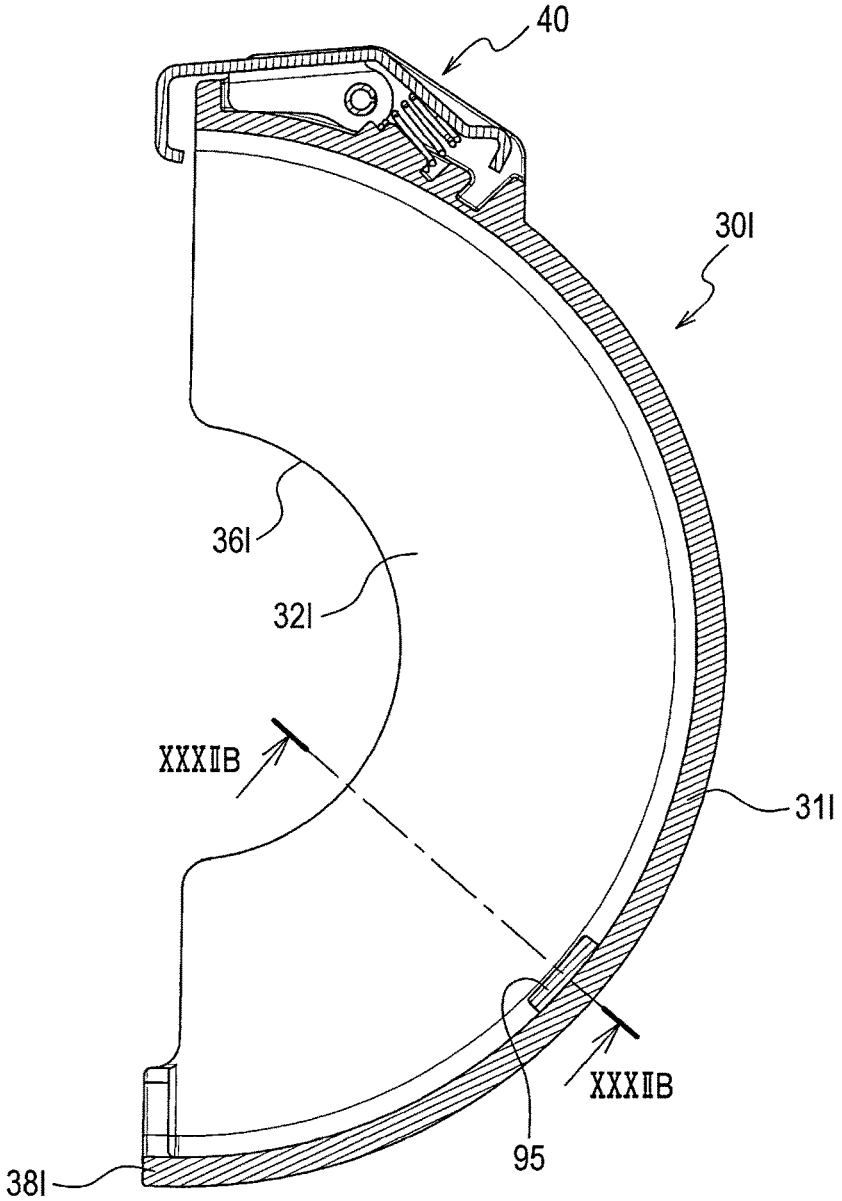
FIG. 32A is a cross-sectional view of a second cover, corresponding to FIG. 4C, as viewed from a gear housing.
Figure 32B:
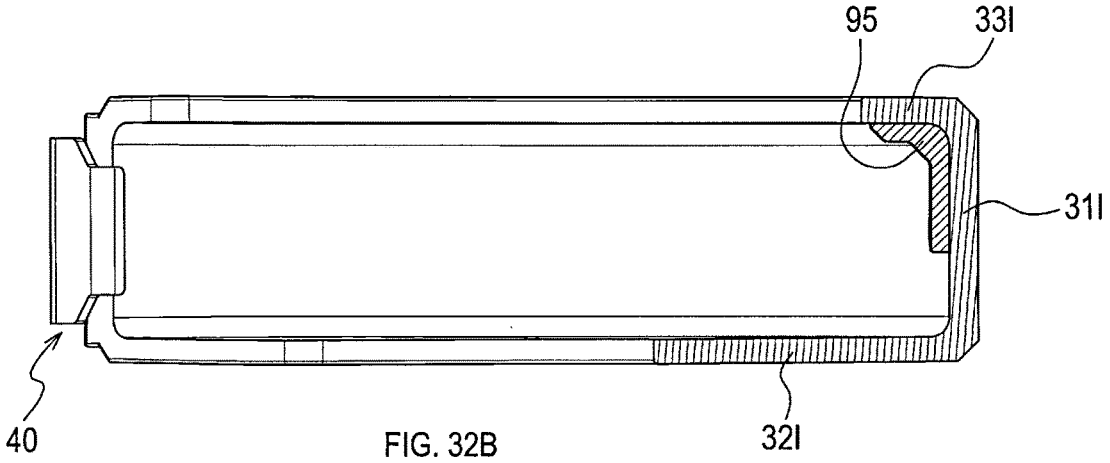
FIG. 32B is a cross-sectional view taken along line XXXIIB-XXXIIB in FIG. 32A.
Figure 33:
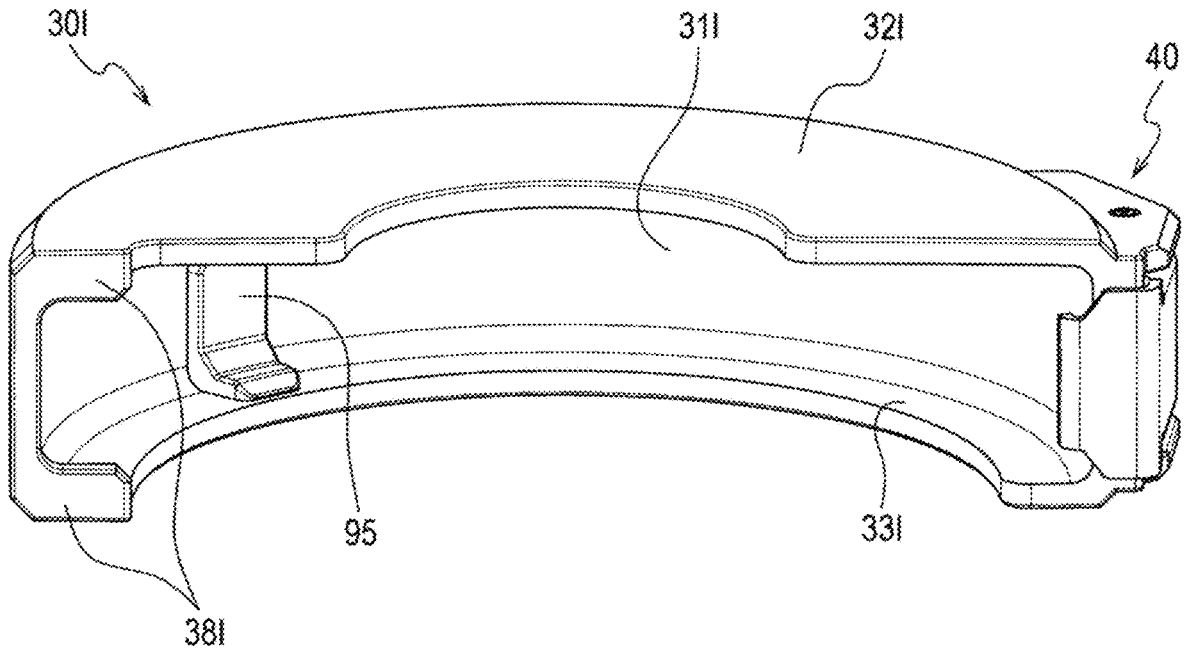
FIG. 33 is a perspective view of the second cover according to a fourth modification as viewed from its inside to be attached to the first cover.

As shown in FIGS. 32A to 33, a single elastic member 95 formed from elastic rubber, a sponge, or an elastomer may be applied to extend from a second periphery protector 31I to a second curved section 33I.

In this case, as shown in FIG. 32A, the elastic member 95 may be located at an intermediate position between the circumferentially middle of the second periphery protector 31I and the end of the second periphery protector 31I adjacent to a bend 38I. This structure can reduce rattling of the second cover 30H more effectively in the radial direction of the tip tool 6 and in the axial direction of the output shaft 5.

Seventh Embodiment

In the first to sixth embodiments and the first to fourth modifications, the elastic strips 34, 35, 74, and 84, or elastic members 91 to 93, and 95, which function as first or second elastic members in an aspect of the present invention, reduce rattling.

To reduce rattling of the second cover 30, the first periphery protector 11 and the second periphery protector 31 may not be urged to be away from each other, or the second curved portion 33 may not be urged to be away from the first plate face protector 12.

In another embodiments, a third elastic member located on the second cover 30 may urge the first periphery protector 11 and the second periphery protector 31 in a direction to be in tight contact with each other. This structure also reduces rattling of the second cover 30.

In the present embodiment, a wheel cover including the third elastic member on the second cover 30 to reduce rattling of the second cover 30 will be described.

A wheel cover 8J according to the present embodiment basically has the same structure as the wheel cover 8 according to the first embodiment, with a second cover 30J and an engagement member 40J structurally different from the corresponding components in the first embodiment. The seventh embodiment will be described focusing on the differences, and the components corresponding to those in the first embodiment in the second cover 30J and the engagement member 40J are given the same reference numerals with letter J added in the drawings and will be described partly.

In the present embodiment, the second cover 30J and the engagement member 40J are metal plates, similarly to the first cover 10.

As shown in FIGS. 34 to 39, a second periphery protector 31J has a bend 38J on its first circumferential end, and the engagement member 40J on its second circumferential end.

Figure 34:
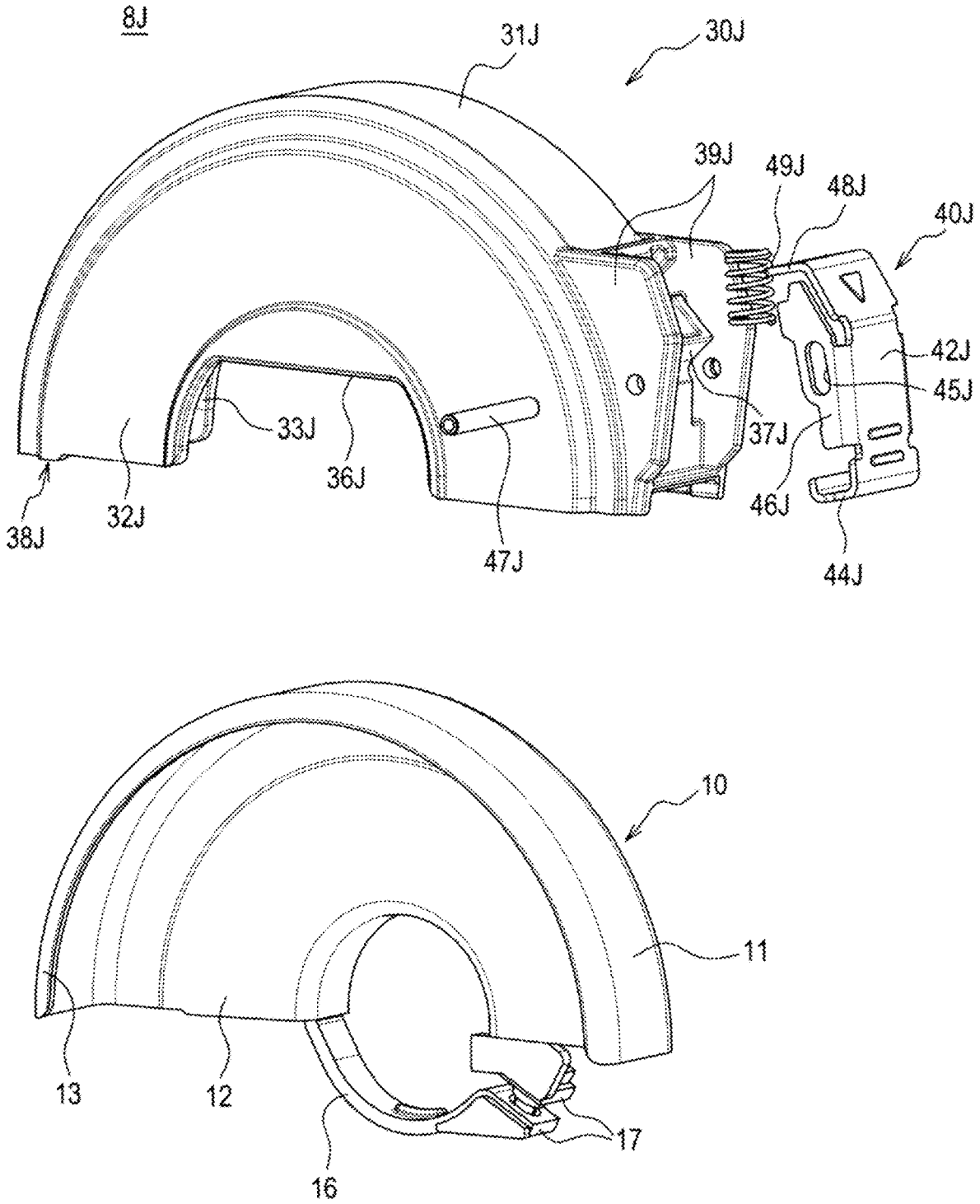
FIG. 34 is a perspective view of a wheel cover according to a seventh embodiment showing its structure.
Figure 35A:
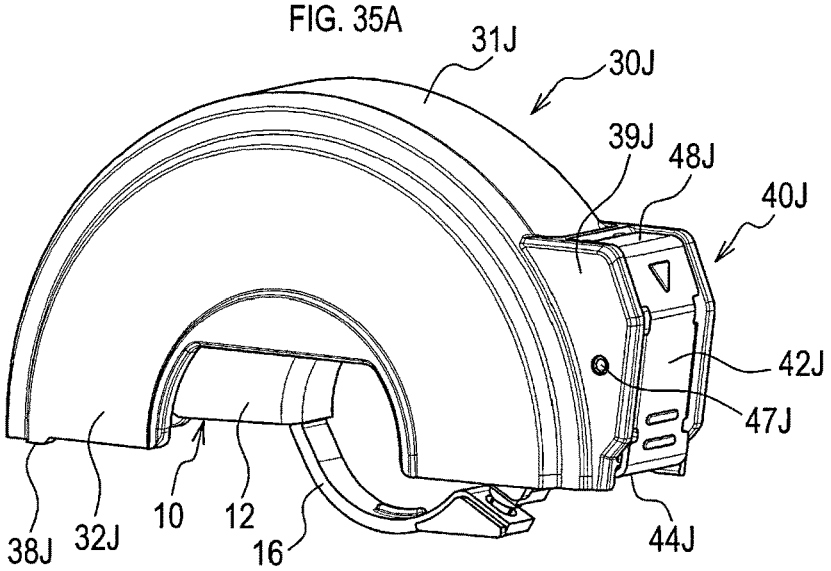
FIG. 35A is a perspective view of the wheel cover with a second cover attached to the first cover, with an engagement member on the wheel cover engaged with a periphery protector on the first cover.
Figure 35B:
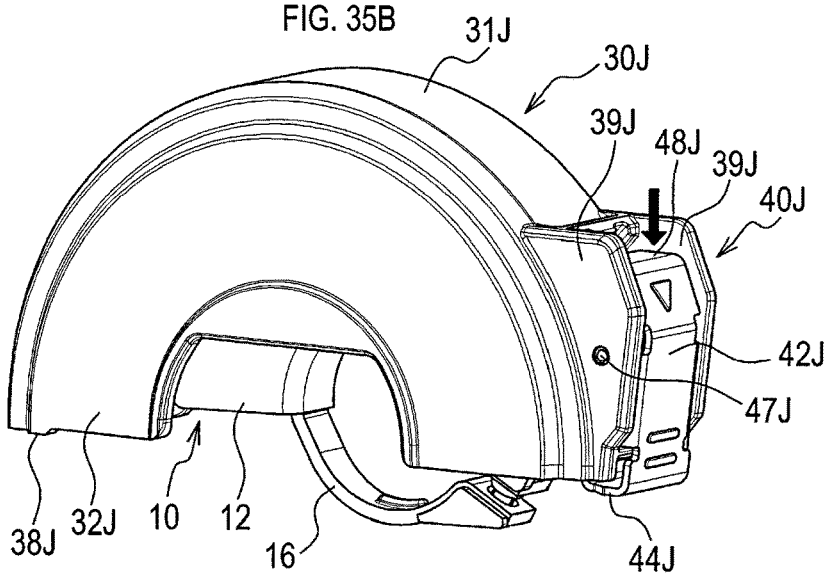
FIG. 35B is a perspective view of the wheel cover with the second cover attached to the first cover, with an operation part of the engagement member pushed to be displaced.
Figure 35C:
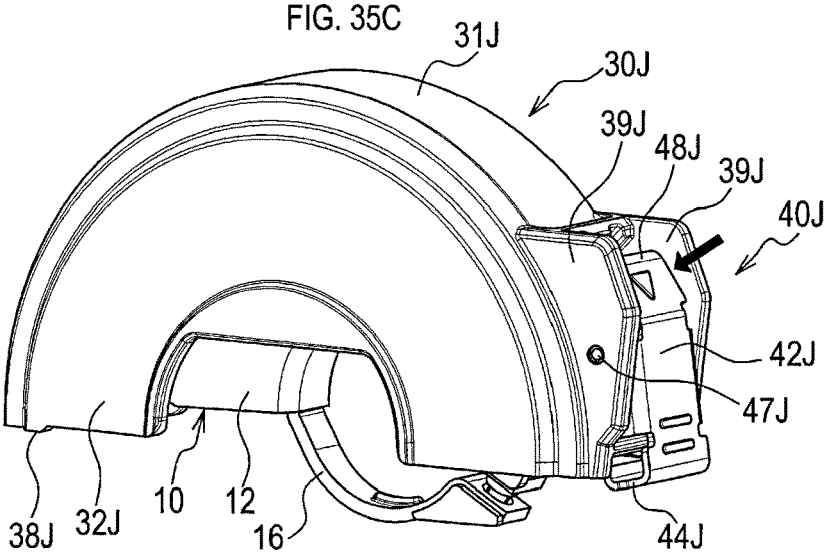
FIG. 35C is a perspective view of the wheel cover with the second cover attached to the first cover, with the engagement member displaced to a retracted position.
Figure 36A:
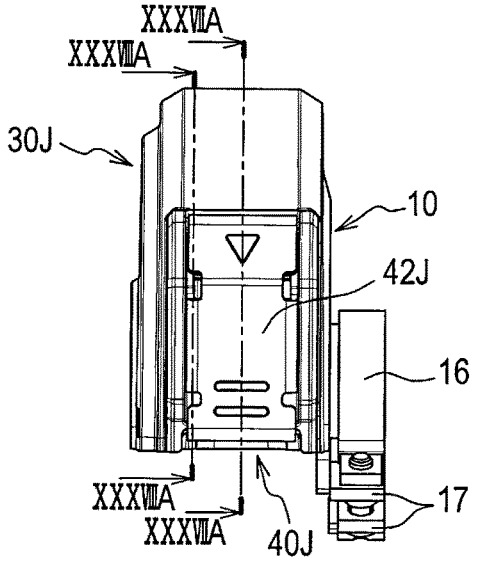
FIG. 36A is a side view of the wheel cover shown in FIG. 35A.
Figure 36B:
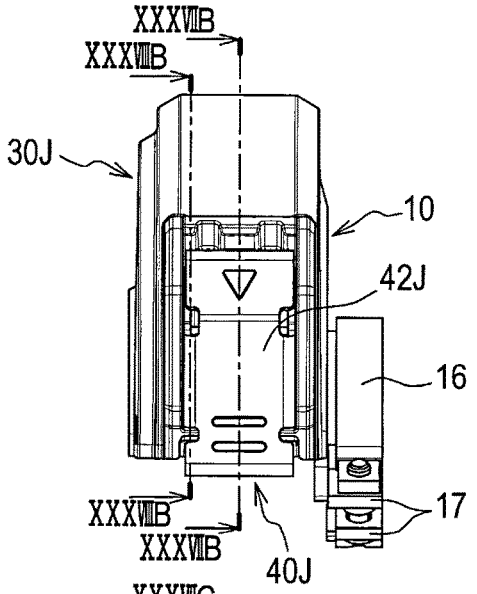
FIG. 36B is a side view of the wheel cover shown in FIG. 35B.
Figure 36C:
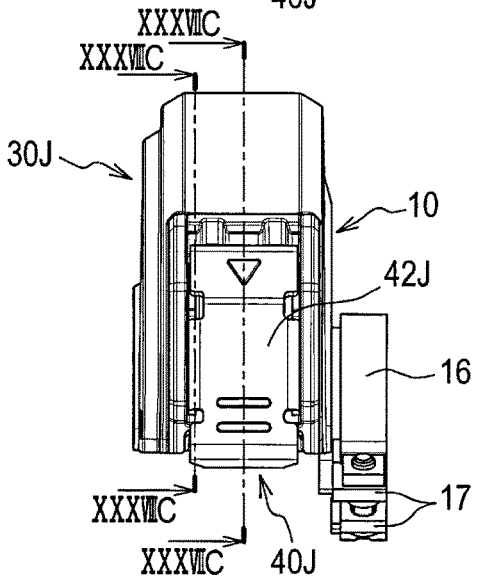
FIG. 36C is a side view of the wheel cover shown in FIG. 35C.

As shown in FIG. 34, the engagement member 40J includes, as in the first embodiment, a movable plate 42J pivotally secured to, about a support shaft 47J, a pair of protruding tabs 39J protruding from the second periphery protector 31J.

The movable plate 42J includes a pair of support pieces 46J bent at a substantially right angle to hold the pair of protruding tabs 39J between them from outside. The movable plate 42J can be in contact with and away from the outer peripheral surface of the second periphery protector 31J with the support shaft 47J placed through the protruding tabs 39J and the support pieces 46J with the two protruding tabs 39J held between the pair of support pieces 46J.

The pair of protruding tabs 39J protrudes from the second periphery protector 31J in a direction opposite to a second plate face protector 32J and a second curved portion 33J. The support shaft 47J thus has its central axis orthogonal to the circumferential direction of the second periphery protector 31J.

The movable plate 42J is thus swingable about the support shaft 47J, allowing one end of the movable plate 42J across the support shaft 47J to be close to or away from a second circumferential end of the second plate face protector 32J. The end of the movable plate 42J is bent at a substantially right angle toward the second periphery protector 31J as an engagement tab 44J engageable with a second circumferential end of the first periphery protector 11.

The engagement member 40J is thus swingable about the support shaft 47J to cause the engagement tab 44J to be displaced between an engagement position at which the engagement tab 44J is engageable with the second circumferential end of the first periphery protector 11 and a retracted position at which the engagement tab 44J is retracted from the engagement position.

The pair of support pieces 46J each has a circumferential elongated slot in the second periphery protector 31A. The slot serves as an insertion hole 45J for receiving the support shaft 47J. The engagement member 40J attached to the second cover 30J is displaceable in the circumferential direction of the second periphery protector 31J.

The movable plate 42J has the other end, which is opposite to the engagement tab 44J, bent toward the second periphery protector 31J. The other end serves as an operation part 48J. An urging member (third elastic member) 49J is located between the engagement member 40J and the second periphery protector 31J. The urging member 49J urges the operation part 48J from the second circumferential end toward the middle of the second periphery protector 31J.

Figure 37A:
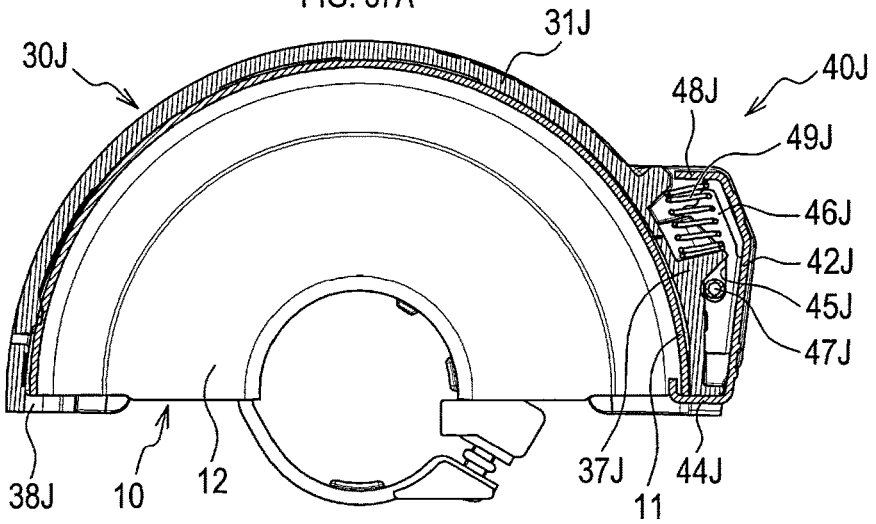
FIG. 37A is a cross-sectional view taken along line XXXVIIA-XXXVIIA in FIG. 36A.
Figure 37B:
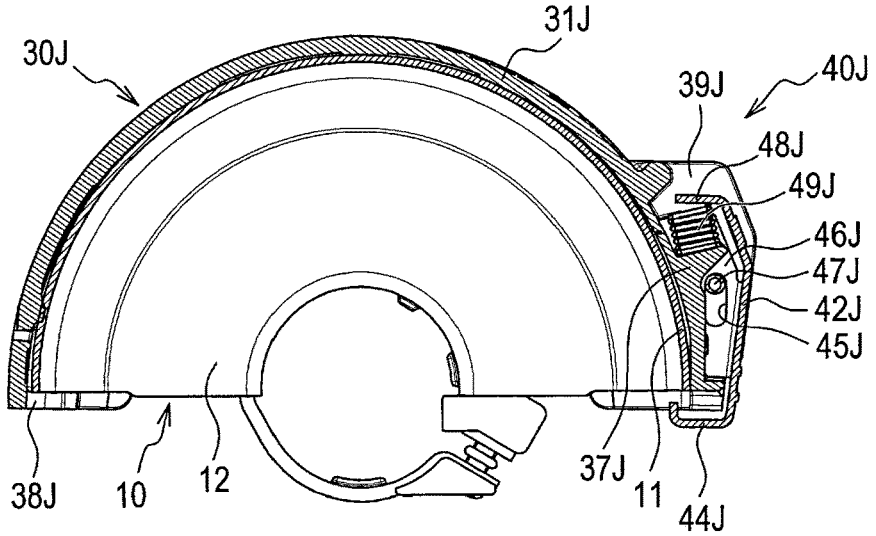
FIG. 37B is a cross-sectional view taken along line XXXVIIB-XXXVIIB in FIG. 36B.
Figure 37C:
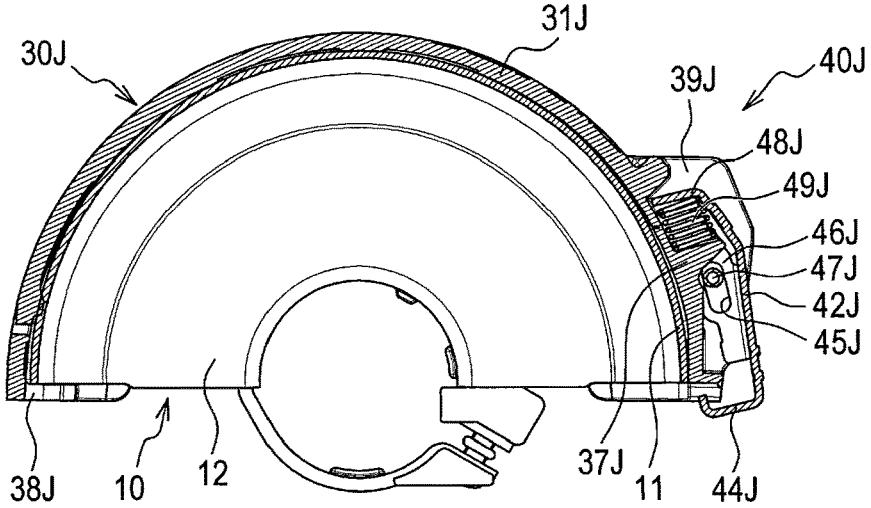
FIG. 37C is a cross-sectional view taken along line XXXVIIC-XXXVIIC in FIG. 36C.

The urging member 49J in the present embodiment includes a coil spring. The urging member 49 is located between a support projection 37J protruding on the outer peripheral surface of the second periphery protector 31J and the operation part 48J, as shown in FIGS. 37A to 37C.

The engagement tab 44J in the engagement member 40J is engaged with a circumferential end of the first periphery protector 11 under the urging force from the urging member 49J, as shown in FIGS. 35A, 36A, 37A, and 38A, in a normal state in which the user is not operating the operation part 48J.

In this state, the second cover 30J is attached to the first cover 10 using the bend 38J on the first end of the second periphery protector 31J and the engagement member 40J, and the first periphery protector 11 and the second periphery protector 31J come in tight contact with each other under the urging force from the urging member 49.

In the present embodiment, the urging member (third elastic member) 49 can reduce rattling of the second cover 30J in the radial direction when the second cover 30J is attached to the first cover 10.

The engagement member 40J can be used for attaching the second cover 30J to the first cover 10 and for causing tight contact between the first periphery protector 11 and the second periphery protector 31J. This reduces the number of components of the wheel cover.

Figure 38A:
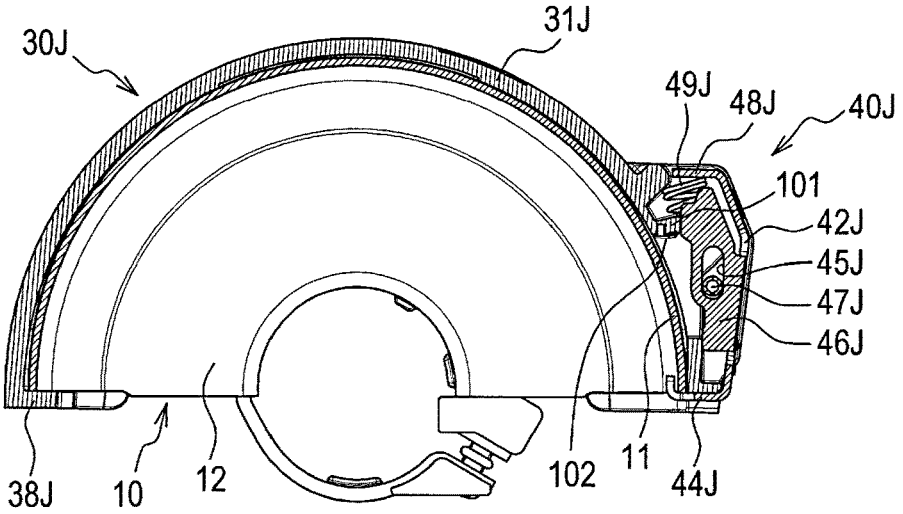
FIG. 38A is a cross-sectional view taken along line XXXVIIIA-XXXVIIIA in FIG. 36A.
Figure 38B:
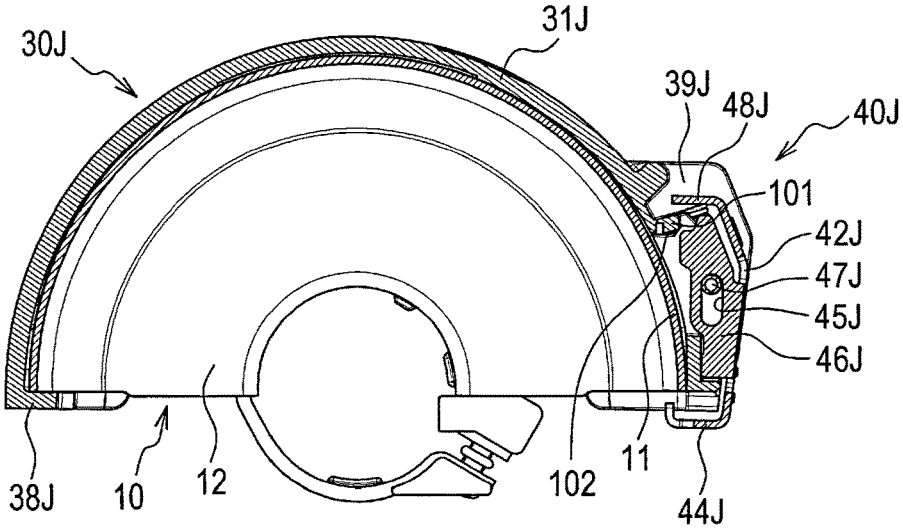
FIG. 38B is a cross-sectional view taken along line XXXVIIIB-XXXVIIIB in FIG. 36B.
Figure 38C:
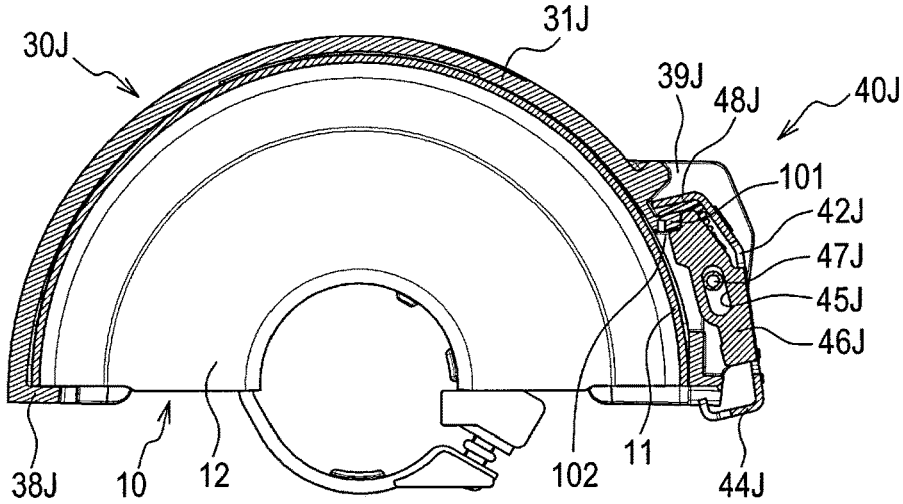
FIG. 38C is a cross-sectional view taken along line XXXVIIIC-XXXVIIIC in FIG. 36C.

As shown in FIGS. 38A to 38C, a projection 101 is located on the outer peripheral surface of the second periphery protector 31J. The projection 101 prevents the engagement member 40 from swinging about the support shaft 47J in the normal state in which the engagement tab 44J is engaged with the first cover 10.

The projection 101 is located to come in contact with the support pieces 46J in the engagement member 40 when the operation part 48J is displaced toward the middle of the second periphery protector 31J. This structure thus avoids disengagement of the engagement tab 44J on the engagement member 40J from the first cover 10 while the second cover 30J is attached to the first cover 10.

When the user pushes the operation part 48J against the urging force from the urging member 49J in this state, the engagement member 40J is displaced toward to the second circumferential ends of the first periphery protector 11 and the second periphery protector 31J, as shown in FIGS. 35B, 36B, 37B, and 38B.

The engagement tab 44J is thus disengaged from the first cover 10, and the second cover 30J can be removed from the first cover 10. In this state, the operation part 48J is also displaced. The engagement member 40J can thus swing about the support shaft 47J without the support pieces 46J coming in contact with the projection 101.

As shown in FIGS. 35C, 36C, 37C, and 38C, when the user pushes and swings the operation part 48J about the support shaft 47J, the engagement tab 44J is displaced from the engagement position at which the engagement tab 44J is engageable with the first cover 10 to the retracted position.

In this state, the engagement tab 44J does not come in contact with the first cover 10 when the second cover 30J is removed from the first cover 10. The second cover 30J can thus be removed easily.

As shown in FIG. 38C, with the engagement tab 44J displaced to the retracted position, the support pieces 46J are in contact with a side wall of the projection 101 adjacent to the engagement tab 44J under the urging force from the urging member 49J. The engagement member 40J is thus retained at the retracted position.

More specifically, the side wall of the projection 101 adjacent to the engagement tab 44J is engaged with the support pieces 46J in the engagement member 40J when the engagement tab 44J is at the retracted position. The projection 101 thus serves as a retainer 102 that retains the engagement tab 44J at the retracted position. The engagement member 40J can be retained in this manner. This eliminates positioning of the engagement member 40J with the operation on the operation part 48J, and thus eliminates continuously operating the operation part 48J in the attachment or removing operation.

The user pushing the operation part 48J can thus swing the operation part 48J about the support shaft 47J to cause the support pieces 46J to be engaged with the retainer 102 and retain the engagement member 40J at the retracted position.

The user can thus easily attach the second cover 30J to the first cover 10, in addition to the removal of the second cover 30J from the first cover 10. The operability can thus be improved.

The user can also swing, with the second cover 30J attached to the first cover 10, the engagement member 40J by operating the operation part 48J to be away from the periphery protector 31J to disengage the support piece 46J from the retainer 102. In this state, the second cover 30J is firmly attached to the first cover 10 under the urging force from the urging member 49J.

In the present embodiment, the second cover 30J is attachable to the first cover 10 using the bend 38J and the engagement member 40J on the second cover 30J. This structure reduces rattling of the second cover 30J.

The second cover 30J simply including the bend 38J and the engagement member 40J can achieve the intended effect of the present disclosure.

Figure 39:
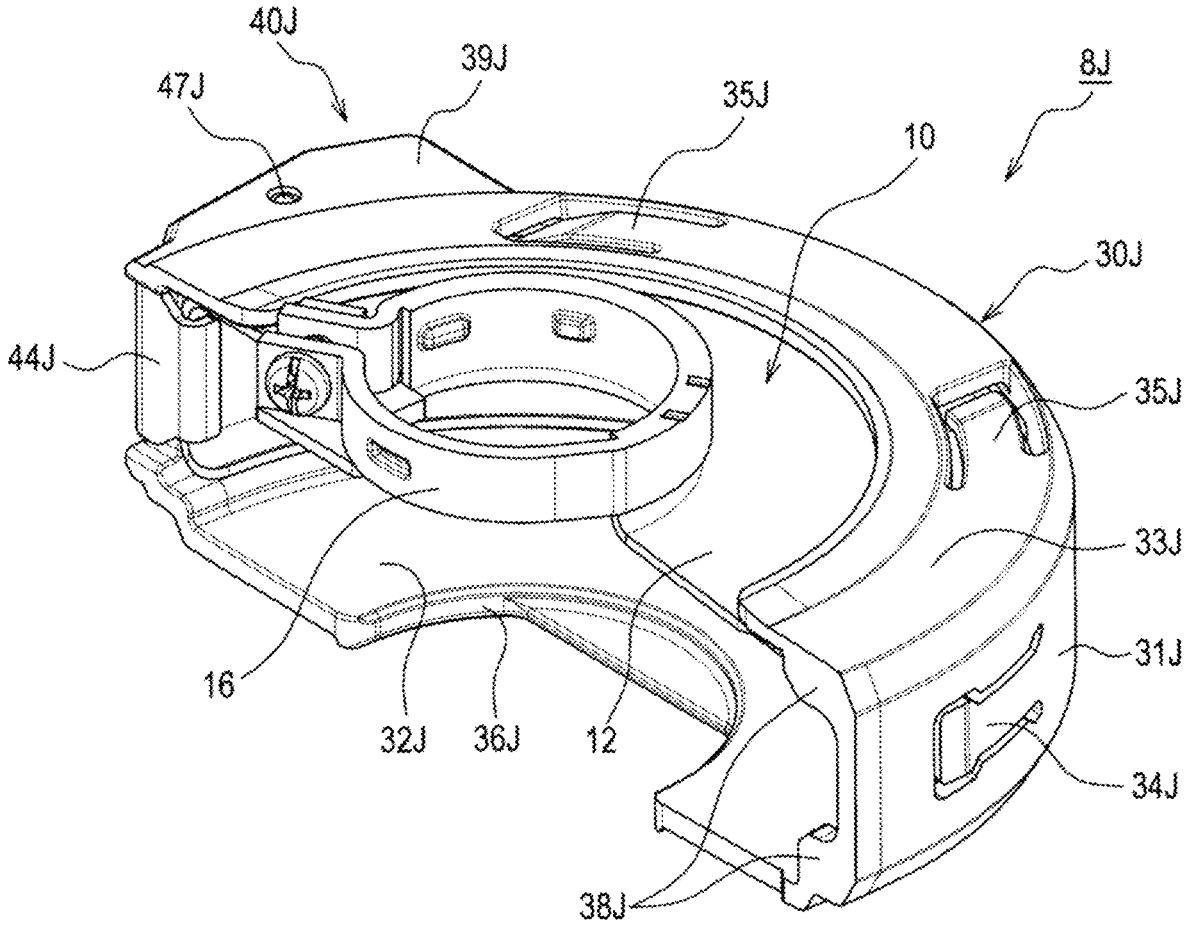
FIG. 39 is a perspective view of the wheel cover with the second cover attached to the first cover as viewed in a direction opposite to FIGS. 34 to 35C.

In contrast, as shown in FIG. 39, the wheel cover 8J according to the present embodiment includes an elastic strip 34J in the second periphery protector 31J and elastic strips 35J in the second curved portion 33J, which are both leaf springs, similarly to the wheel cover 8 according to the first embodiment.

In the structure according to the present embodiment, the elastic strips 34J and 35J, and the urging member (third elastic member) 49J in the engagement member 40J can more reliably reduce rattling of the second cover 30J.

The elastic strip 34J is located on the end of the second periphery protector 31J opposite to the second circumferential end on which the engagement member 40J is located. This structure thus reduces rattling of the second cover 30J at the two circumferential ends of the second periphery protector 31J.

In the present embodiment, the second cover 30J can be placed over the first cover 10 with the second plate face protector 32J facing the first plate face protector 12. However, with an attachment preventive portion 36J shown in FIG. 34 in contact with the annular member 16, the second cover 30J cannot be placed over the first cover 10 to have the second plate face protector 32J overlapping the first plate face protector 12.

The second cover 20J in the present embodiment may not include the attachment preventive portion 36J. In this case, the second cover 30J can be placed over the first cover 10 with the second plate face protector 32J overlapping the first plate face protector 12.

The first to seventh embodiments and the first to fourth modifications of the present disclosure have been described above. The wheel cover in one or more aspects of the present disclosure may include multiple components that replace a single component with multiple functions described in each of the above embodiments and modifications. The wheel cover may include multiple components that replace a single component with a single function. The wheel cover may include a single component that replaces multiple components with multiple functions, or that replaces multiple components with a single function. Some of the components of the above embodiments may be eliminated. One or more of the components in each of the above embodiments may be added to or replaced by one or more of the components described in another one of the embodiments. The embodiments of the present invention include all possible embodiments that fall within the technical idea set forth in the claims.

REFERENCE SIGNS LIST

1 grinder
4 gear housing
5 output shaft
6 tip tool
8, 8A to 8E wheel cover
11 periphery protector
12 plate face protector
13 curved portion
30, 30A to 30I second cover
31, 31A to 31J periphery protector
32, 32A to 32J plate face protector
33, 33C, 33F to 33J curved portion
34, 34A to 34C, 34F, 34G, 34J elastic strip
35, 35C, 35J elastic strip
38J bend
40J engagement member
49J urging member
48J operation part
47J support shaft
102 retainer
70, 80 plate
74, 84 elastic strip
91 to 93, 95 elastic member

The invention claimed is:

1. A wheel cover for covering a disk-shaped tip tool attached to an output shaft of a power tool, the wheel cover comprising:

a first cover attachable to a body of the power tool to cover at least a portion of a first surface of the tip tool, the first surface being adjacent to the body of the power tool;

a second cover removably attachable to the first cover to cover at least a portion of a second surface of the tip tool, the second surface being opposite to the body of the power tool; and a rattle restrainer configured to reduce, while the second cover is attached to the first cover, rattling of the second cover relative to the first cover, wherein:

the rattle restrainer is configured to reduce rattling of the second cover at least in a radial direction of the tip tool intersecting with the output shaft or in an axial direction parallel to the output shaft, the first cover includes:

a first plate face protector facing the first surface of the tip tool to protect a first plate face of the tip tool, and a first periphery protector facing a peripheral edge of the tip tool about the output shaft to protect a periphery of the tip tool, the second cover includes:

a second plate face protector facing the second surface of the tip tool to protect a second plate face of the tip tool, and a second periphery protector facing the peripheral edge of the tip tool about the output shaft to protect the periphery of the tip tool, the second cover is attachable to the first cover to have the second periphery protector overlapping the first periphery protector, and the rattle restrainer includes at least one first elastic strip to urge the first periphery protector and the second periphery protector away from each other.

2. The wheel cover according to claim 1, wherein the at least one first elastic strip includes an elastic strip in the first periphery protector or the second periphery protector, and the elastic strip in the first periphery protector or the second periphery protector is movable in the radial direction.

3. The wheel cover according to claim 2, wherein the first elastic strip is integral with the first periphery protector or the second periphery protector across a cutout.

4. The wheel cover according to claim 2, wherein the first elastic strip is a member separate from the first cover and separate from the second cover, and is fixed to the first periphery protector or the second periphery protector.

5. The wheel cover according to claim 1, wherein the at least one first elastic strip is located between the first periphery protector and the second periphery protector in a deformable manner.

6. The wheel cover according to claim 5, wherein the at least one first elastic strip comprises elastic rubber, a sponge, or an elastomer.

7. The wheel cover according to claim 1, wherein the at least one first elastic strip includes a plurality of first elastic strips along the first periphery protector or the second periphery protector in a circumferential direction.

8. The wheel cover according to claim 1, wherein the second cover has a second curved portion on an end of the second periphery protector opposite to an end adjacent to the second plate face protector to hold the first periphery protector between the second curved portion and the second plate face protector, the second cover is attachable to the first cover to have the second periphery protector overlapping the first periphery protector and the first periphery protector held between the second plate face protector and the second curved portion, and the rattle restrainer includes at least one second elastic strip to urge the second curved portion away from the first plate face protector.

9. The wheel cover according to claim 8, wherein the at least one second elastic strip includes an elastic strip in the second curved portion, and the elastic strip in the second curved portion is movable in the axial direction.

10. The wheel cover according to claim 9, wherein the elastic strip in the second curved portion is integral with the second curved portion across a cutout.

11. The wheel cover according to claim 8, wherein the at least one second elastic strip is located between the second curved portion and the first cover in a deformable manner.

12. The wheel cover according to claim 8, wherein the at least one second elastic strip includes a plurality of second elastic strips in the second curved portion along the second periphery protector in a circumferential direction.

13. The wheel cover according to claim 1, wherein the second cover is attachable to the first cover to have the second periphery protector overlapping the first periphery protector, and the rattle restrainer includes a spring to urge the first periphery protector and the second periphery protector to be in direct contact with each other.

14. The wheel cover according to claim 13, wherein the second periphery protector covers the first periphery protector, the second cover includes a bend located on a first circumferential end of the second periphery protector and engageable with a first circumferential end of the first periphery protector, and a clip located on a second circumferential end of the second periphery protector and deformable in a circumferential direction of the second periphery protector, and the clip is manually engageable with a second circumferential end of the first periphery protector when the second cover is attached to the first cover, and the spring is located on the second circumferential end of the second periphery protector to urge the clip from the second circumferential end toward a middle of the second periphery protector.

15. The wheel cover according to claim 14, wherein the clip includes a push tab operable to displace the clip toward the second circumferential end of the second periphery protector against an urging force from the spring.

16. The wheel cover according to claim 15, wherein the second periphery protector holds a support shaft orthogonal to the circumferential direction of the second periphery protector on an outer peripheral surface on the second circumferential end of the second periphery protector, and the clip is axially supported on the support shaft in a manner swingable between an engagement position at which the clip is engageable with the second circumferential end of the first periphery protector and a retracted position at which the clip is retracted from the engagement position.

17. The wheel cover according to claim 16, wherein the second periphery protector includes, on the outer peripheral surface on the second circumferential end of the second periphery protector, a retainer engageable with the clip to retain the clip at the retracted position when the clip is displaced toward the second circumferential end of the second periphery protector against the urging force from the spring.

18. A wheel cover for covering a disk-shaped tip tool attached to an output shaft of a power tool, the wheel cover comprising:

a first cover attachable to a body of the power tool to cover at least a portion of a first surface of the tip tool, the first surface being adjacent to the body of the power tool, the first cover including a first plate face protector facing the first surface of the tip tool to protect a first plate face of the tip tool, and a first periphery protector facing a peripheral edge of the tip tool about the output shaft to protect a periphery of the tip tool; and a second cover removably attachable to the first cover to cover at least a portion of a second surface of the tip tool, the second surface being opposite to the body of the power tool, the second cover including a second plate face protector facing the second surface of the tip tool to protect a second plate face of the tip tool, a second periphery protector facing the peripheral edge of the tip tool about the output shaft to protect the periphery of the tip tool, a bend located on a first circumferential end of the second periphery protector and engageable with a first circumferential end of the first periphery protector, a clip located on a second circumferential end of the second periphery protector and deformable in the circumferential direction of the second periphery protector, the clip being manually engageable with a second circumferential end of the first periphery protector when the second cover is attached to the first cover, the second circumferential end of the second periphery protector located circumferentially opposite to the first circumferential end of the second periphery protector, and a spring located on the second circumferential end of the second periphery protector, to urge the clip from the second circumferential end toward a middle of the second periphery protector, wherein the second cover is attachable to the first cover to have the second periphery protector overlapping the first periphery protector and the second periphery protector covering the first periphery protector.

19. The wheel cover according to claim 18, wherein the clip includes a push tab operable to displace the clip toward the second circumferential end of the second periphery protector against an urging force from the spring, the second periphery protector holds a support shaft orthogonal to the circumferential direction of the second periphery protector on an outer peripheral surface on the second circumferential end of the second periphery protector, the clip is axially supported on the support shaft in a manner swingable between an engagement position at which the clip is engageable with the second circumferential end of the first periphery protector and a retracted position at which the clip is retracted from the engagement position, and the second periphery protector includes, on the outer peripheral surface on the second circumferential end of the second periphery protector, a retainer engageable with the clip to retain the clip at the retracted position when the clip is displaced toward the second circumferential end of the second periphery protector against the urging force from the spring.

* * * * *